US012262833B2

(12) United States Patent
Freudenthal

(10) Patent No.: US 12,262,833 B2
(45) Date of Patent: Apr. 1, 2025

(54) COLLAPSIBLE FACETED OBJECT HAVING A CLOSED THREE-DIMENSIONAL SHAPE

(71) Applicant: Foldaments, LLC, Lucas, TX (US)

(72) Inventor: Richard Freudenthal, Lucas, TX (US)

(73) Assignee: Foldaments, LLC, Lucas, TX (US)

( * ) Notice: Subject to any disclaimer, the term of this patent is extended or adjusted under 35 U.S.C. 154(b) by 48 days.

(21) Appl. No.: 17/899,850

(22) Filed: Aug. 31, 2022

(65) Prior Publication Data

US 2023/0071235 A1 Mar. 9, 2023

Related U.S. Application Data

(60) Provisional application No. 63/239,179, filed on Aug. 31, 2021.

(51) Int. Cl.

| | |
|---|---|
| ***A63H 33/00*** | (2006.01) |
| ***A47G 33/08*** | (2006.01) |
| ***G09F 1/06*** | (2006.01) |

(52) U.S. Cl.

CPC ..... *A47G 33/08* (2013.01)

(58) Field of Classification Search

CPC ..... G09F 1/06; A47G 33/08

See application file for complete search history.

(56) References Cited

U.S. PATENT DOCUMENTS 1,734,954 A * 11/1929 Arvidson ..... A47G 33/08 428/8
2,191,041 A * 2/1940 Protz ..... A47G 33/08 428/7
2,977,701 A 4/1961 Louderback
3,060,609 A 10/1962 Woolven
3,571,958 A 3/1971 Stevens et al.
3,668,796 A 6/1972 Patterson (Continued)

FOREIGN PATENT DOCUMENTS

CN 2485514 Y 4/2002
CN 105674206 A 6/2016

(Continued)

OTHER PUBLICATIONS

Gerson, "29.9 in. H Assorted Metal Wire Collapsible Ornaments with Remote Control Feature (Set of 3)", Model #2486270EC, viewed at www.homedepot.com, Sep. 22, 2020, 4 pages.

(Continued)

*Primary Examiner* — Shin H Kim

(74) *Attorney, Agent, or Firm* — Slater Matsil, LLP

(57) ABSTRACT

In a first embodiment, a collapsible faceted object includes a number of interconnected rigid facet panels. The facet panels are arranged so that the object can be in either a flat state or an expanded state. In the flat state, the facet panels are substantially parallel to one another and the object has a first thickness in a direction perpendicular to the parallel facet panels. In the expanded state, the object has a visually continuous outer surface that forms a closed three-dimensional shape and a second thickness in the direction perpendicular. The second thickness is substantially larger than the first thickness. The object is capable of remaining in both the flat state and the expanded state without application of an external force.

25 Claims, 33 Drawing Sheets

(56) References Cited

U.S. PATENT DOCUMENTS

| | | | | |
|---|---|---|---|---|
| 3,722,153 | A * | 3/1973 | Baer | E04B 1/32 D25/13 |
| 4,319,418 | A | 3/1982 | Transport | |
| 4,492,723 | A | 1/1985 | Chadwick, II | |
| 4,773,622 | A | 9/1988 | Herlin | |
| 4,794,024 | A | 12/1988 | Crowell et al. | |
| 5,393,579 | A | 2/1995 | Witte | |
| 5,752,649 | A | 5/1998 | Weder | |
| 5,814,380 | A | 9/1998 | Tamborello et al. | |
| 5,937,553 | A | 8/1999 | Maran | |
| 6,006,457 | A | 12/1999 | Transport | |
| 6,264,199 | B1 * | 7/2001 | Schaedel | A63F 9/088 273/157 R |
| 6,379,212 | B1 * | 4/2002 | Miller | A63H 33/084 446/85 |
| 6,579,578 | B1 | 6/2003 | Lai | |
| 7,029,364 | B1 | 4/2006 | Thomasson | |
| 7,320,816 | B2 | 1/2008 | Quigel | |
| 7,546,702 | B2 * | 6/2009 | Malkovas | G09F 1/08 446/148 |
| 10,759,161 | B2 | 9/2020 | Todie | |
| 2001/0013188 | A1 | 8/2001 | Hall | |
| 2004/0256282 | A1 | 12/2004 | Glenn | |
| 2007/0275840 | A1 | 11/2007 | Bennett | |
| 2008/0286499 | A1 | 11/2008 | Spaar | |
| 2011/0095074 | A1 | 4/2011 | Stephens | |
| 2015/0314909 | A1 | 11/2015 | Escuin | |
| 2020/0273374 | A1 | 8/2020 | Rostami | |
| 2023/0071235 | A1 * | 3/2023 | Freudenthal | A47G 33/08 |

FOREIGN PATENT DOCUMENTS

| | | | |
|---|---|---|---|
| TW | M506923 | U | 8/2015 |
| WO | 2017173486 | A1 | 10/2017 |
| WO | 2017190163 | A1 | 11/2017 |

OTHER PUBLICATIONS magicornaments.com, downloaded Jul. 18, 2021, 17 pages.
Magic ornaments nok, Selected screen shots from YouTube video, https://www.youtube.com/watch?v=4sDFKM-MG88, Mar. 27, 2019, 16 pages.

* cited by examiner

FIG. 14A
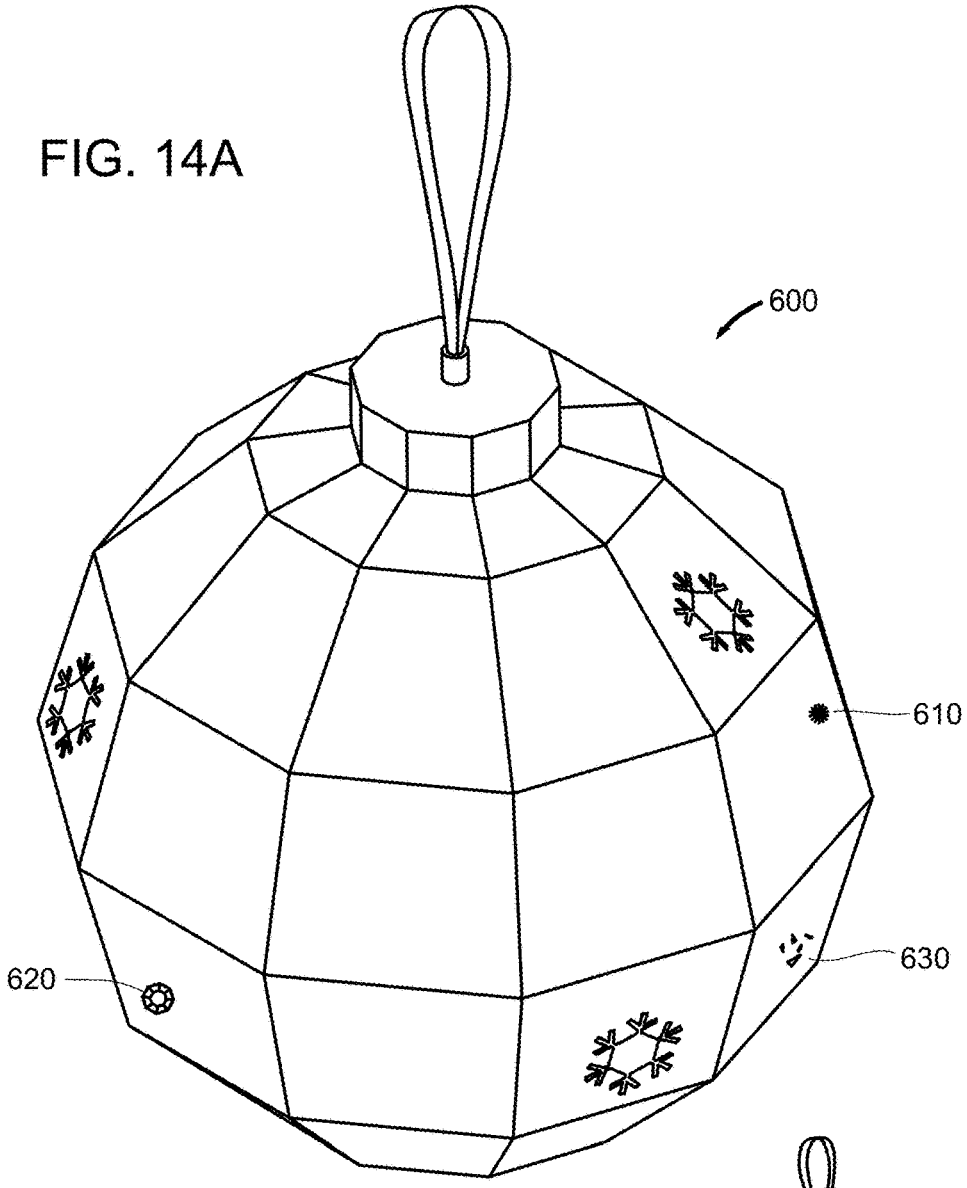
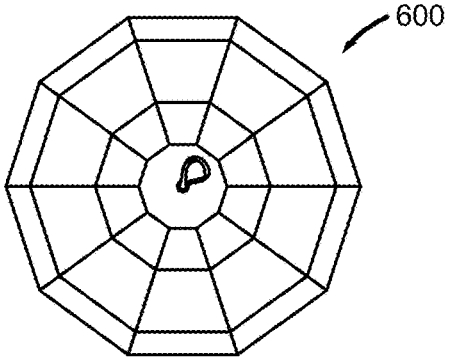
FIG. 14B
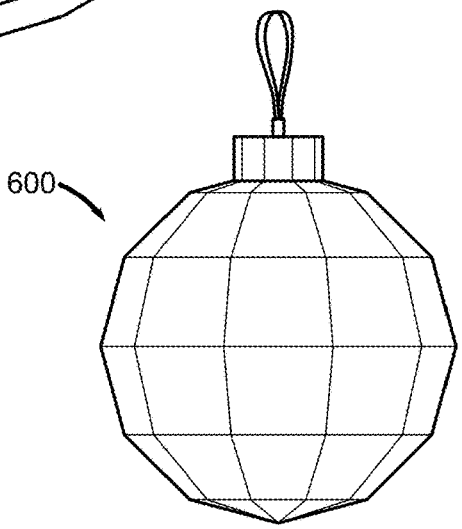
FIG. 14C

FIG. 15D
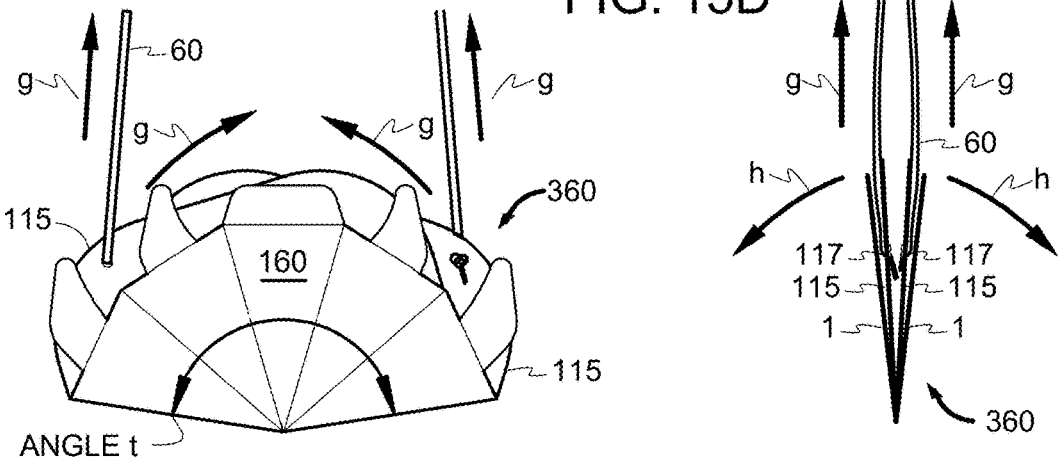
FIG. 15E
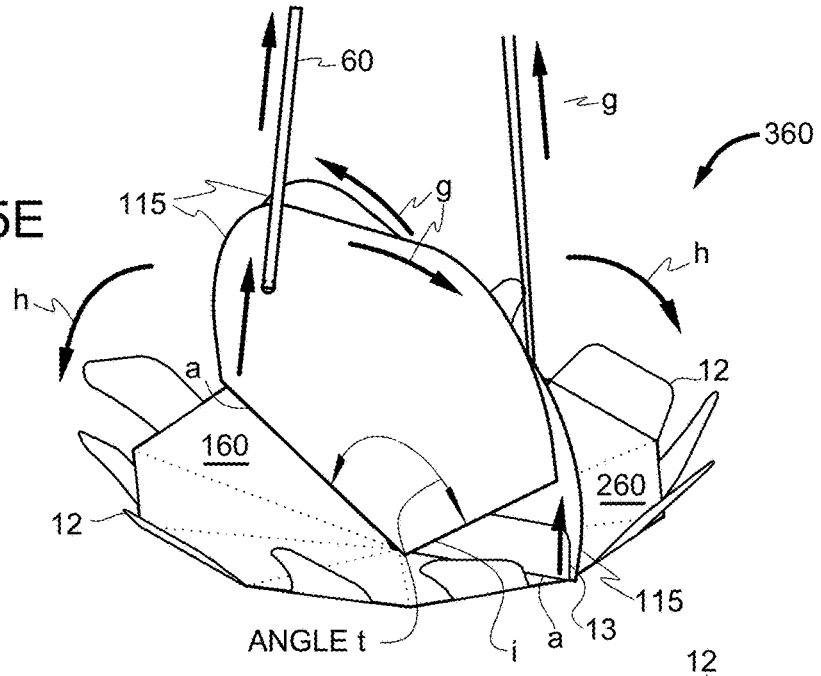
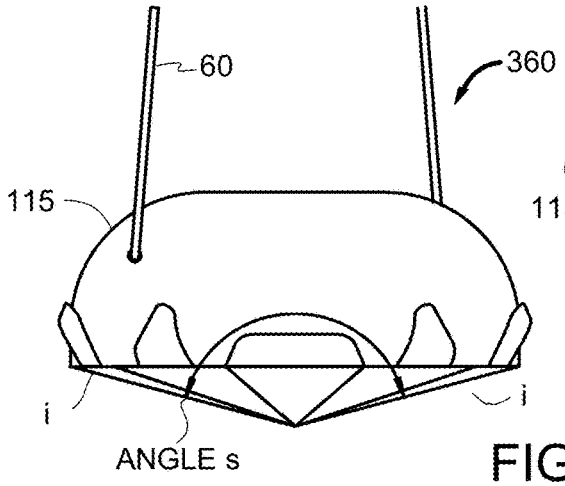
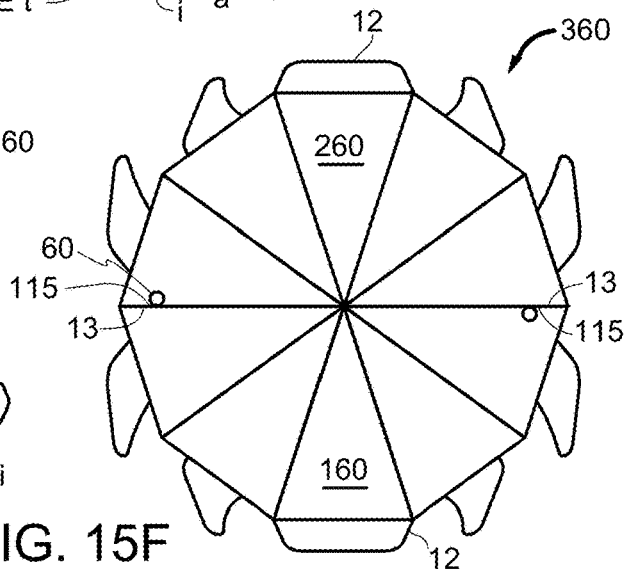
FIG. 15F

COLLAPSIBLE FACETED OBJECT HAVING A CLOSED THREE-DIMENSIONAL SHAPE

CROSS-REFERENCE TO RELATED APPLICATIONS

This application claims the benefit of U.S. Provisional Application No. 63/239,179, filed on Aug. 31, 2021, which application is hereby incorporated herein by reference.

TECHNICAL FIELD

Embodiments of the present invention relate generally to a collapsible object having a closed three-dimensional shape.

BACKGROUND

Oversized ornaments are often used for holidays, parties, weddings, events, and other celebrations. For example, in wintertime snowmen, Christmas trees and ornaments, reindeer, and other decorations can be found. These objects can be large so they are visible in a home's yard or a retail location. While the size is advantageous for display, it can be a detriment when shipping and storing the objects in a retail store, warehouse, or homeowners' storage space.

U.S. Patent Pub. No. 2020/0273374 discloses an apparatus comprised of flexible gores that are serially connected to each other at their lateral adjoining edges. These gores have a hole in their polar region and a drawstring runs through the gores' holes such that, when the drawstring is pulled, the drawstring pulls the gores' polar regions together and a radial three dimensional shape forms.

U.S. Patent Pub. No. 2011/0095074 is directed toward a polygonal container having at least five interconnected body panels and a blank for making the polygonal container. The ends of the polygonal container are provided with a plurality of pie shaped triangular sections that can provide unique decorative experience to the user of a consumer product contained and dispensed from therein.

U.S. Pat. No. 3,571,958 discloses a pop up display that is constructed from two blanks and a closed loop resilient material. Each blank consists of a central polygonal panel to each edge of which is hingedly attached a pentagonal flap, which is further bounded by two inner sides flanking the side common to the flap and panel and two outer sides. At least one outer side of each flap may have a tab portion. The two blanks are placed with their panels in face to face contact and the closed loop is disposed about the periphery of the blanks so that it crosses each outer side and lies in contact with the exposed faces of the flaps. Under the influence of the closed loop of resilient material, the blanks are caused to adopt a polygonal configuration but can be flattened against the influence of the closed loop of resilient material for insertion into a flat container such as a mailing envelope or the like.

SUMMARY

In a first embodiment, a collapsible faceted object comprises a plurality of interconnected rigid facet panels. The facet panels are arranged so that the object can be in either a flat configuration or an expanded configuration. In the flat configuration, the facet panels are substantially parallel to one another and the object has a first thickness in a direction perpendicular to the parallel facet panels. In the expanded configuration, the object has a visually continuous outer surface that forms a closed three-dimensional shape and a second thickness in the direction perpendicular. The second thickness is substantially larger than the first thickness. The object is capable of remaining in both the flat configuration and the expanded configuration without application of an external force.

In another embodiment, a collapsible faceted object comprises a plurality of pattern groups interconnected along a spine. Each pattern group includes a plurality of rigid facet panels so that each facet panel is attached to an adjacent facet in the respective pattern group by a flexible joint. Each facet panel is spaced from an adjacent facet panel by an open space when the object is in a collapsed state and each facet panel has an edge that is parallel to an edge of the adjacent facet panel when the object is in an expanded state. A guide mechanism is configured so that the object can be transformed from the collapsed state to the expanded state by simultaneously moving the facet panels to close the open spaces in a manner guided by the guide mechanism and so that the object can be transformed from the expanded state to the collapsed state by simultaneously moving the facet panels to create the open spaces between the facet panels in a manner guided by the guide mechanism.

Embodiments of making a collapsible object are also disclosed. In one embodiment, a plurality of separate pattern groups are formed from a hard-sided material. Each pattern group includes a plurality of facet panels separated by a flexible joint. Sliding alignment guide tabs are provided for the facet panels. The pattern groups are loaded into a fixture in a layered manner so that the sliding alignment guide tabs of one pattern group overlies an adjacent pattern group. Slot stiffener tabs are attached to the pattern groups so that each slot stiffener tab overlies but is not attached to the associated sliding alignment guide tabs thereby forming guide tab slot. Each pattern group is attached to an adjacent pattern group.

BRIEF DESCRIPTION OF THE DRAWINGS

For a more complete understanding of the present invention, and the advantages thereof, reference is now made to the following descriptions taken in conjunction with the accompanying drawings, in which:

FIGS. 13A-3D show the assembly of a neck accessory part;

FIGS. 14A-14C illustrate perspective, side, and top views, respectively, of a completed object;

FIGS. 15A-15F show the formation and function of a bottom cone portion of a sphere;

DETAILED DESCRIPTION OF ILLUSTRATIVE EMBODIMENTS

The following description provides examples of embodiments of the invention. It is understood that features shown in various embodiments can be combined.

In a first embodiment, a collapsible Christmas/holiday ornament resembles a traditional holiday tree ornament of a globe shaped sphere, teardrop or other 3-dimensional shape having a seemingly continuous unbroken exterior surface having interior volume made from 2-dimensional rigid sheet materials that can be disassembled or collapsed to a flattened state requiring reduced volumetric space (storage space). Such a "pop-up" design allows for ease and repeatable transformation from flat to expanded states without any excessive assembly or disassembly.

Using a combination of multi-sided shaped rigid facet panels, flexible hinged joints connecting adjacent facet panels, and retracting articulating or "sliding joints" that are allowed to open and close negative spaces in-between the facet panels in a mechanically controlled manner, a normally flat, rigid 2-dimensional sheet material can be manipulated to change its form from a 2-dimensional flat surface into a hard sided 3-dimensional shape resembling a known recognizable object having a visually unbroken surface. The mechanics of these interconnected, movable sliding articulating joints and facet surface panels afford minimal or no assembly effort or time to create the display object as well as enabling repeatable transformation from open to closed states.

As described below, the collapsible objects can take on a number of configurations. The holiday ornament is just one example.

These collapsible objects can be used in a number of contexts. In the commercial space, office buildings, municipal, hospitality, event centers, retail stores and malls can use the object or an assortment of objects for seasonal décor. Homeowner uses include smaller objects for interior décor and larger objects for outside, (e.g., on the lawn, hanging from balcony, eaves, or exterior tree).

Figure 1:
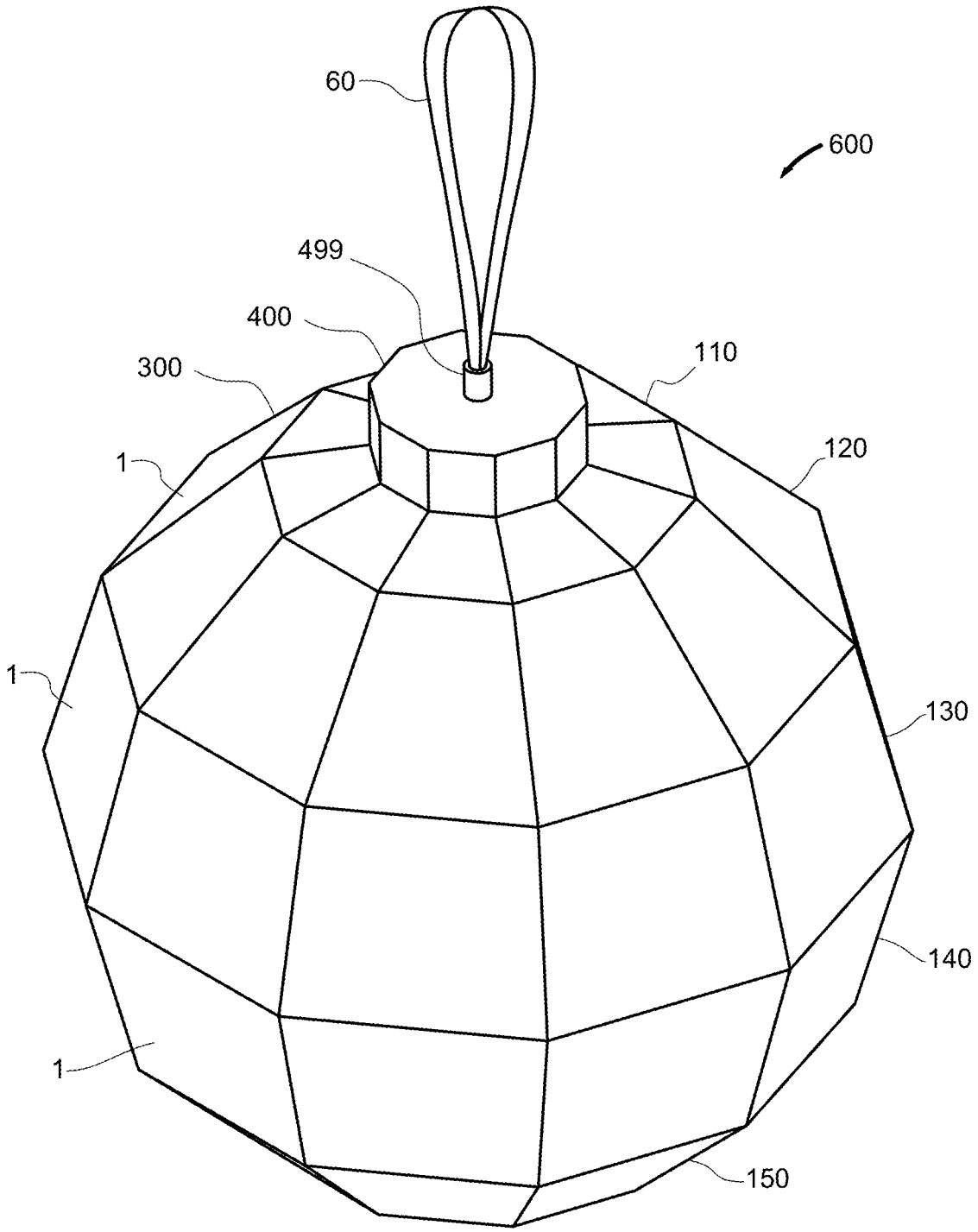
FIG. 1 illustrates an example of a collapsible object according to an embodiment.

FIG. 1 illustrates an example of a collapsible object, in this case a Christmas ornament. The object is formed of rigid facet panels 1 and can be easily expanded and collapsed as needed. This feature is advantageous for seasonal decorations that are reused and need to be stored out of season. It is also advantageous for shipping purposes since the object can take very little space in shipping containers and while otherwise being transported. In fact, non-seasonal objects, (e.g., a globe) can be designed to ship or be merchandised on store shelving or kiosk in a collapsed form and then be expanded by the end user.

The example Christmas ornament shown in FIG. 1 can be sized to be hung on a typical home Christmas tree, a larger commercial Christmas tree, exterior tree, or singularly or in groupings from a ceiling. At least in part due to the rigid facet panels, the ornament can also be made much bigger (e.g., sized to fit in a retail shopping center or an office building lobby). For example, the ornament can be several feet in diameter while maintaining structural integrity. Size examples of different diameters are shown in the chart below.

| | | |
|---|---|---|
| Homeowner interior | 6-8" | Greeting cards, hung on Christmas tree or home décor (on mantel, buffet, table arrangement) |
| Homeowner interior décor | 10" to 2' | Floor arrangements, hung from ceiling, interior balcony, foyer or staircase arrangements |
| Homeowner exterior | 2' to 5' | Lawn décor, hung from landscape trees, |
| Commercial, Municipal | 4' to 12' | Floor display or hanging in airport, retail stores, shopping mall, office building atriums, hotel/casino lobby, parks, street décor. |

These sizes and uses are provided only as examples.

The example in FIG. 1 shows a sphere 300 with a cylinder 400 attached to the top of the sphere 300, thereby forming an ornament 600. The sphere 300 includes six consecutive rings 110-160 of facet panels 1 to illustrate the construction of the object 600. Each ring includes a plurality of facet panels 1 and forms a pattern group. As will be discussed below, the number of facet panels 1 could be significantly larger so that the object presents a substantially smooth outer surface, or fewer facet panels to present a more "geometric" shape.

The surface can be opaque, translucent, or clear with printed artwork and/or have sparkles or other decorative surface materials with or without other added ornaments. Both opaque, translucent, and clear materials could have internal illumination and/or surface accent lighting (e.g., LED lighting) powered by batteries or cord to external power source.

Objects may include secondary accessory parts or other ornaments to enhance the design. Examples may include faux greenery, ribbons, a snowman's scarf or a gnome's staff.

While not shown in FIG. 1, it is understood that a multitude of decorative surface materials or any design or pattern could be printed on the outer surface of the object. The object can be formed so as to resemble a recognizable object. For example, the object of FIG. 1 resembles a Christmas ornament. In this context, the object resembles a recognizable object when the appearance of the object can be construed as something different than the object itself by an ordinary person. For example, a container with the lid closed would be construed as a container and, therefore, would not resemble a recognizable object as the term is used here. Example objects that resemble a recognizable object include a collapsible sphere that resembles a Christmas ornament or a ball (e.g., baseball, basketball, soccer ball). An elongated sphere could resemble an Easter egg or jack-o-lantern (pumpkin) or football. Further embodiments other than spheres are discussed below.

FIGS. 2A-2J illustrate an example of how the object can be expanded and collapsed. This assembly process can be performed by an untrained individual with relative ease. In other words, the user, who may be a homeowner, special event planner, or facilities worker for a commercial building can expand and collapse the object relatively quickly.

Figure 2A:
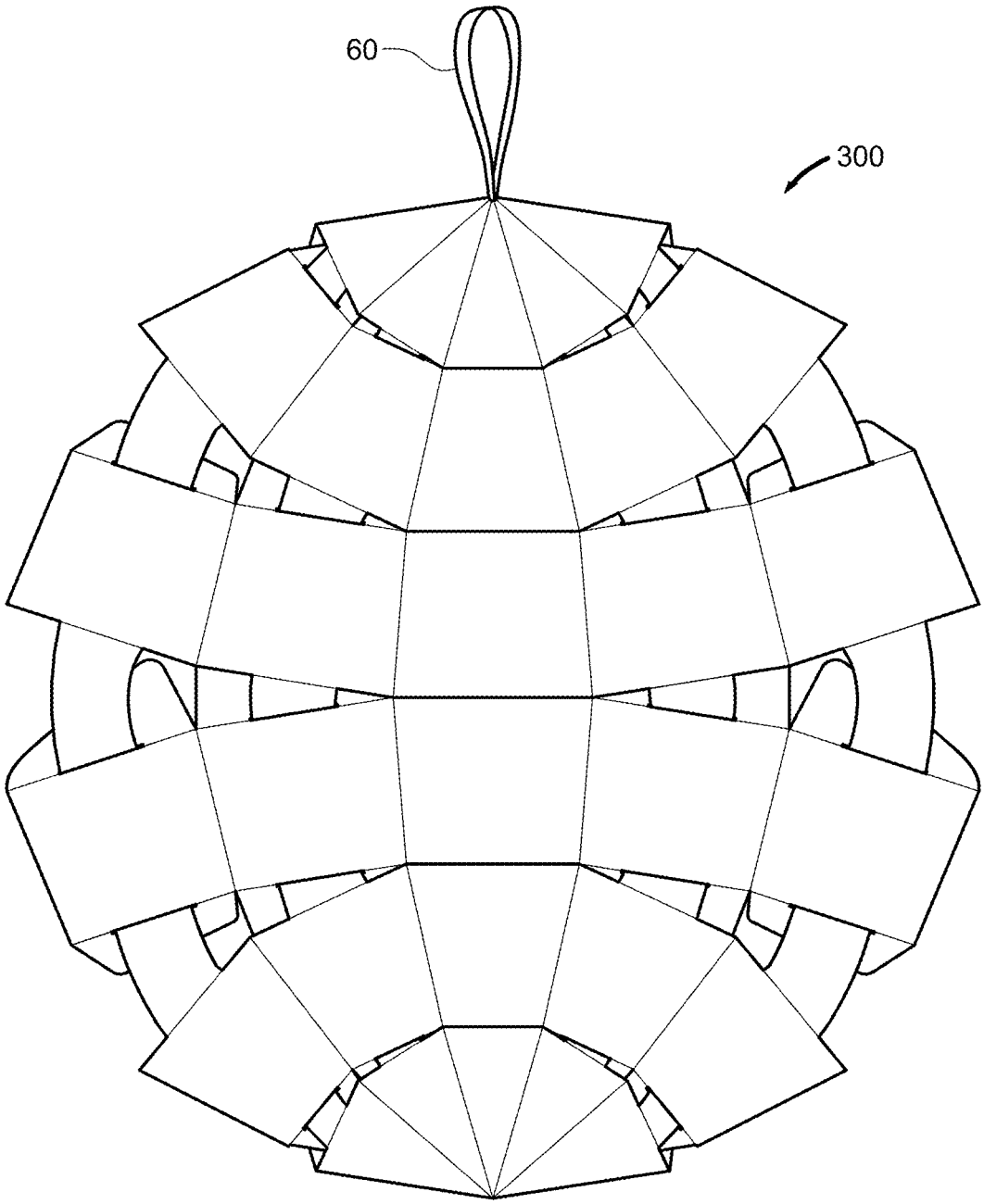
FIGS. 2A to 2J illustrate a method of using the collapsible object according to an embodiment.
Figure 2B:
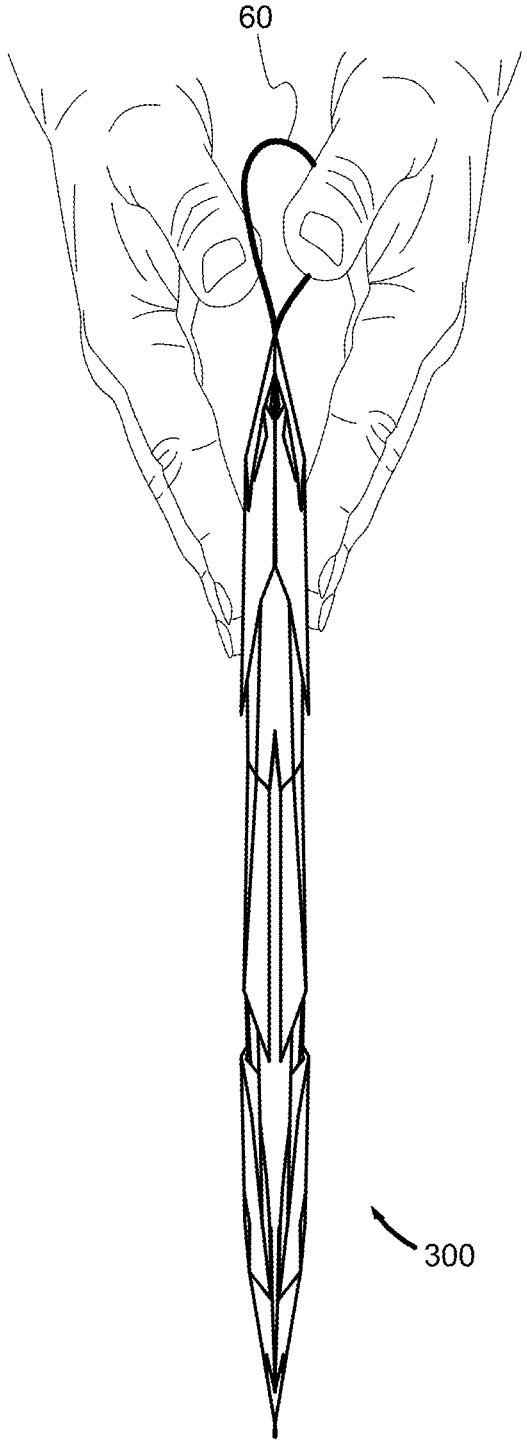

In FIGS. 2A front view and 2B side view the object begins in a collapsed, substantially flat state or configuration, (e.g., at manufacturing warehouse, shipping sea container/truck, retail store stockroom, original packaging, or home storage). In this state, the object can rest on a surface with a very small height. As shown in FIG. 2A, the object remains in the flat state without application of an external force. In this context, an external force is a force applied outside the continuous outer surface (see FIG. 2E).

Figure 2C:
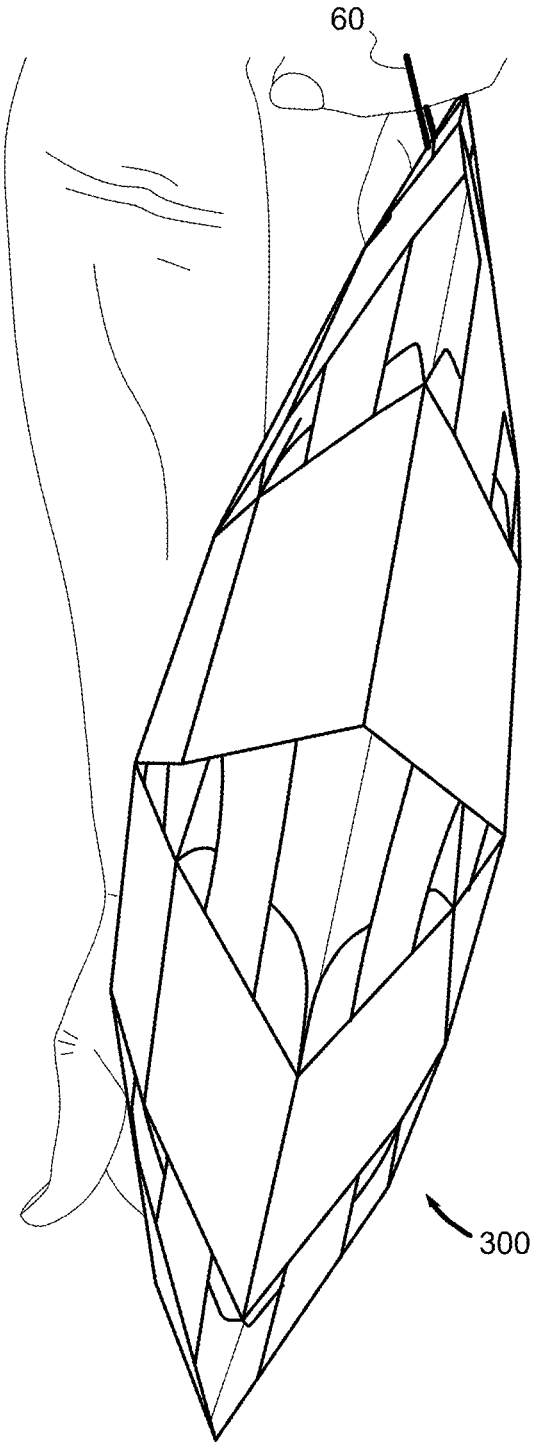
Figure 2D:
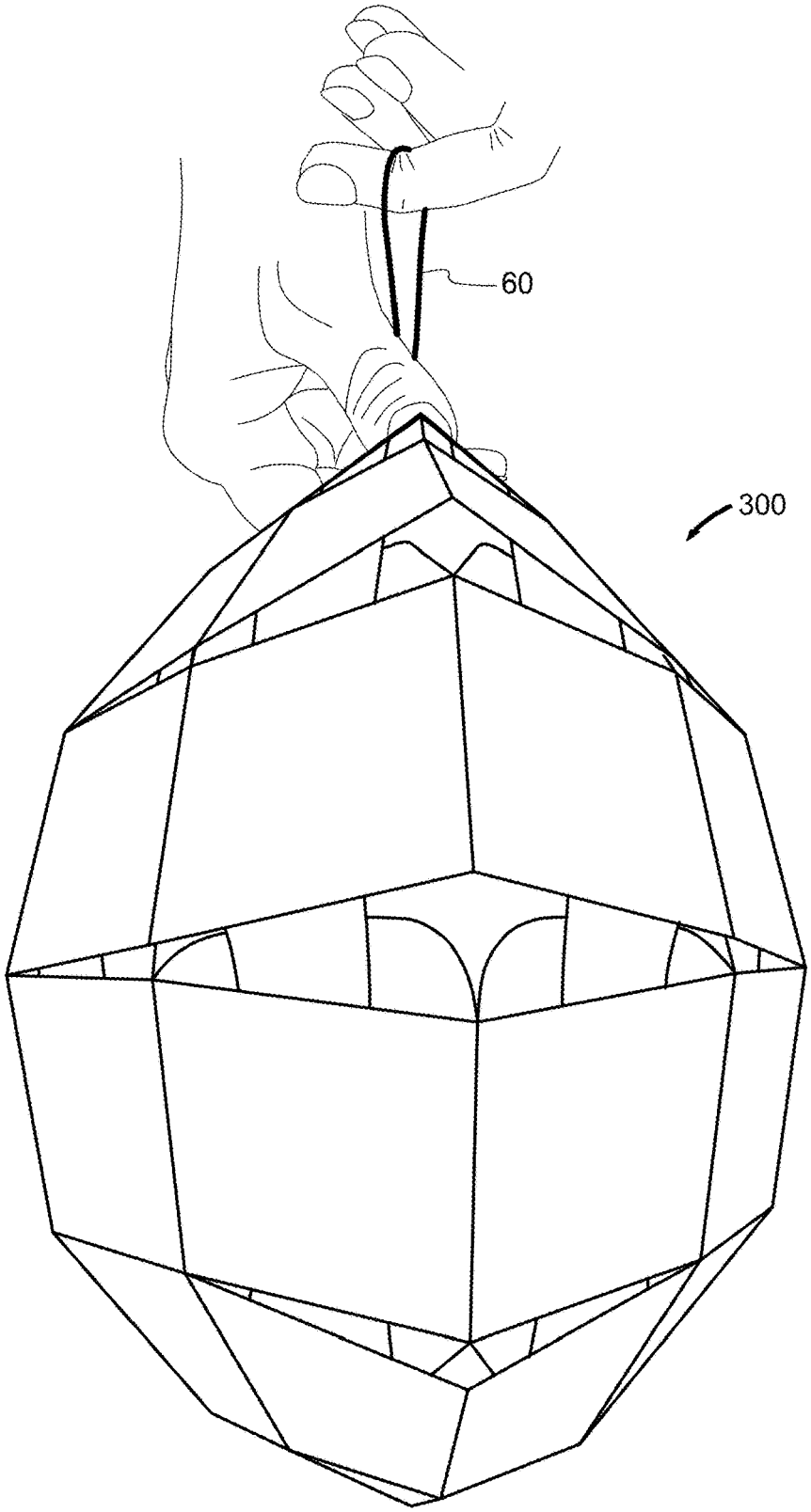

The expansion process begins in FIG. 2C. In this case a pull string is provided to facilitate expansion. As will be clear below, a rubber band, shock cord, spring or other internal mechanisms can also be used to initiate, facilitate, or assist expansion. The expansion continues in FIG. 2D until a fully expanded object is achieved as seen in FIG. 2E.

Figure 2E:
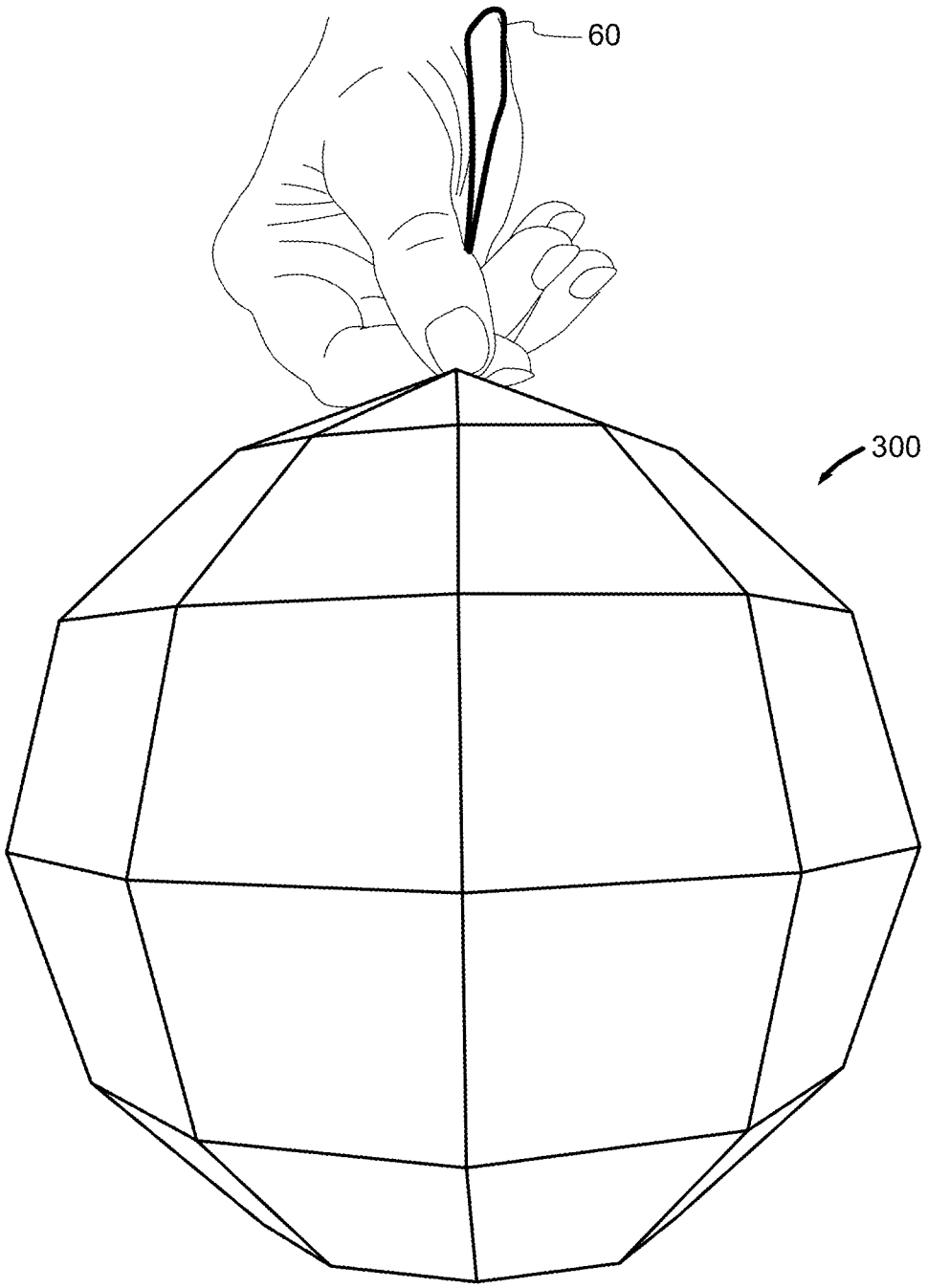

As shown in FIG. 2E, in the expanded state, the object has a visually continuous outer surface that forms a closed three-dimensional shape. As with the collapsed state, the object is capable of remaining in the expanded state without application of the external force. In this example, the continuous outer surface does not include any holes, or missing faces. A continuous outer surface can include a small number of openings (e.g., less than 95% of the total surface area) depending on the application, (e.g., a jack-o-lantern that includes eye holes).

Figure 2F:
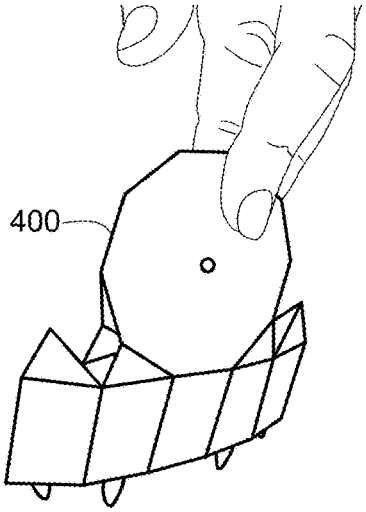
Figure 2G:
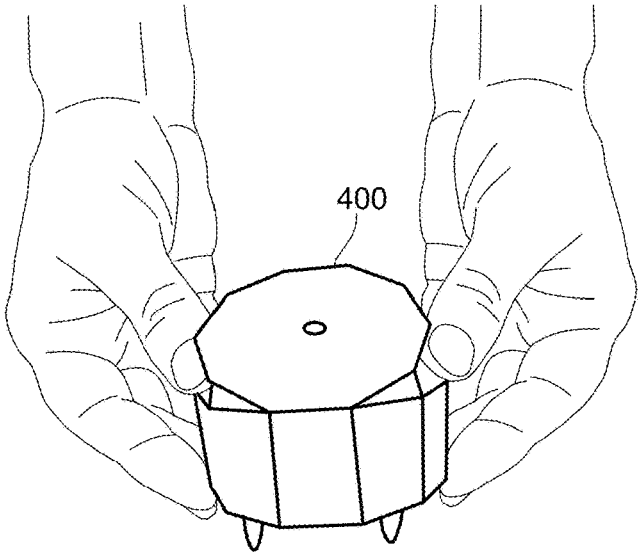
Figure 2H:
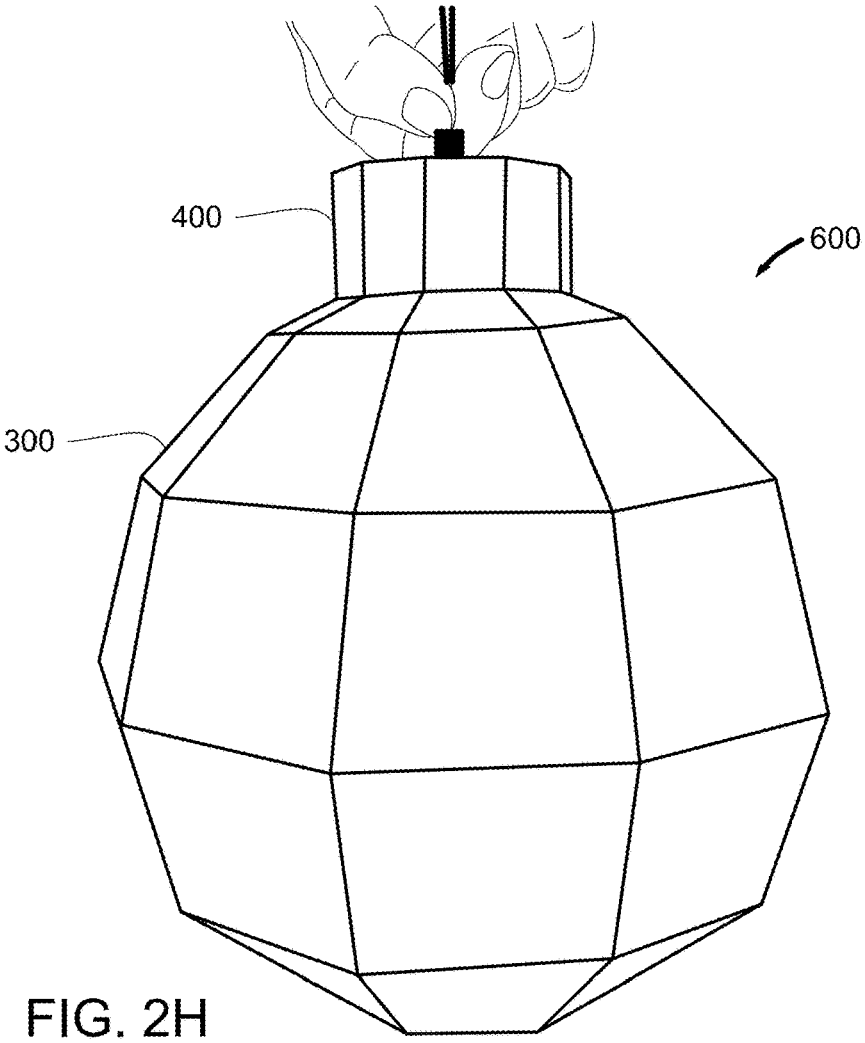
Figure 2I:
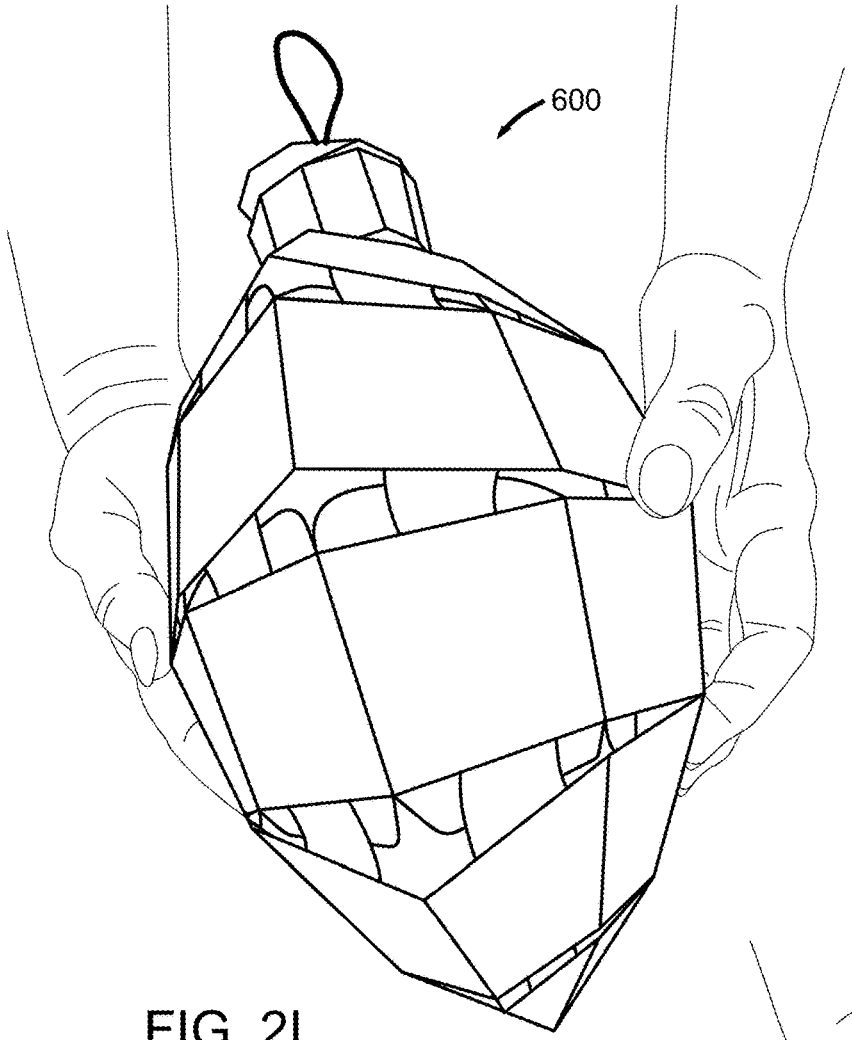

FIGS. 2F and 2G illustrate the assembly of the neck accessory part and FIG. 2H shows the addition of the neck accessory part to the top of the sphere. The sphere can now be utilized as desired. As noted above, the number of pattern groups and facet panels can be increased so that the sphere appears to have a smoother outer surface.

Figure 2J:
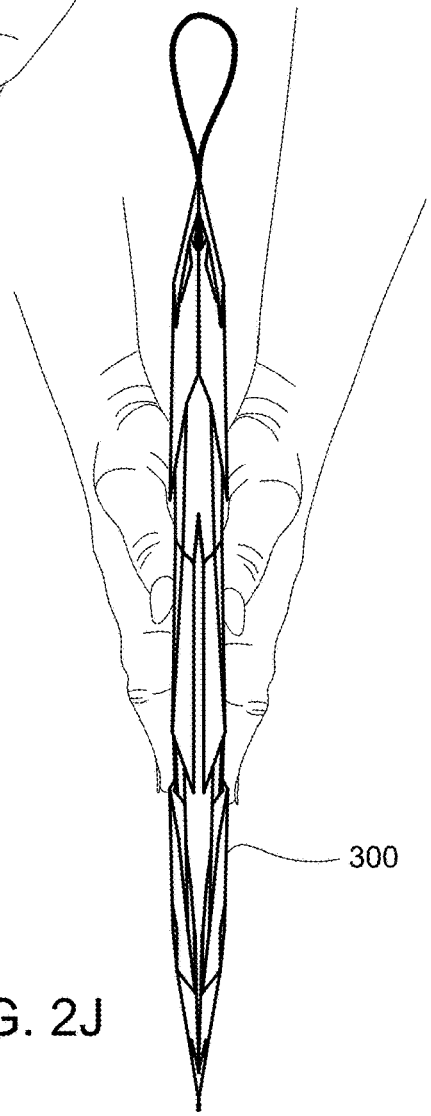

As shown in FIGS. 21 and 2J the object can be easily collapsed back to the original substantially flat state for storage (e.g., seasonal). The expanding and collapsing steps can be repeated as many times as necessary.

A more detailed illustration of the production of the sphere will be described with reference to FIGS. 3A to 3I. This particular method provides but one example.

Figures 3A, 3B:
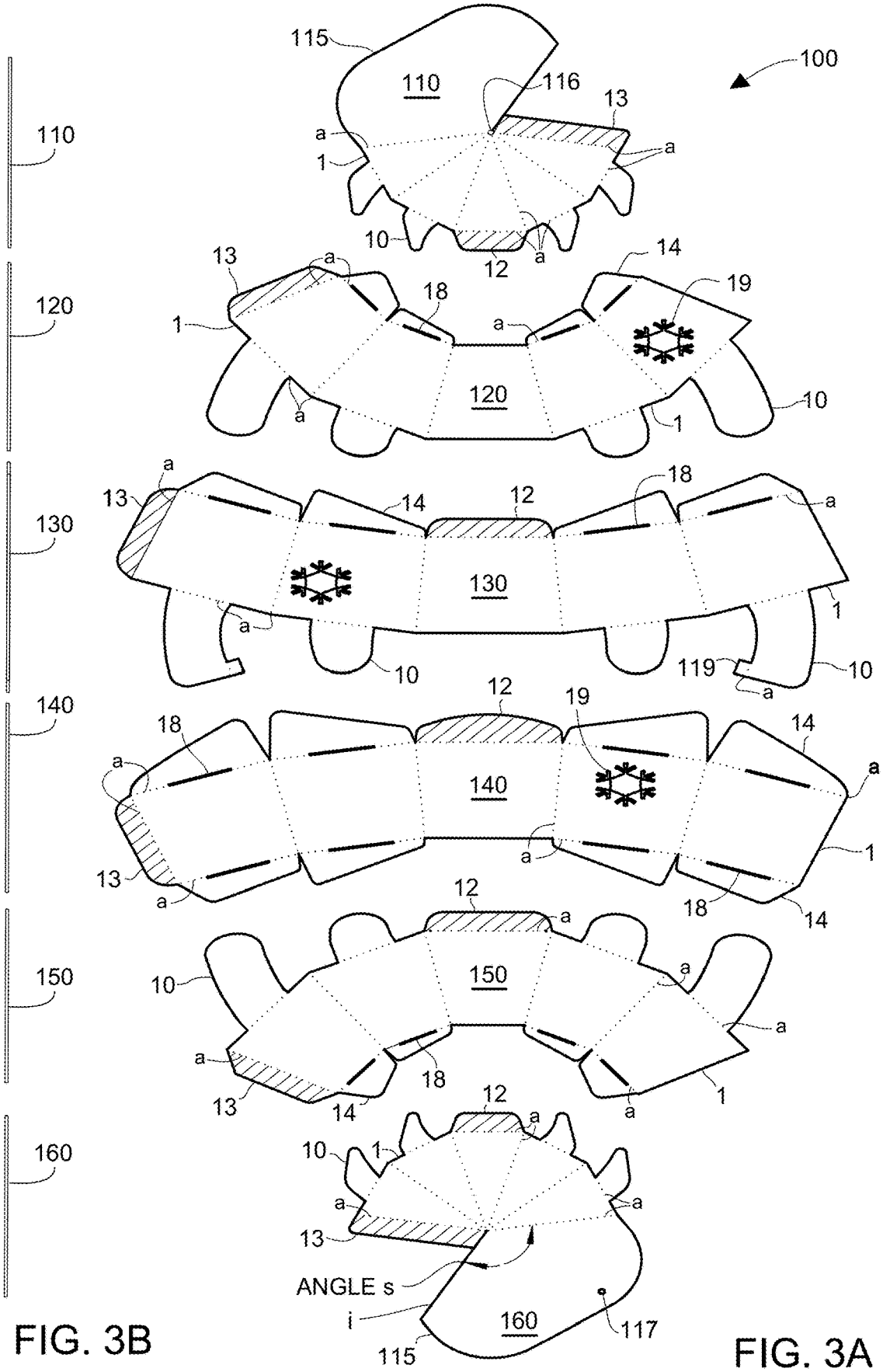
FIGS. 3A to 3J illustrate an example of the production of the sphere according to an embodiment.

FIG. 3A provides a plan of example cut-out patterns needed to make the front half of an enclosed sphere. It is understood that while this discussion focuses on one specific embodiment other materials, shapes, connectors, and relative dimensions are possible. FIG. 3B shows a side view of the example cut-out patterns.

Components of the example cut-out patterns provided in FIG. 3A are now described with reference to the reference numerals in the figures.

In this example, flat facet panel 1 is implemented as a multi-sided flat rigid surface panel. The shape of the facet panel 1 can be triangular, quadrilateral, pentagonal, hexagonal, octagonal, or other depending on the desired object shape upon expansion. The material might be a foldable sheet material such as cardstock, cardboard or plastic, or a rigid material such as sheet metal, plastic or wood-based sheet goods. Combinations or built-up laminations of these materials can also be used. For example, a paper surface sheet could be used with a plastic, composite or wood backing. Facet panels 1 incorporate various decorative surface treatments. A plurality of facet panels 1 can be combined to create pattern group 110-160, which can in turn be combined to create a sub-assembly (or a completed assembly).

For longevity or exterior uses plastic or composite, sheet metal, fiber-reinforced plastic (FRP) and/or other waterproof sheet goods can be used. Rigid sheet goods can be solid, honeycombed, corrugated, or laminated. The thickness and type of sheet good used is determined by the size, structural and aesthetic requirements of the object. Rigid materials are not required as the exterior surface. Soft materials such as fabric or vinyl may be substituted for rigid sheet goods if attached to a rigid framework (e.g., metal tubing, molded plastic, pipe, or rod) of the same outside shape of the intended flat facet panel 1 that may or may not include internal bracing. All other disclosed working mechanics are the same as hard sided objects. Soft sided objects may be preferable in some cases especially for larger objects.

A guide mechanism 10 controls the movement of expansion "opening" and contraction "closing" of the flat facet panels 1, articulating joints and negative open space in-between the flat facet panels 1 that allows a 2-dimensional sheet to be transformed with minimal effort into a 3-dimensional object. The guide mechanism 10 allows all the multiple, interconnected flat facet panels 1 to move in mass (expand or contract) at the same time in a coordinated, controlled singular movement. In this example, the guide mechanism 10 is implemented using a sliding alignment guide tab.

The sliding alignment guide tab 10 can be formed integrally with the facet panel 1 as shown in FIG. 3A. Alternatively, the sliding alignment guide tab 10 can be formed separately and then adhered to the facet panel 1 as shown, for example, in FIG. 3C.

The sliding alignment guide tab 10 is captured by the guide tab slot 18 to ensure proper alignment of the flat facet panels 1 perimeter edges in the "expanded" state thereby achieving a visually seamless, unbroken surface. The material of the sliding alignment guide tab 10 may be the same as the flat facet panels 1, or a different material or method (e.g., guide rods, wires, cords) as long as material and/or method performs the controlled guiding and alignment of the flat facet panel 1 as intended.

Pattern connection tab 12 can connect patterns via a flexible joint (e.g., a) allowing a hinging motion. This element can be permanent (e.g., overlapping tab with glue, tape (e.g., double sided), flap hinge, piano hinge) and/or temporary (e.g., slot and locking tab, loose pin, hook and loop, drawstring, clasp, strap and buckle, strap and eyelet, roto-lock, magnet). Other means of connection are also possible to connect multiple pattern cutouts to one another.

Pattern group connection tab 13 is similar to pattern connection tab 12. This connection tab 13 can connect a pattern to itself to create a "ring" or other shape while allowing a hinging motion (e.g., a). This can be permanent glue and/or temporary slot and locking tab. Again, other means of connection are also possible. In some examples, the group connection tab 13 can connect the associated facet panel to a further facet panel, which can be helpful in the fabrication of larger objects.

Slot stiffener tab 14 can provide material for construction of and to hold the guide tabs slot 18. The slot stiffener tab 14 is a surface for controlling the sliding movement of guide tab 10 as well as providing a landing surface for adjacent facet panels 1, aligning the panel edges to be flush and parallel to each other over the entire length of the edge. As discussed above, in operation, sliding alignment guide tab 10 is inserted into guide tab slot 18 and is free to slide within the guide tab slot 18 over its length of travel. Guide tab slot 18 controls direction, alignment, and end limits of movement of sliding alignment guide tab 10.

Sliding alignment guide tab extraction limit lock 119 limits travel of, captures, and prevents sliding alignment guide tab 10 from inadvertently coming out of guide tab slot 18. Extraction limit locks 119 may be used on other guide tabs 10 as needed. Sliding alignment guide tab extraction limit lock 119 shown is but one example of a variety of designs that may be used that perform the same function.

The reference a indicates a movable fold line, hinged joint or otherwise flexible connection between flat facet panels 1, connection tabs 12, 13 or other parts requiring a flexible joint in-between. This can be a score line, crease and fold, with or without perforations to assist bending, live hinge of flexible material, mechanical hinge, "V" groove of rigid material having a flexible face material, or a built-up lamination of a flexible face material glued to a subterranean rigid material, or other hingedly mechanism allowing a rotating movement between parts. Connection a may be a temporary or permanent connection.

FIG. 3A also illustrates an actuator control plate 115. The actuator control plate 115 includes an actuator cord hole 116 and an actuator cord connection point 117. The operation of the actuator control plate 115 will be described below.

Also illustrated are an s angle, which is the final open angle at bottom and top of opened sphere and a t angle, which is the bottom angle of the cone pattern in the flattened 2-dimensional state. A limit edge i can be used to stop the opening of the lower (and upper) cone shapes at the correct angle. Opposing downward force on each side of cone interior (left and right) maintains correct angle of cone shape under compression of sphere in the opened state.

As discussed above, the object can resemble a recognizable object. The snowflake 19 is included to illustrate an example of implementing this feature. For example, a Christmas ornament could be implemented with snowflake designs over a colored surface. In general, any surface artwork, glitter, sequence, printed or applied graphics, jewels, ornaments, or designs can be implemented. The visual appearance is limited only by the imagination of the maker.

The collection of facet panels 1 can be combined to create a connected pattern group, six of which are shown in this example. In this example, the connected pattern groups 110-160 forms the top (or bottom) half sphere sub-assembly 100. While a sphere can be formed with two sub-assemblies 100 more complicated shapes could require more sub-assemblies, the number being limited only by practical concerns.

FIG. 3B, which is a side view of FIG. 3A, illustrates pattern groups 110-160. Top cap facet group 110 is designed to allow the object to lie substantially flat in a closed state and to be a cone-shaped 3-dimensional ring in opened state. Similarly, bottom cap facet group 160 is designed to allow the object to lie substantially flat in closed state and to be a 3-dimensional cone-shaped ring in opened state.

Top mid ring facet group 120 is designed to allow the object to lie substantially flat in closed state and to be a cone-shaped 3-dimensional ring in opened state. Two facet groups 120 can be joined together via pattern group connection tabs 13 create a completed ring. Top center facet group 130, bottom center facet group 140, and bottom mid-ring facet group 150 are similar in design and function as top mid ring facet group 120.

As previously stated, it is understood that while this discussion focuses on one specific embodiment other materials, shapes, connectors, fabrication and assembly techniques, and relative dimensions are possible.

In the example provided in FIG. 3A, the sphere surface facet groups (110, 120, 130, 140, 150, 160) are separated into six half "rings" (to be completed into full rings via end pattern connection tabs 13 and joined together later via midline pattern connection tabs 12 at c-c) and the sliding alignment guide tabs 10 and slot stiffener tabs 14 are cut from the same sheet and joined to the sphere ring flat facet panels 1 via a folding crease a. Depending on the size of the object to be made and size of material to be used, or other considerations, many variations and combinations of part size, attachment order and/or methods can be implemented.

For a small object, many facet panels 1, sliding alignment guide tabs 10, slot stiffener tabs 14, pattern connection tabs 13, and other parts can be joined together and cut from one blank or sheet of material in a common pattern or patterns. A score line, crease fold or V groove on a single material or built-up lamination of flexible surface materials backed up by rigid materials or other means of bending may be used to create a flexible fold line in-between various parts at location a.

With a larger object, it could be more efficient if only one part is made from one sheet of goods or multiple sheets and all other parts are connected to one another at location a via a mechanical hinge, live hinge, or another applied hinging device used to connect the various parts hingedly allowing a bending hinging motion between them. These can be temporary (e.g., loose pin hinge, hook and loop, magnets) or permanent connections between connecting the parts together. In an even larger part, a single part may be manufactured from multiple other framing and sheet materials (e.g., steel tube, sheet metal, sheet FRP, plastic molded or otherwise).

Figure 3C:
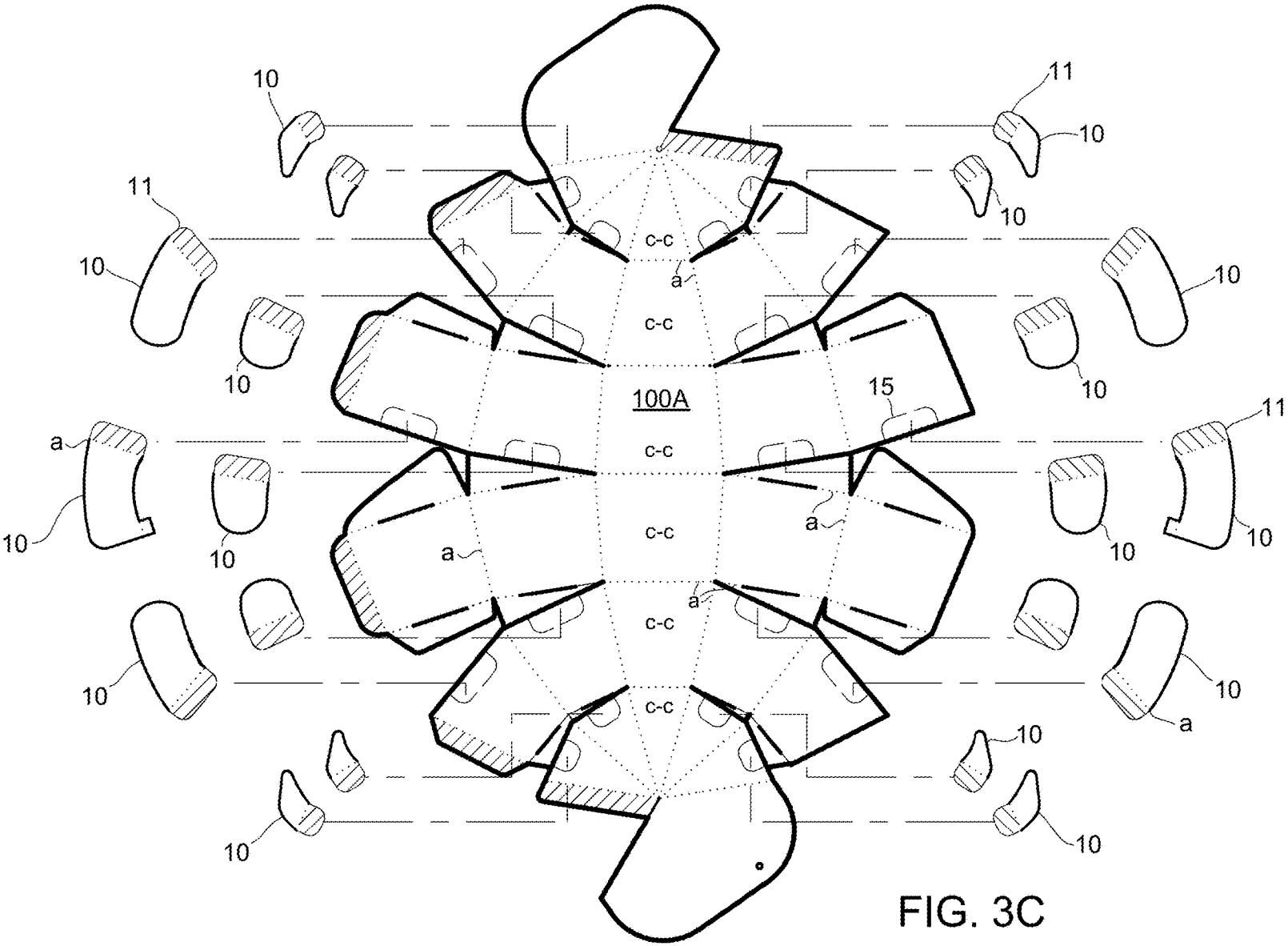

FIG. 3C illustrates but one alternate manufacturing method where all the flat facet ring groups (110, 120, 130, 140, 150, 160 per FIG. 3A) are cut from one sheet of material (labeled here as 100A) and connected from the onset along the centerline facet panels, i.e., spine c-c (prior location of connection tab 12 in FIG. 3A), via a crease fold line a or V groove or other means at location a. The spine c-c holds the pattern group (in this case ring group) together while the facet panels 1 are moved from the collapsed state to the expanded state. The facet panels 1 are guided during the movement by a guide mechanism, which can include a male part and a female part (e.g., tab and slot, rod and opening, cord(s) or wire(s) and opening, amongst others.)

In this example, the sliding alignment guide tabs 10 (and/or slot stiffener tabs 14 could be included) would be separate cut-out parts and affixed to the flat facet panels 1 via glue tabs 11 or other means of attachment (e.g., live hinge, mechanical hinge). Glue tab landing locations on the center spine plate 15 are shown. The actual pattern shapes, order and combination of part assembly and attachment method to one another during manufacturing may be adjusted or changed per specific manufacturing requirements of size, shape, materials, manufacturing means and methods or other parameters and/or end use requirements. Inter-woven parts may be woven through by hand or machine to achieve a "woven" functionality of parts.

FIGS. 3D-3G demonstrate but another alternate manufacturing method where all the flat facet ring groups (110, 120, 130, 140, 150, 160 per FIG. 3A) are separate cut-outs, are then loaded into a fixture 347 and then assembled in layers, one after the other. This example method may be performed by hand or automated using machines.

Figures 3D, 3E, 3F:
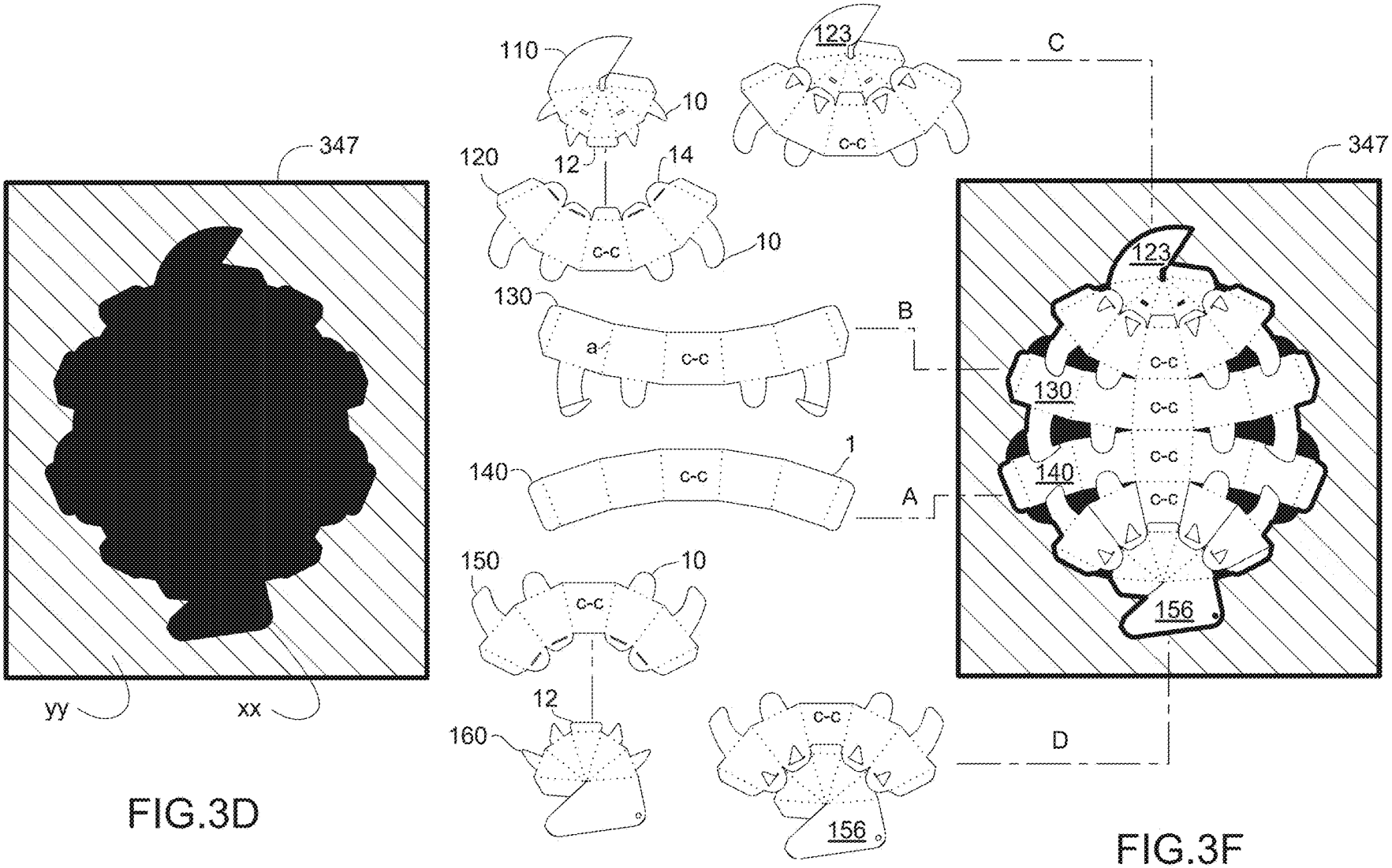
Figure 3H:
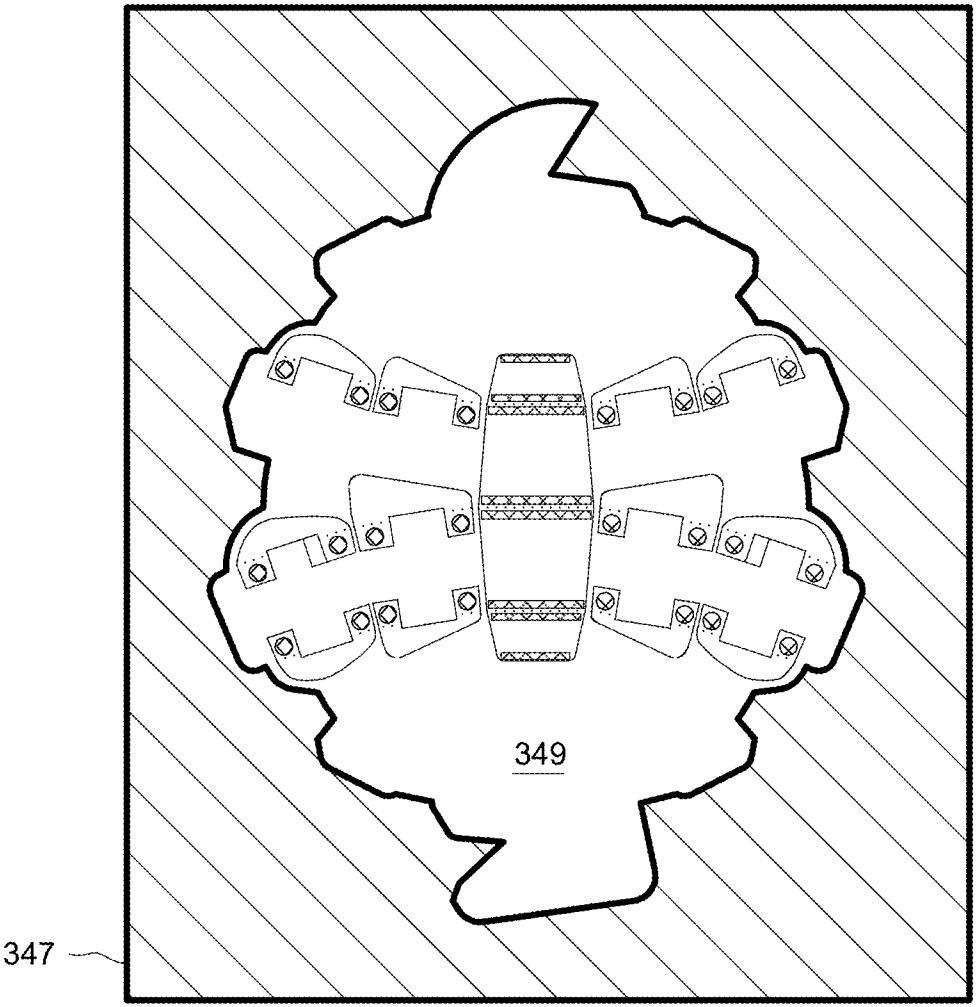

FIG. 3D shows a fixture 347, which can have a flat surface to place parts on (i.e., center blackened area xx). This can be a vacuum surface for holding parts or have push shafts to assist in unloading parts, or other devices or clamps that assist in the loading and/or unloading of parts. The outer area yy may have thickness (e.g. ½" thick), or be posts, clamps, fences, guides, or other devices that locate and hold the parts in place accurately for assembly. The fixture may have an area for assembling one item at a time (as shown) or have multiple areas for assembling many items at a time (e.g., rack with 6 areas with multiple racks, continuous straight assembly line, or rotary assembly machine).

FIG. 3E shows flat facet ring groupings but cut slightly differently, in this case, all the sliding alignment guide tabs 10 and facet panels 1 are cut from a common sheet as before, but slot stiffener tabs 14 on facet groups 130, 140 have been left off for later assembly. On groups 110, 120 sliding alignment guide tabs 10 are inserted into guide tab slot 18, and pattern connection tab 12 is used to join the parts making the new group 123. The same is done with facet groups 150, 16*o* to make new facet group 156. Any number of pre-assembly combinations of parts can be made.

FIG. 3F shows flat facet ring groups 123, 120, 130, 140, 156 being loaded into the fixture 347. It is preferred that the group be loaded in the order A, B, C, D shown in FIGS. 3E and 3F. This order of loading establishes an overlapping of sliding alignment guide tabs 10 always being on top of facet panels 1 and on the interior of the finished object. Parts can be loaded into fixture by hand or machine.

Figure 3G:
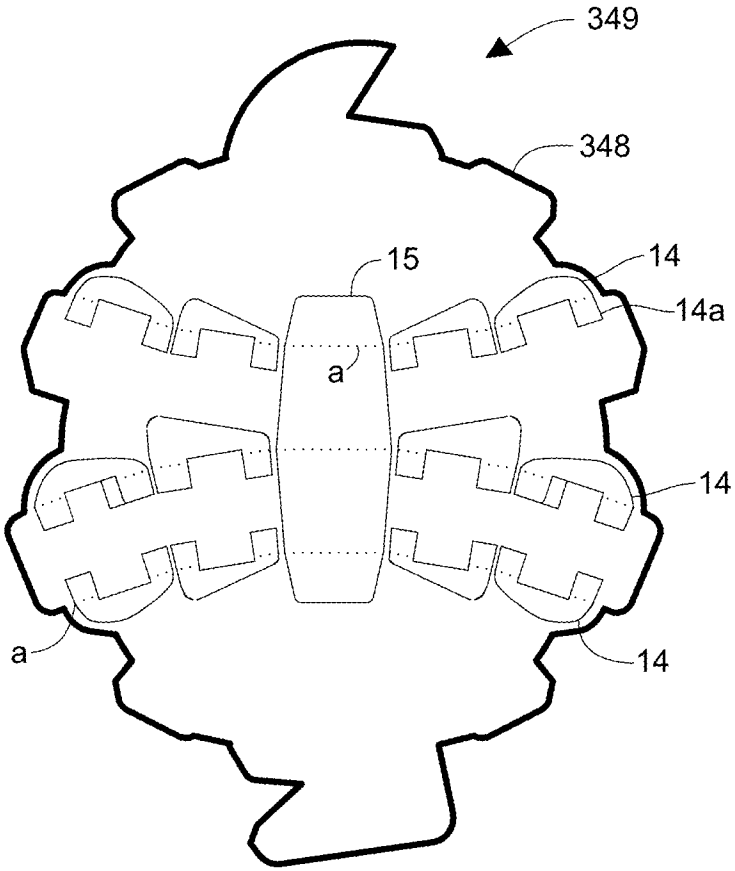

FIG. 3G shows a disposable mask 348, (in this example a die-cut cardstock cutout). The mask cutout 348 holds in the correct position the slot stiffener tabs 14 that were left off from the original cutting of patterns for groups 130, 140. Glue tabs 14*a* have been added to the slot stiffener tabs 14 and crease and fold line a added at part hinge movement line. A center spine connection plate 15 is also held in the mask 348. The disposable mask 348, center spine connection plate 15, slot stiffener tabs 14 and glue tabs 14*a*, together make parts mask sub-assembly 349. In this example the prior mentioned parts are held temporarily in the mask by small connector tabs that rip easily making the parts removable from the mask. The mask can be any device or fixture that temporarily holds subsequent parts in place for assembly.

Prior to placing parts mask 349 in fixture 347, glue is applied to the glue tabs 14*a*, and on the center spine plate 15 on either side of the bendable line a (glue shown by glue dots, hidden hashed circle and bars). Parts mask 349 is placed in fixture 347, on top of the pre-loaded ring groups 123, 120, 130, 140, 156 with the glue facing downward toward the ring parts already in the fixture. FIG. 3G shows the parts mask 349 in the fixture 347, on top of pattern groups 123, 120, 130, 140, 156. After temporary pressure is applied to the glue locations, slot stiffener tabs 14 via glue tabs 14*a* are glued in position to groups 130 and 140 respectively, and center spine connection plate 15 spans facet the center facet panels 1 of groups 130, 140 at spine c-c, connecting the rings with a flexible joint at locations a.

Figure 3J:
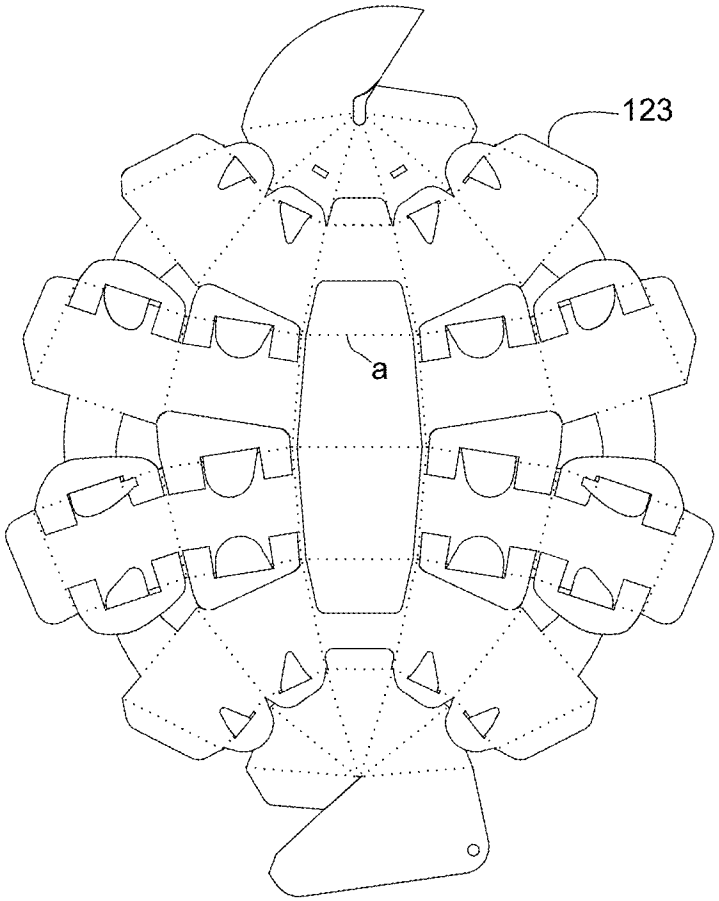
Figure 3I:
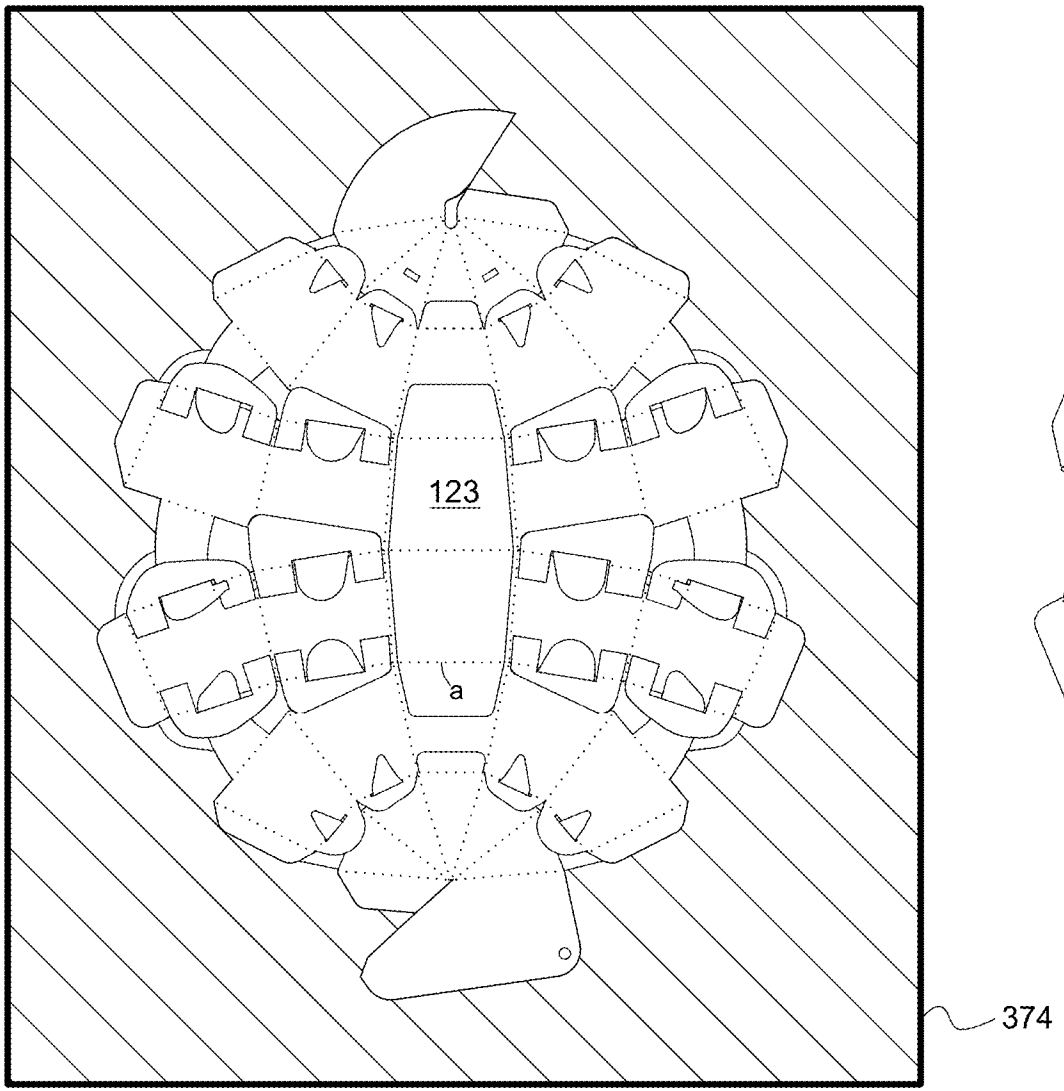

FIG. 3I shows the disposable mask 348 pulled away and discarded, leaving behind the now glued in place center spine connection plate 15 and slot stiffener tabs 14. The gluing of slot stiffener tabs 14 via glue tabs 14*a* to the ring groups below form the guide tab slots 18 around the sliding alignment guide tabs 1*o*. With the removal of mask 348, the entire inside plan view of the half sphere sub-assembly 123 can now be seen in the fixture.

FIG. 3J shows the half sphere sub-assembly 123 after being removed from fixture 374. This alternative assembly of applying layers of parts, one after the other, by nature creates a "weaving" of parts thereby eliminating the need for the many sliding alignment guide tabs 10 to be inserted (e.g., by hand) into the guide tab slots 18 and facilitates other joining of parts that potentially could be a time consuming endeavor. A portion of or all of this method of assembly can be done by hand or machine.

The two alternative sub-assemblies shown in FIGS. 3A and 3J are but two examples of a multitude of possible pattern combinations and manufacturing techniques to achieve the substantially same object and function. The making of an object may use one construction method, two, several and/or a combination of methods that achieve the same result.

Figure 4A:
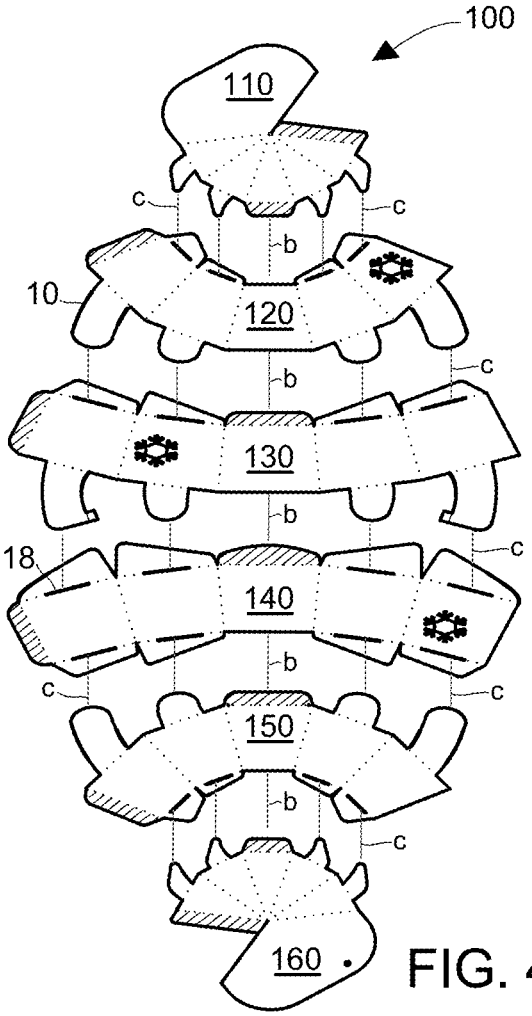
FIGS. 4A-4B provide plan views of front patterns (FIG. 4A) and rear patterns (FIG. 4B) used to make a complete sphere using the pattern layout of FIG. 3A.
Figure 4B:
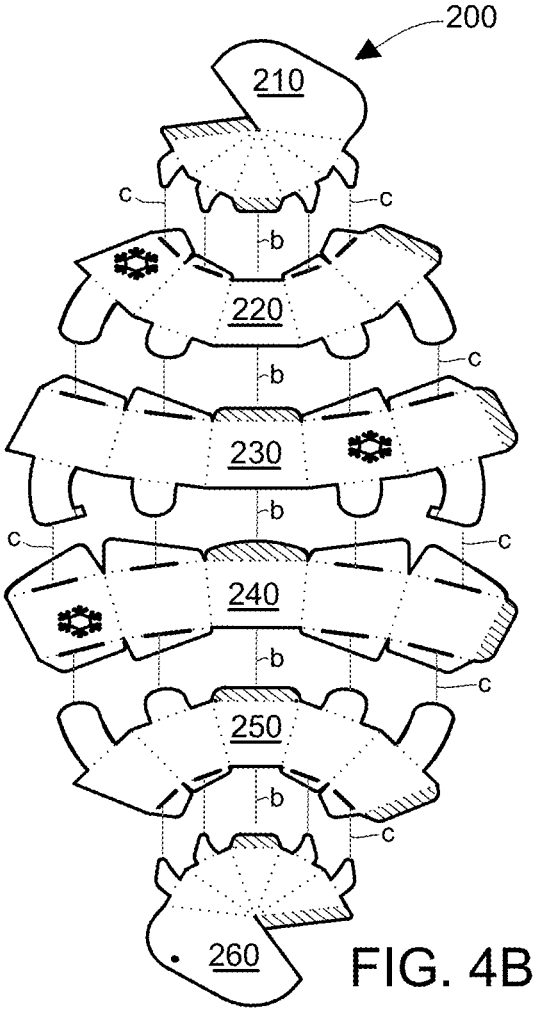

FIGS. 4A-4B provide plan views of front patterns (FIG. 4A) and rear patterns (FIG. 4B) used to make a complete sphere using the original pattern layout presented in FIG. 3A. Reference numeral 100 and 200 indicate pattern sub-assemblies to create the front and back half of a sphere and the rings being joined via connection tabs 13. These front and back sub-assembly 100, 200 patterns could be identical to one another but do not need to be.

FIGS. 4A-4B illustrate movement b, the bringing together and joining of facet pattern groups (110, 120, 130, 140, 150, 160) into front sub-assembly 100, and rear facet pattern groups (210, 220, 230, 140, 240, 250, 260) into rear sub-assembly 200, in this example using pattern connection tabs 12. The attachment along the newly created a line can be permanent glue and/or temporary slot and locking tabs or other means of a flexible hingedly connection. Insertion and inter-weaving of sliding alignment guide tabs 10 into guide tab slots 18 is also shown as movement c.

Figure 5A:
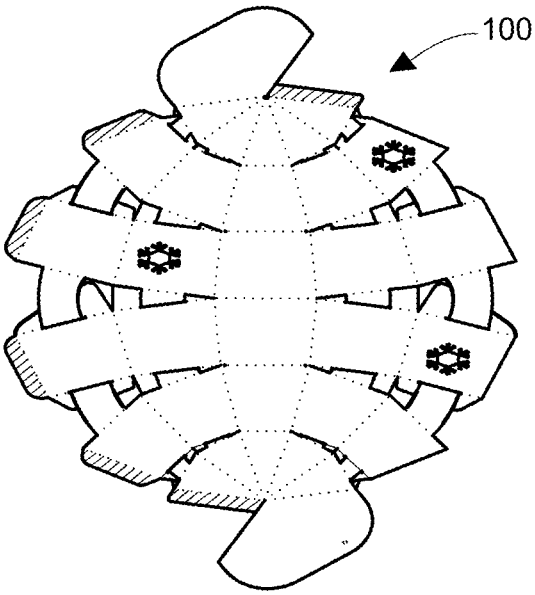
FIGS. 5A-5B provide plan views of an assembled front sub-assembly (FIG. 5A) and an assembled rear sub-assembly (FIG. 5B)
Figure 5B:
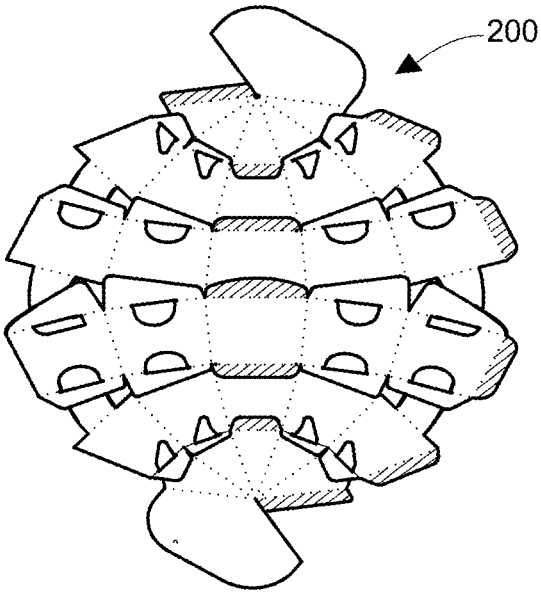

FIGS. 5A-5B provide plan views of an assembled front sub-assembly 100 (FIG. 5A) and an assembled rear sub-assembly 200 (FIG. 5B). Sub-assembly 100 (FIG. 5A) and assembled rear sub-assemblies 200 are identical parts. FIG. 5A is a view of the outside or exterior of the sub-assembly 100 and FIG. 5B is a view of the back side or interior of the sub-assembly 200.

Figure 6:
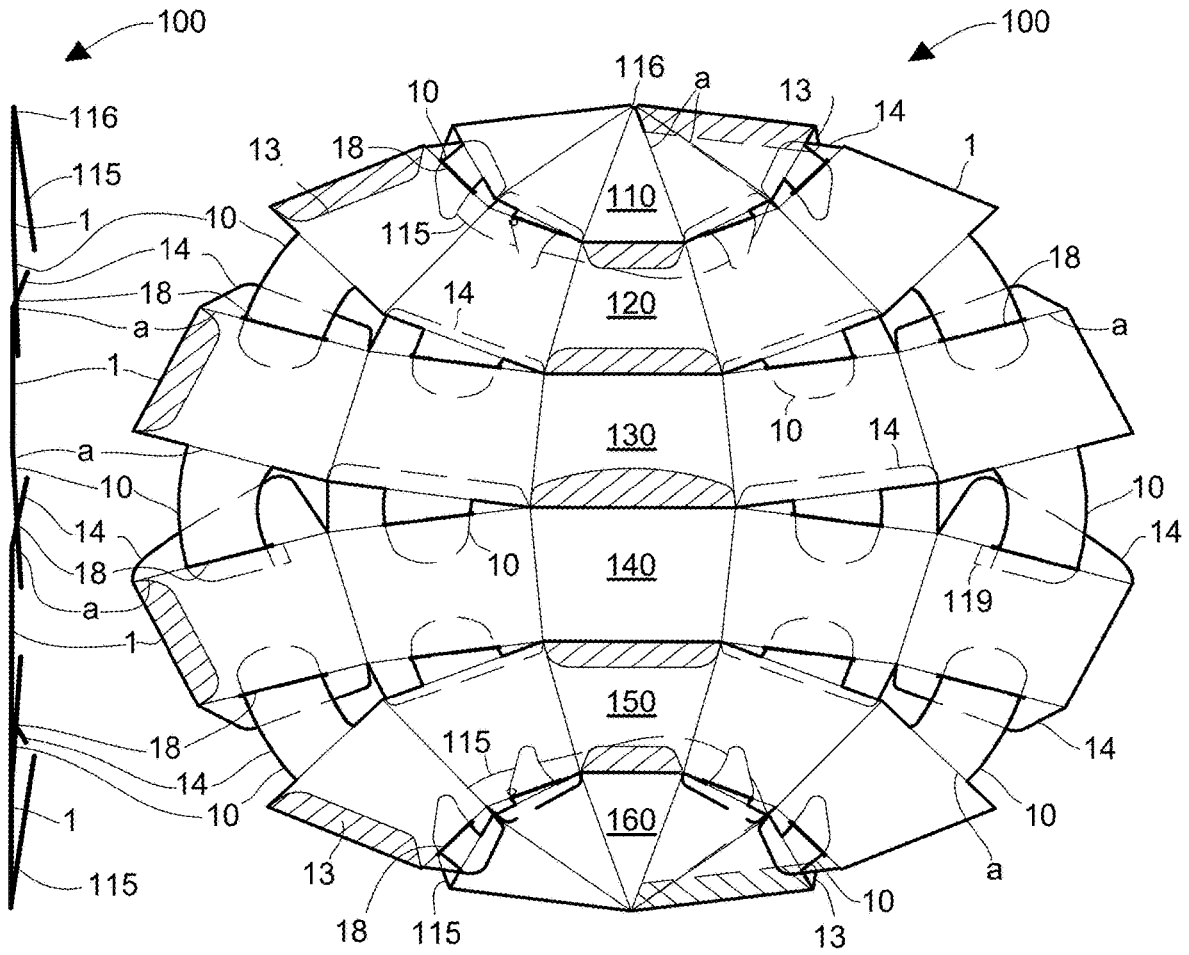
FIG. 6 provides a plan and side view of front assembly.

FIG. 6 provides a plan and side view of front sub-assembly too showing the inter-weaving of flat facet panels 1, sliding alignment guide tabs to, guide tabs slots 18, and slot stiffener tabs 14. Note that in FIG. 6 all the assembled parts, using the embodiment of the mentioned design principles, allowed the newly created sub-assemblies too to lay flat, in a substantially 2-dimensional state.

Figure 7:
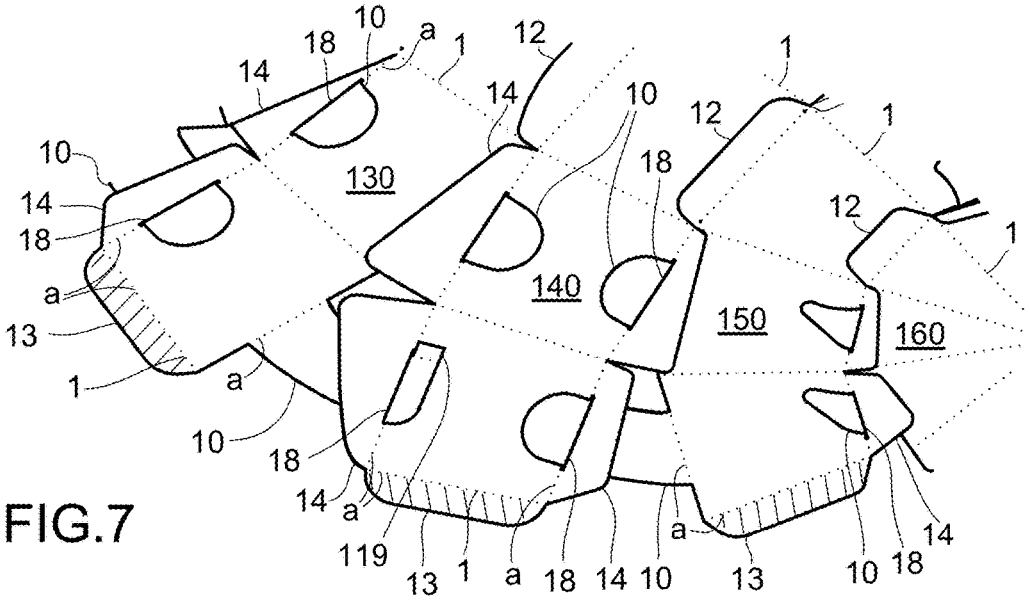
FIG. 7 provides an enlarged detail of the assembly of FIG. 6.

FIG. 7 provides an enlarged detail of FIG. 6 showing the insertion into and weaving of sliding alignment guide tabs 10 through slot stiffener tabs 14 and guide tab slots 18.

In FIG. 6, the pattern group connection tabs 13 are folded over in preparation for gluing front and rear sub-assemblies 100, 200 together. In FIG. 7 the pattern group connection tabs 13 remain unfolded in the original pattern shape prior to folding over.

Figures 8A, 8B, 8C:
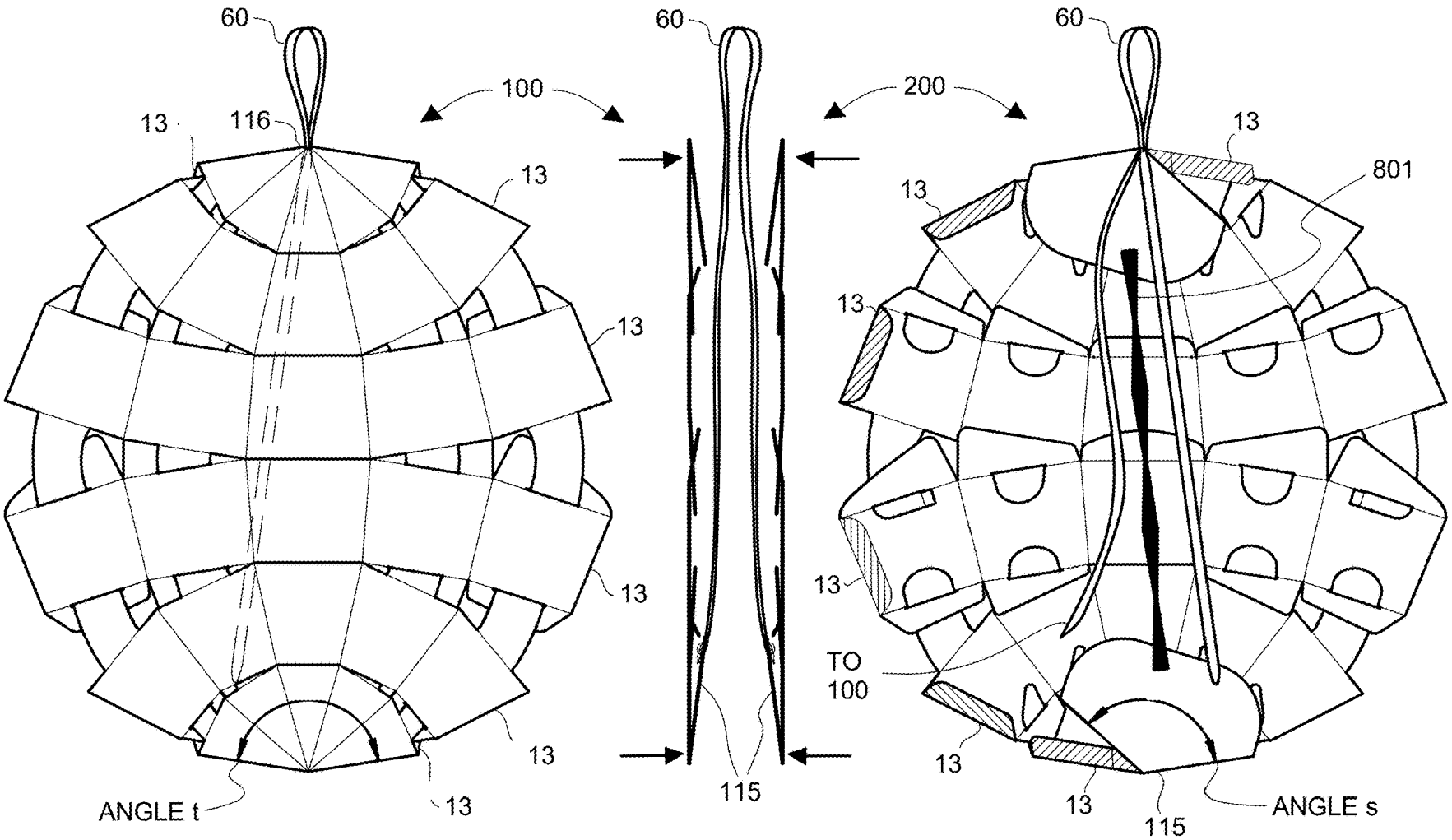
FIGS. 8A-8C show a front sub-assembly and a rear sub assembly prior to being joined to create a complete sphere.

FIGS. 8A-8C show front sub-assembly 100 and rear sub assembly 200 prior to being joined to create a complete sphere. FIG. 8A shows plan and exterior view of front sub-assembly 100 and FIG. 8C shows an interior plan view of back sub-assembly 200. FIG. 8B shows a side view of front sub-assembly 100 and rear sub-assembly 200 in position, facing one another, prior to joining. As seen in FIG. 8C pattern group connection tabs 13 are folded over in preparation for gluing and joining of sub-assemblies 100 & 200 together.

FIG. 8A shows angle t. The bottom angle of the cone pattern in the flattened 2-dimensional state. This angle changes from angle t to the final sphere opened angle s (seen in FIG. 8C) during the opening process (i.e., changing from flat to 3-dimensional).

FIG. 8B shows actuator pull cord 60 added and connects to actuator control plate 115 prior to joining front and rear sub-assemblies 100, 200 together.

FIG. 8C shows the addition of an alternate device 801 to assist in the object opening/closing operation. This can be a rubber band, spring, shock cord, or other device or elastic material that assists in the movement of parts and operation of the object (later explained in more detail). The alternative device may or may not be used.

Figure 9:
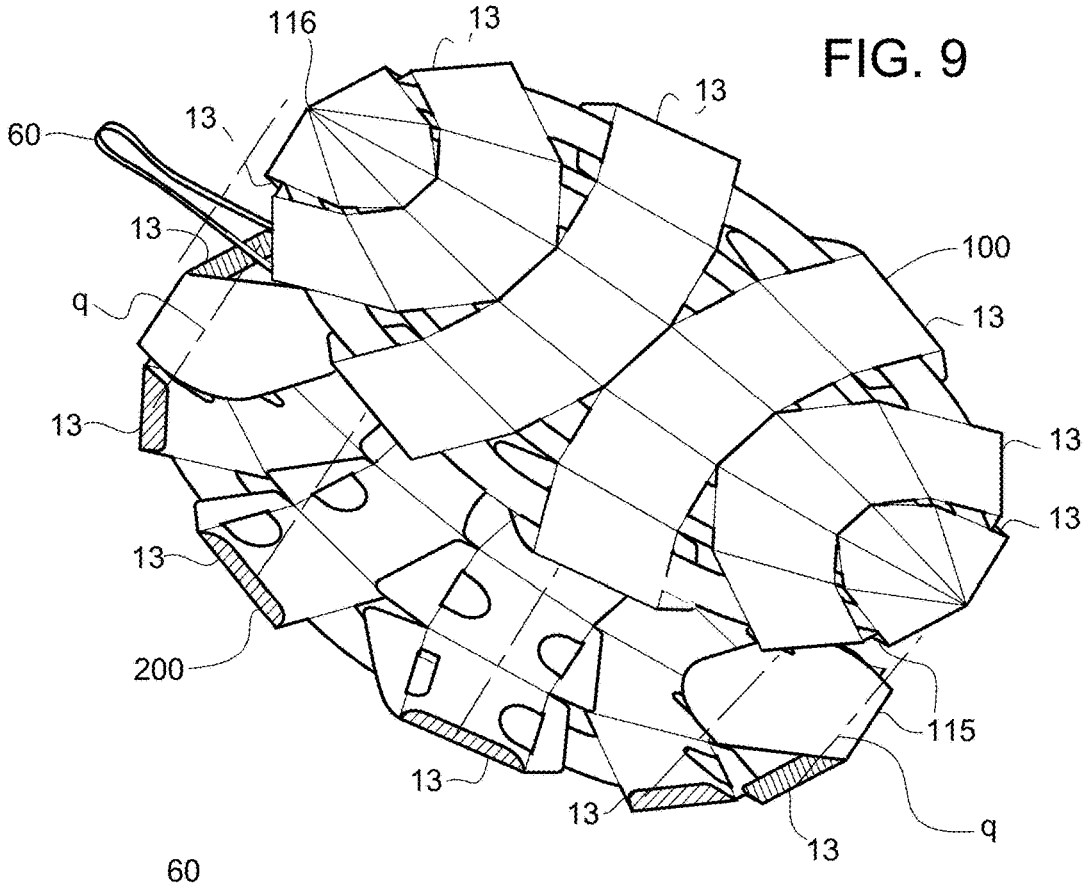
FIG. 9 shows an ISO view of the joining of sub-assemblies.

FIG. 9 shows an ISO view of the joining of sub-assemblies front 100 (top) and back 200 (bottom) movement q. The outer ring end edges of front sub-assembly 100 and rear sub-assembly 200 are brought together and joined via pattern group connection tabs 13 (in this case front sub-assembly 100 and rear sub-assembly 200 tabs 13 are glued together around the entire circumference) to create a completed sphere assembly 300.

Figure 10A:
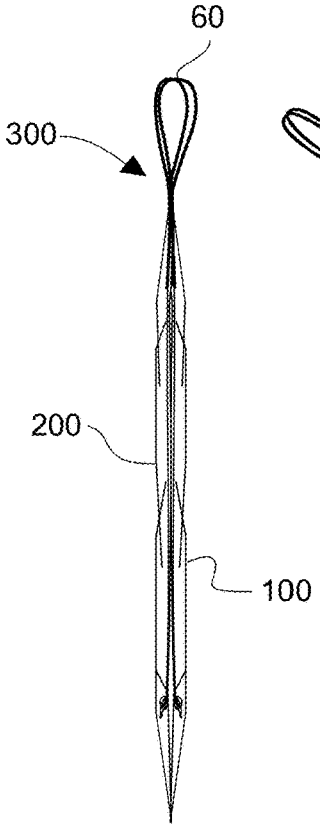
FIG. 10A shows a side view of joined front and back panels and FIG. 10B shows an ISO view of FIG. 10A.
Figure 10B:
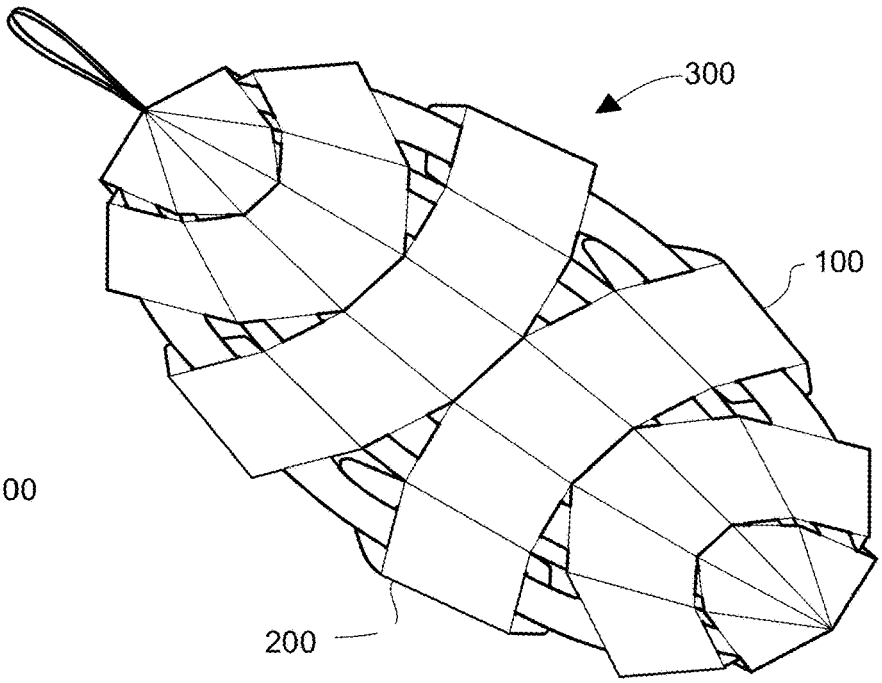

FIG. 10A shows a side view of joined front and back panels and FIG. 10B shows an ISO view of FIG. 10A. Here a complete sphere 300 includes the front sub-assembly 100, the back sub-assembly 200 and the actuator pull cord 60, all in a substantially flat, 2-dimensional state.

Figure 11A:
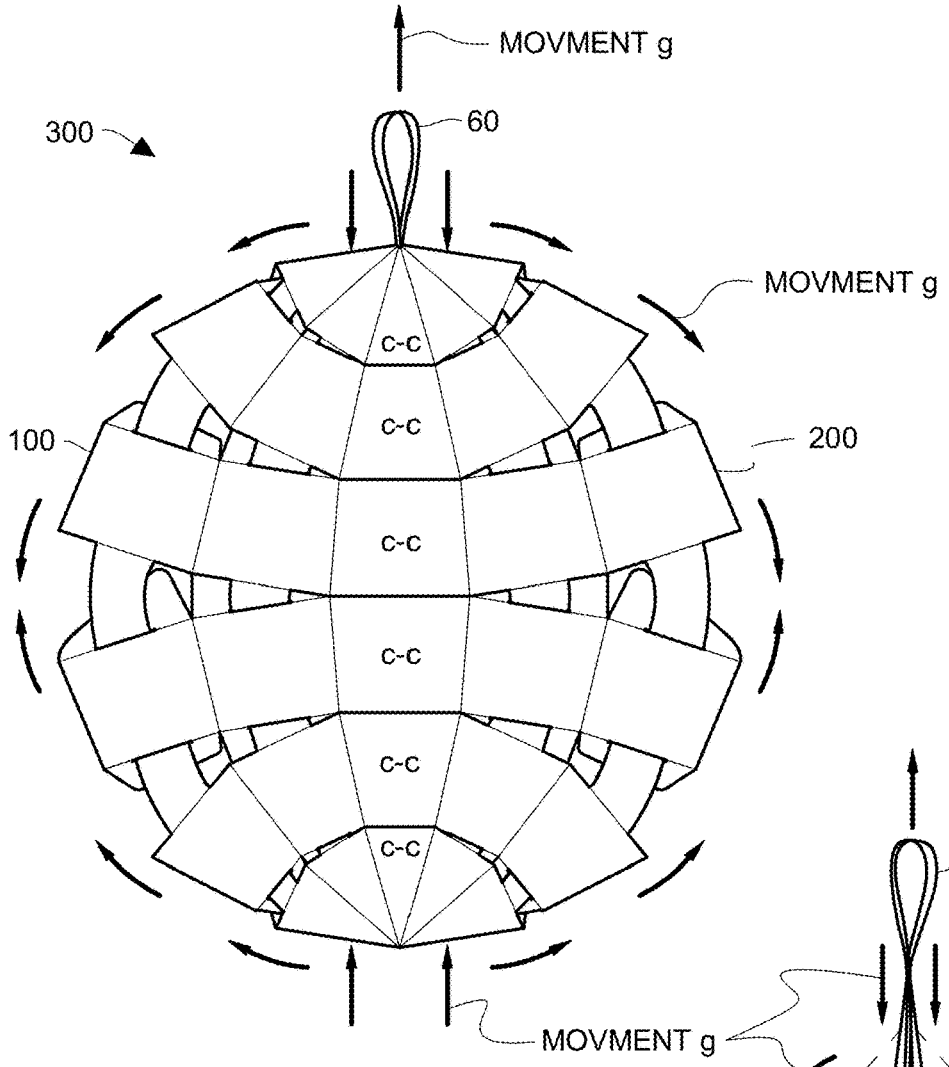
FIGS. 11A and 11B show a front view and a side view, respectively, of a completed sphere and the operation of movement.
Figure 11B:
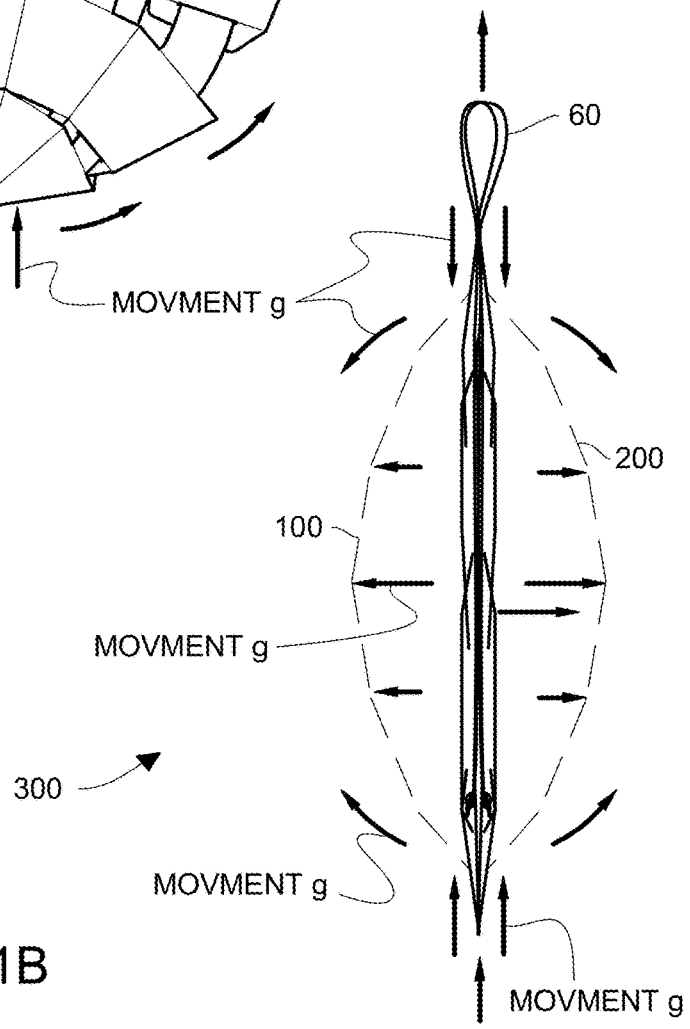

FIGS. 11A and 11B show a front view and a side view, respectively, of the completed sphere 300 and transformational movement g from a substantially flat 2-dimensional to open 3-dimensional state, (e.g., from collapsed to expanded). The side view of FIG. 11B shows the lower end of the actuator cord 60 is attached to the bottom of the sphere via the actuator control plate 115. The exposed top of actuator cord 60 is held in one hand. The other hand is placed on the top of the sphere. The actuator cord 60 is pulled upward, pulling the sphere bottom upward, as the other hand on top of the sphere resists the upward movement and/or pushes downward on the sphere. These opposing forces place the sphere poles in compression, forcing the poles towards one another. This compression of the top and bottom poles toward one another transmits the force through the mutually connected center longitudinal facet panels c-c (i.e., spine) on either side of the sphere (i.e., front and rear), pushing them towards the equator and forcing the panels expansion outward, perpendicular to the first compression axis.

On each pattern group (e.g., ring), all the facet panels 1 that are connected to the center panel c-c (i.e., spine), following in turn, are forced to expand outward or "open" from flat rings to round rings, thus forming a round 3-dimensional sphere. As the rings expand outwards, the open space in-between the rings begin to close. This closing movement of the open spaces between the rings force the sliding alignment guide tabs 10 to slide into the guide tab slots 18. This interaction of the sliding alignment guide tabs 10 to slide into the guide tab slots 18 control the movement, direction of travel, travel path, length of travel and maintains the proper alignment of the facet panels 1 edges, keeping them parallel with one another when closed.

Figure 12A:
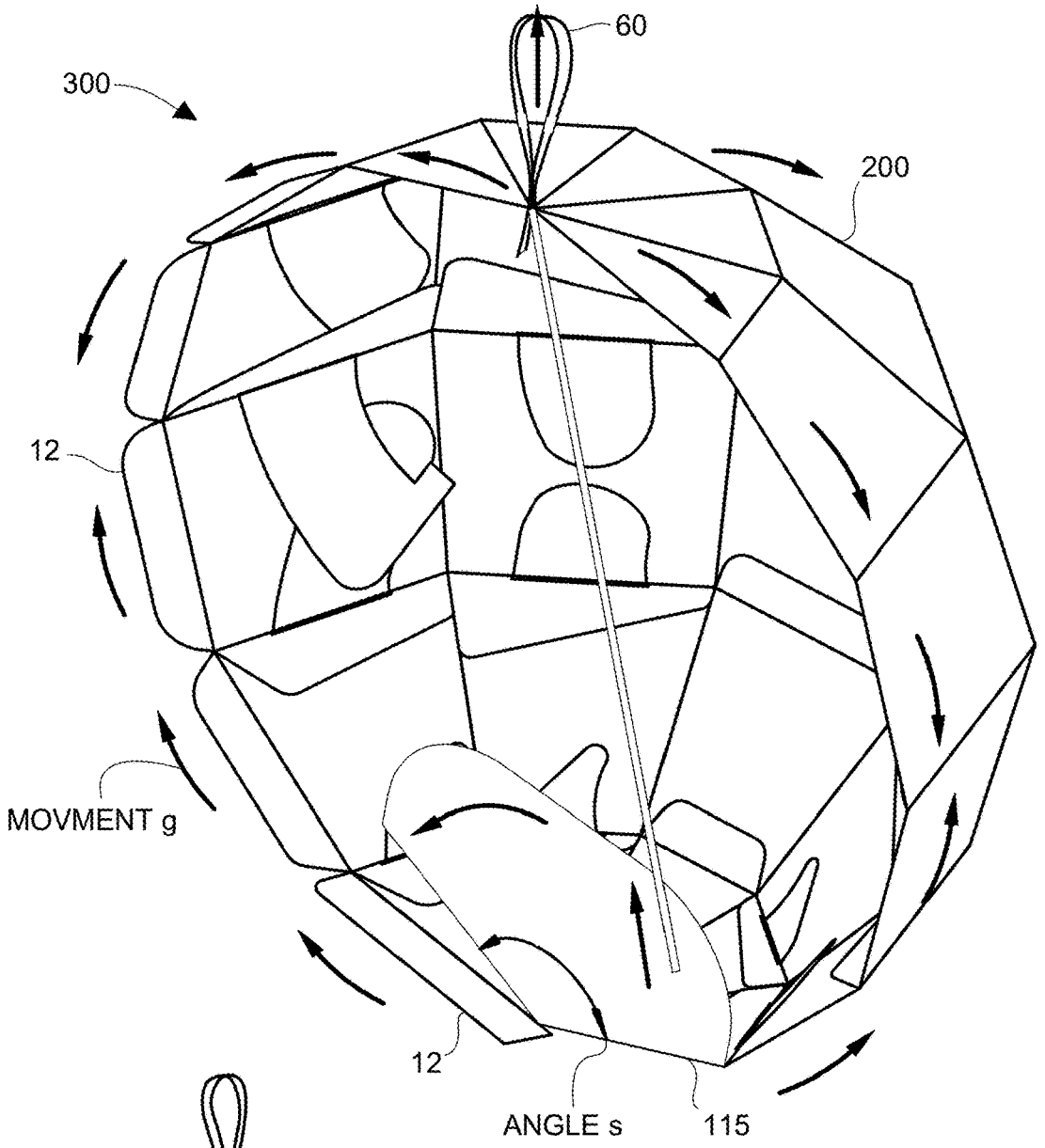
FIG. 12A shows a perspective view of the interior of a fully opened rear sub-assembly.

FIG. 12A shows a perspective view of the interior of a fully opened rear sub-assembly 200 and movement of various parts (movement g) during opening. In FIG. 12A the actuator control plate 115 assists in the forcing open of the top and bottom cones and the control plates bottom angle s acts as a stop to limit the length of travel and maintain the final shape of the cones. Depending on object size, materials, and other factors the actuator control plates 115 (as per the method of operation of the tear drop shown on FIGS. 16F-16K) may not be necessary. An alternative construction method may be to attach the actuator cord 60 directly to the lower parts of the sphere eliminating the actuator control plates 115 or substituting the plates for another internal device that substantially performs the same function.

Figure 12B:
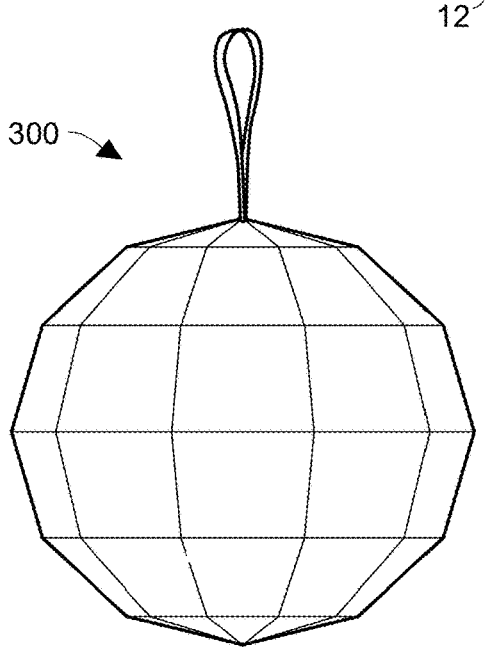
FIG. 12B shows a front view of a fully opened object.

FIG. 12B shows a front view of a fully opened object 300, (i.e., expanded state). The rear view is identical to front view.

FIGS. 13A-13D illustrate an accessory part. The specific design of the accessory part, or parts, is only limited by the imagination of the designer.

Figure 13A:
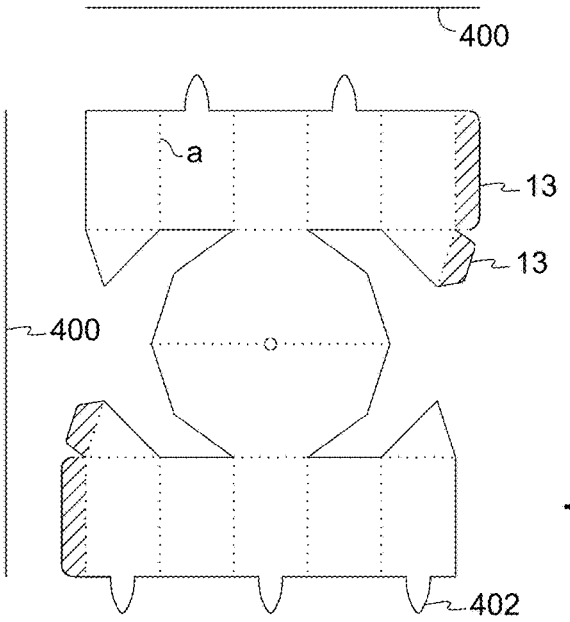
Figure 13B:
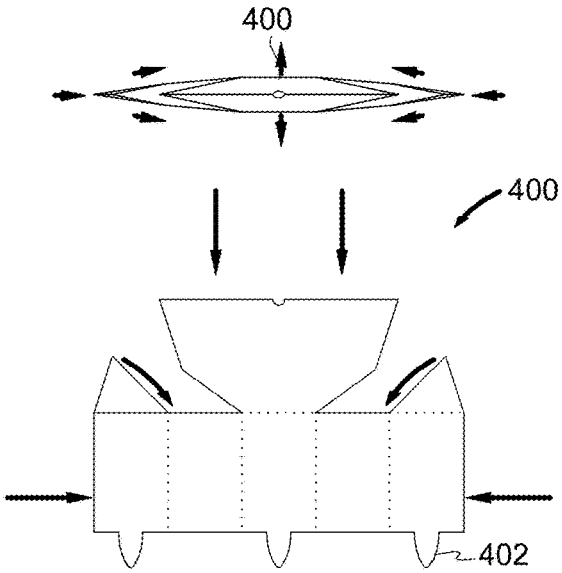
Figure 13C:
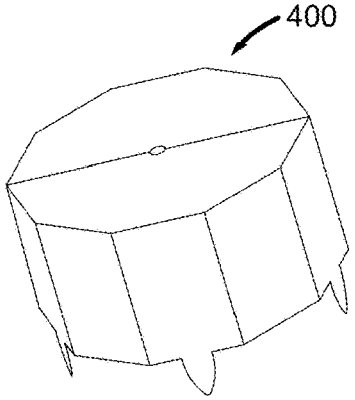

FIG. 13A shows a plan view of pattern for neck accessory part. In this example, the accessory part includes a neck pattern 400, locator tabs 402, glue tabs 13, and movable fold lines a. FIG. 13B shows a front and top view of expanding the neck pattern from a flat 2-dimensional shape to an open 3-dimensional object by pushing downwards on the top surfaces and inward on the side surfaces. FIG. 13C shows an ISO view of the expanded neck part 400.

Figure 13D:
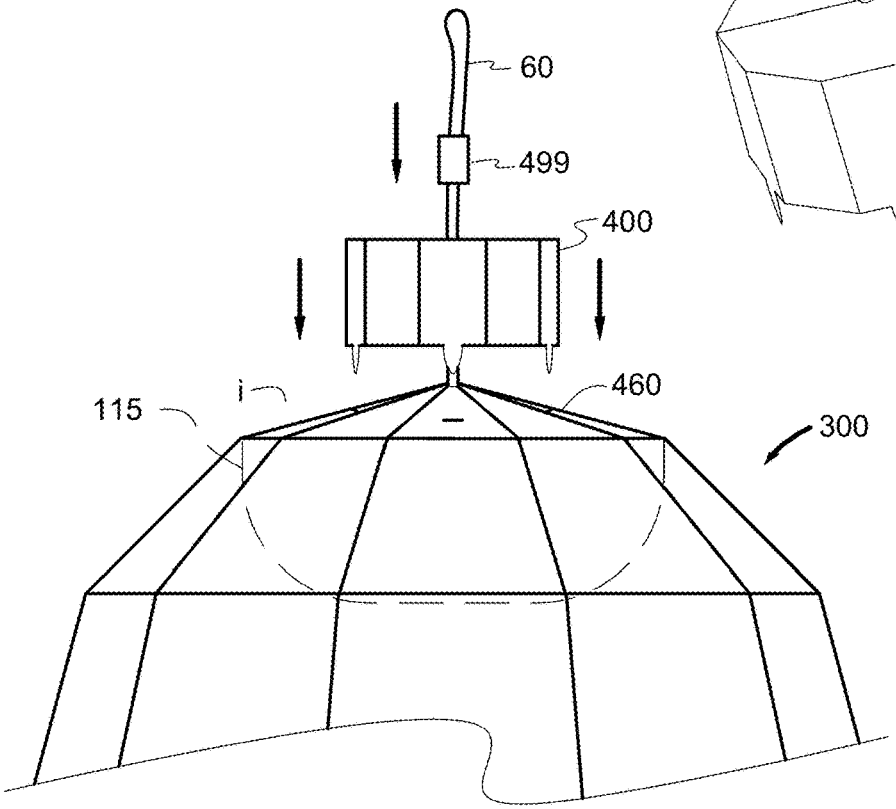

FIG. 13D shows a front view of the addition of neck accessory part 400 and cord lock 499 to the sphere object 300. In this illustration, the sphere top cone 460 has slots to receive the neck locator tabs. A variety of methods may be used to connect accessory part to other parts. Also seen is the hidden top cone actuator control plate 115 and limiting angle i that counter excessive force from the neck's downward movement. Cord lock 499 keeps the accessory part 400 in place as well as the entire sphere in compression, keeping the open spaces tightly closed in-between the facet panels 1 of the ring and the sliding articulating joints in the area of the sliding alignment guide tabs 10. Keeping the object in tight compression (or in tension) via a cord lock 499, or other mechanical device maintains the desired "opened" or expanded 3-dimensional shape.

FIGS. 14A-14C illustrate perspective, side, and top views, respectively, of a completed object. The completed ornament 600 is shown here in the open expanded state. The ornament can include accent lighting 610, (e.g., arrangement of fiber optic or LEDs surface and/or internal lighting) to illuminate a translucent surface material. Reference numeral 620 indicates surface ornaments, faux gems, appliques, and decorations, while reference number 630 can refer to glitter, metallic foils, or an infinite variety of decorative surfaces. Surfaces may be laminated with a protective coating or other protective film or coating for longevity. As will be clear, any decorations or printing can be provided on the outer surface of the ornament 600 or accessory parts. The object may be suspended utilizing the actuator cord 60 or other suspension means or device intended for that purpose or for exterior ground applications (e.g., base, anchoring system, stakes, and/or guy cords).

FIGS. 15A-15F show the formation and function of the bottom cone portion of the sphere. The top cone is functionally identical to the bottom cone.

Figure 15A:
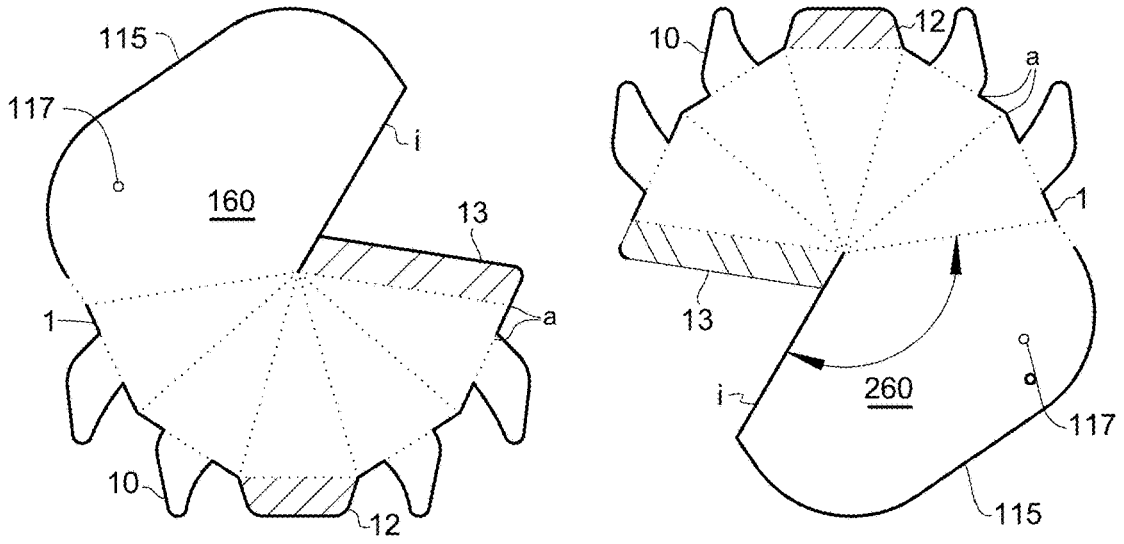
Figure 15B:
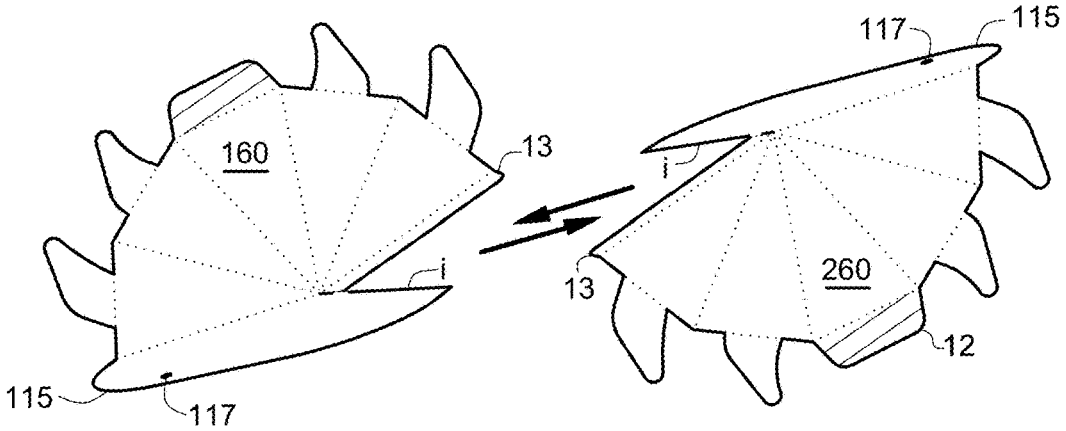

FIG. 15A shows flat pattern groups 160, 260 used to make the bottom cone of a complete sphere and other parts mentioned in FIG. 3A. FIG. 15B shows an actuator control plate 115 and glue tab 13, which are folded up approximately 90 degrees for assembly. Bottom cap facet groups 160 and 260 can slide together to become interlocked.

Figure 15C:
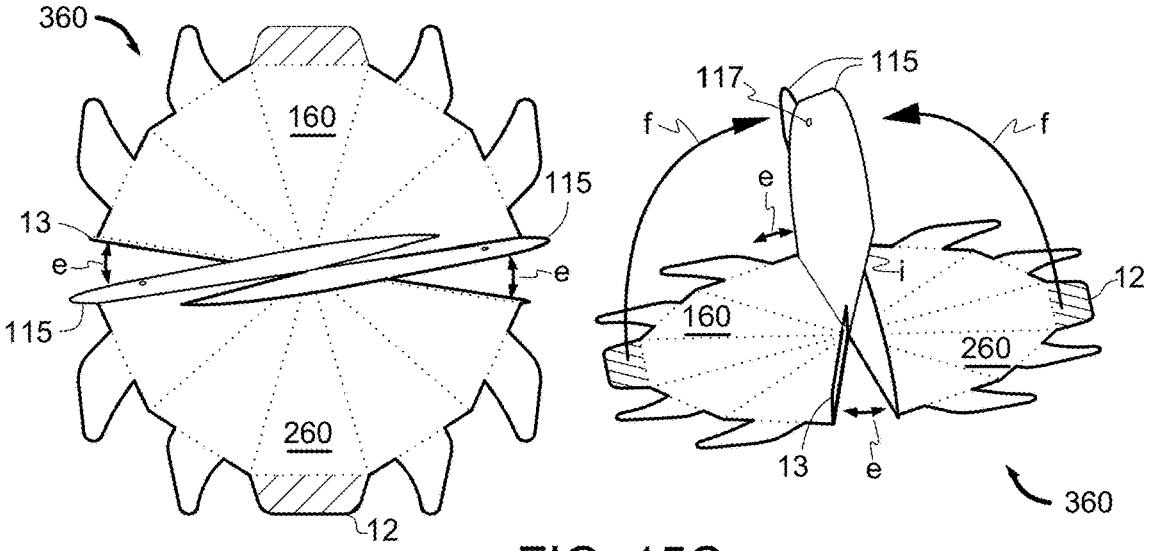
Figure 16A:
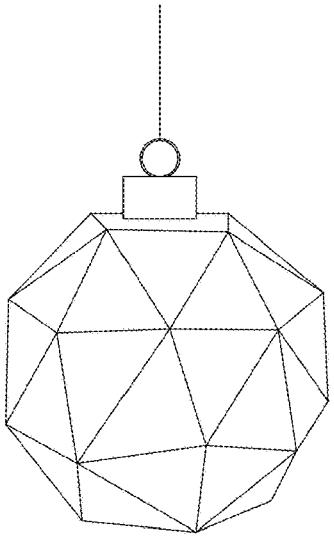
FIGS. 16A-16F illustrate examples of other embodiments of structures that may transform from a substantially flat 2-dimensional closed state to a 3-dimensional open state.
Figure 16B:
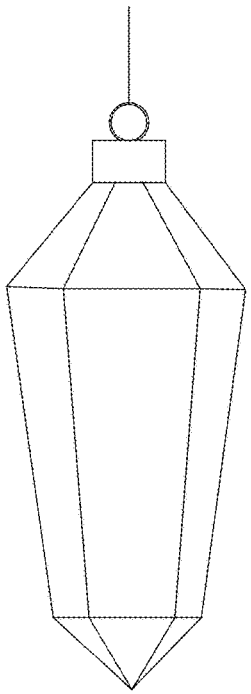
Figure 16C:
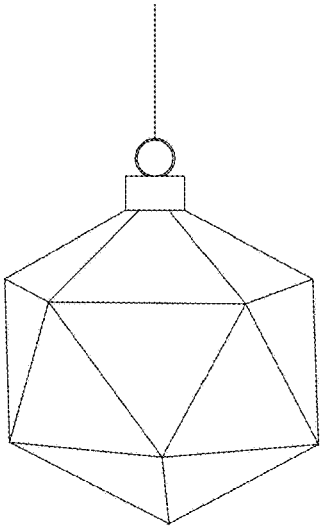
Figure 16D:
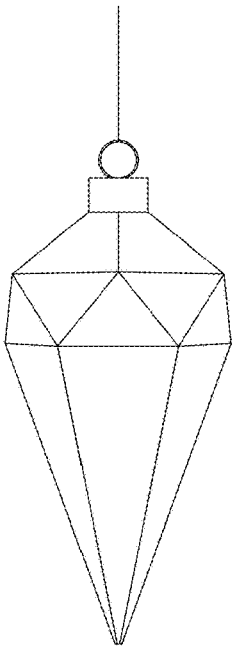
Figure 16E:
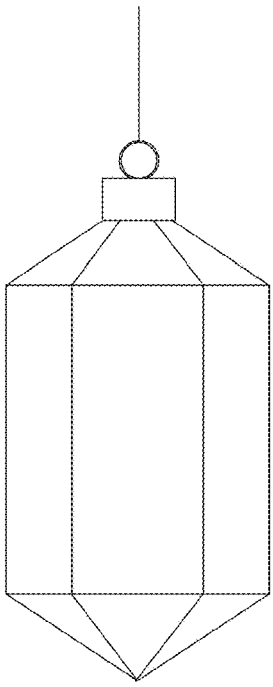
Figure 16F:
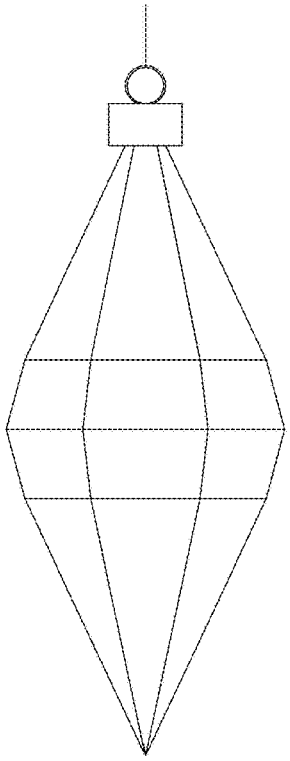

In FIG. 15C, the glue tab 13 and actuator control plate 115 are pulled together and glue tab is glued (or otherwise attached) to the actuator control plates (movement e). On close examination of FIG. 15C, it is noted that it is normally not possible to pull the parts together to close the gap at e if the facet panels 1 of parts 160 and 260 are both in a flat 2-dimensional plane. This bringing together of tabs 13 and 115 at e is made possible by first having the facet panels 1 folded up to create a cone shape (movement f). This makes and keeps the shape of the cone. Once movement f is made, creating a cone, it is then possible to bring together glue tab 13 and actuator control plate 115 for attachment to one another making an unbroken and continuous cone shape. The gluing of cone sides 160 and 260 creates the new sub-set of a complete sphere bottom cone part 360.

FIG. 15D shows front and side views of sub-set sphere bottom cone 360 in the flattened closed state. Actuator cords 60 are added to actuator control plate 115. FIG. 15D shows the actuator cords 60 being pulled upwards and the actuator control plates 115 being pulled and rotated inwards (movement g). This inward rotation of the two opposing actuator control plates 115 in movement g forces the faceted cone panels to fold outwards, opening, thus creating a cone shape (movement h). The angled bottom edge i of the actuator control plates 115 creates a limiting "stop" to prevent the cone from opening past the correct final angle s.

FIG. 15E shows an ISO view of the opening of sphere bottom 360 in motion where the actuator cords 60 are pulled up and the two opposing actuator control plates 115 rotate up and inwards pulling each side of the cone upwards, changing the bottom angle from angle t to angle s (movement g). This rotating angle change from angle t to angle s, induced from the rotating actuator control plates 115, inward from both sides of the cone, left and right, force the center cone panels to unfold or "open" (movement h).

FIG. 15F provides a front and top view of the sphere bottom cone 360 in the fully opened state. The sphere top cone is functionally identical to bottom cone with a minor variation explained below. Brake angle i (hidden) on the actuator control plates 115 is fully seated into the cone bottom at angle s between the left and right side facet panel 1 crease line a. No further opening movement of the pull cords 60 or actuator control plates 115 beyond the correct angle s is possible due to the braking angle i imposed on the interior cone bottom and facet panel 1 crease line a as shown in the front view of FIG. 15F.

In this example, the top cone 460 is the same as the bottom cone but with no actuator cords 60 attached. The top cone 460 uses the pushing down motion from the hand, instead of the actuator cords 60 to perpetuate the opening motion needed to rotate the actuator control plates 115 inwards and force open the facet panels 1 of the top cone and stopping at the correct spot due to the limiting stop/brake of angle i on the actuator control plates 115. Angle i limits the travel/opening of the cone and resists any implied over-compression or collapsing force of the sphere, helping to maintain its shape under compression stresses.

As an alternative, the actuator tab 115 may not be used. A simple cone can be made with facet panels 1 being joined to one another to create a cone shape. In this case, the cones still function as intended, folding from flat 2-dimensional to a 3-dimensional cone shape (movement h) provided the facet panel 1 number is such to make a symmetrical folding and flattening possible. The simple cones may still initiate the sphere opening and closing but without the added stability and internal support the actuator tabs 115 provides.

An alternate method to perform movement g, to open the object, is to do so manually, that is, instead of pulling the actuator cord 60 to initiate movement g (FIGS. 11A-11B), one places one hand each on the sphere poles and push the poles together. This compression will expand the sphere as before and perform the same function as pulling the actuator cord 60. If the sphere is opened in this manner, that is by hand, the actuator cord 60 may be pulled after the manual opening and restrained using the cord lock 499 to keep the sphere in compression in the expanded state. Devices other than an actuator cord can be used to maintain tension to keep the object in the compressed state (e.g., an internal rubber band).

FIGS. 16A-16F illustrate examples of other embodiments of structures similar to the sphere that may transform from a substantially flat 2-dimensional closed state to a 3-dimensional open state. Each of these examples of geo-shaped ornaments can be made using techniques similar to those shown above. The shapes and orientations of the facet panels, movable and sliding accordion acting joints that are arranged to open and close are adjusted to provide the desired object.

To provide one example, FIGS. 17A-17E illustrate an embodiment of a tear drop shaped ornament utilizing the same principles outlined herein to transform the object from a substantially flat 2-dimensional closed collapsed state to a 3-dimensional open expanded state.

Figure 17E:
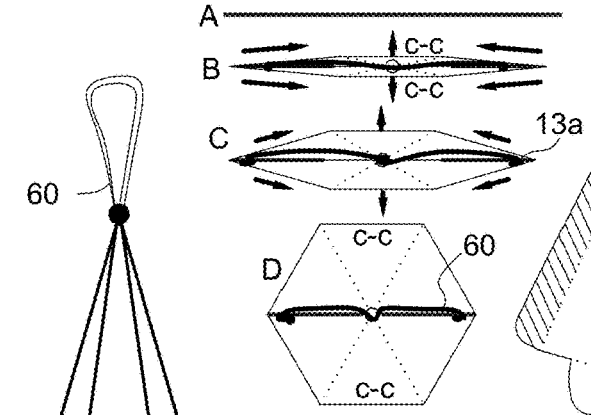
FIGS. 17A-17E illustrate an embodiment of a tear drop shaped ornament.
Figure 17A:
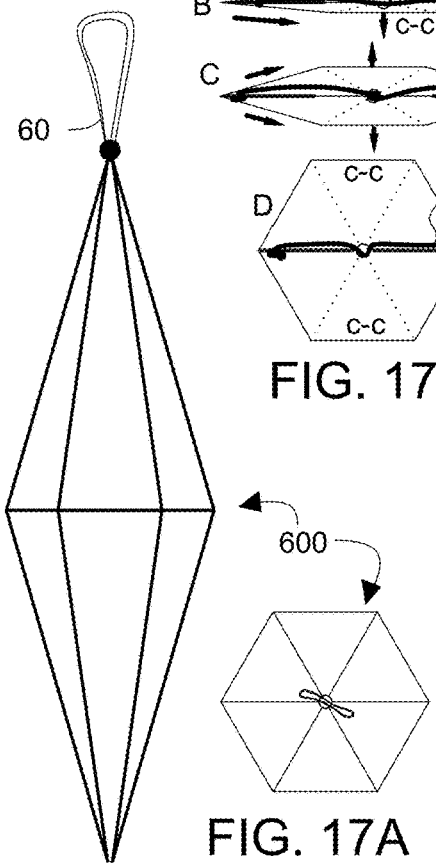

FIG. 17A shows front and top views of the completed tear drop shaped object in its expanded state. The tear drop 600 uses similar parts and operation principles presented and outlined in the sphere example. As with other objects discussed herein, size, shape and proportions, materials, surface finishes and graphics, lighting options, specific pattern layout, mechanics and details of parts, modes of operation and assembly techniques may vary.

Figure 17B:
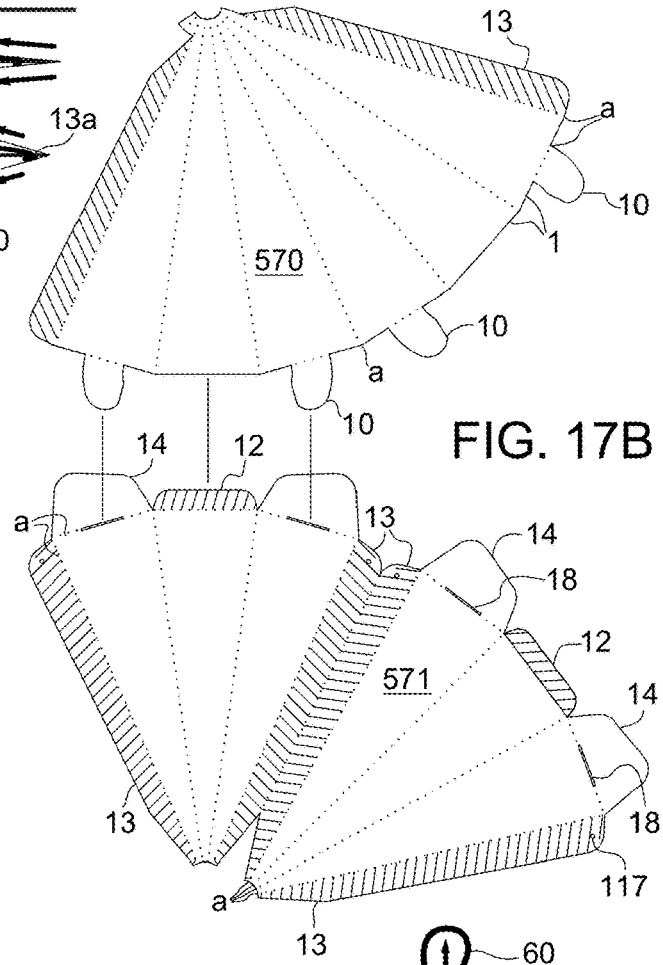

FIG. 17B shows the top 570 and bottom 571 patterns used to make the tear drop 600. The reference numerals correspond to those used in FIG. 3A.

Figure 17C:
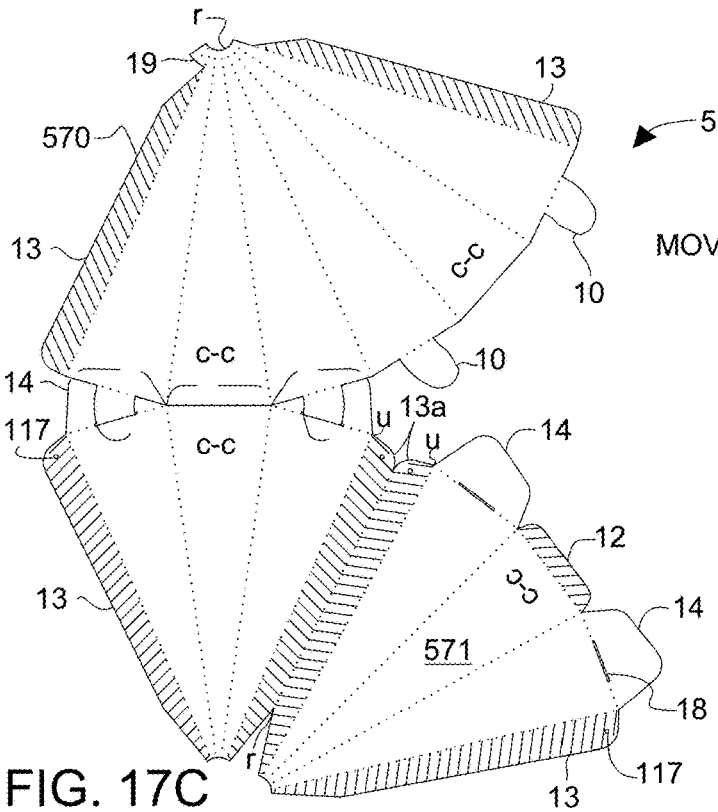

In FIG. 17C, the top pattern 570 and bottom pattern 571 are brought together and joined via pattern connection tab 12 to form sub-assembly 577. During joining, sliding alignment guide tabs 10 are placed in front of slot stiffener tabs 14 and are inserted into guide tab slots 18.

Examining upper section 570, the two pattern group connection tabs 13, one on each side of the part, are folded over 180 degrees toward what will later be the inside of the object. Next the entire part is folded over 180 degrees (i.e., in half) along center fold line r. The two pattern group connection tabs 13 are now facing one another (i.e., on top of one another) are glued together creating a continuous cone. Collar flap 29 is wrapped in the interior creating a circular ring to reinforce the opening where the actuator cord 60 passes through. Other means of reinforcing the hole where the cord passes through are possible (e.g., plastic collar).

Examining lower section 571, the two inner pattern group connection tabs 13*a* are shown. Glue is applied to the tabs, which are folded over 180 degrees along fold line r, with the outer surfaces on the inside facing one another. Gluing the tabs 13*a* together creates a ridged spine. As with the upper section, the two outer connection tabs 13, one on each side of the part, are folded over 180 degrees along the fold line, toward what will later be the inside of the object.

At this time both sides of facet panels 571 are folded 360 degrees at fold line u, back on themselves thereby creating a cone shape and placing the finished exterior surfaces on the outside and both left and right glue tabs 13, 13*a* on the inside of the object. Pattern group connection tabs 13, now facing one another are glued together creating a continuous flattened cone. During this process the two remaining sliding alignment guide tabs 10 are placed in front of slot stiffener tabs 14 and are inserted into guide tab slots 18.

Figure 17D:
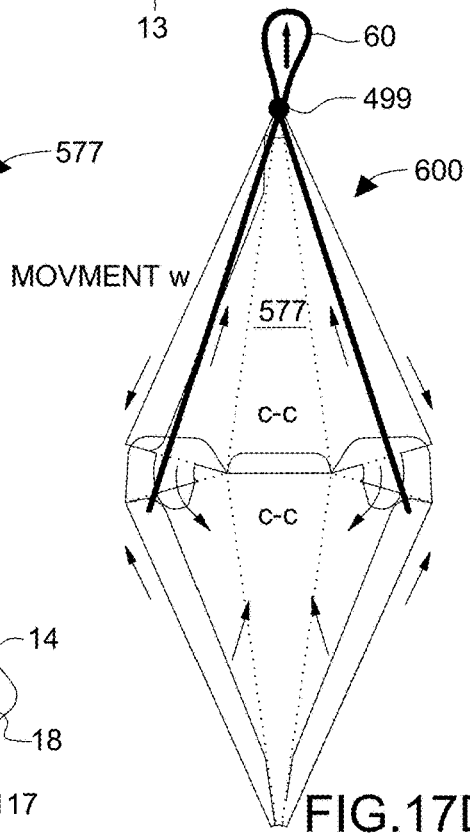

FIG. 17D shows a section view of the completed subassembly 577 in its flattened 2-dimensional state (i.e., collapsed). Actuator cord 60 (e.g., ribbon, barbed or knotted ends) is attached to activation cord holes 117 located on the lower glue tab spines 13, 13*a* and run through the hole at the top of the object, completing grouping 600.

Movement w is shown whereby the actuator cord 60 is pulled up with one hand. The other hand holds the upper cone 570 in place and/or pushes it down. Pulling on the actuator cord 60 combined with the resistance on the upper cone 570 transmits the force downwards through the center facet panels 1 at c-c on both sides of the object and also at the same time pulls the lower glue tab spines 13, 13*a* upwards and inwards. This in turn forces the upper and lower cones (570, 571) toward one another, in compression. These combined forces cause the center facet panels at c-c to push outwards, expanding the cone and also causing the sliding alignment guide tabs 10 to rotate downwards and slide into the guide tab slots 18 until the upper and lower cones meet creating a proper hexagon with a closed, visually unbroken surface. Cord lock 499 is added to keep the entire object in tension (i.e., in the expanded state).

FIG. 17E shows a plan section view of the progressing of movement w whereby the object starts in a substantially closed, flattened 2-dimensional state (view A). In view B, pulling actuator cord 60 pulls the left and right glue tab spines 13, 13*a* inwards towards one another. This in turn forces the facet panels at c-c (i.e. spine) to expand outwards. The progression continues in view C until the movement is completed as seen in view D.

An alternate method to perform movement w is to push the object poles together, by hand, opening the object, and then pulling taught and locking the actuator cord 60 to maintain tension to keep the object in the fully expanded state. As noted above, the actuator cord 60 can be replaced (or supplemented) with another device that performs the same function.

The object is closed (i.e., returned to the flat 2-dimensional shape) by releasing cord lock 499 allowing freedom of movement of actuator cord 60 and pressing with the hands on both sides of the object at the equator in the location of longitudinal center line (i.e., spine) facet panels 1 at c-c, reversing the opening movement, until the object is in its fully flattened state.

Although different in some aspects and details, movement w is substantially similar in principle to the mechanics of parts and movements outlined in the sphere example and embodies the design ideas presented herein.

Figure 17H:
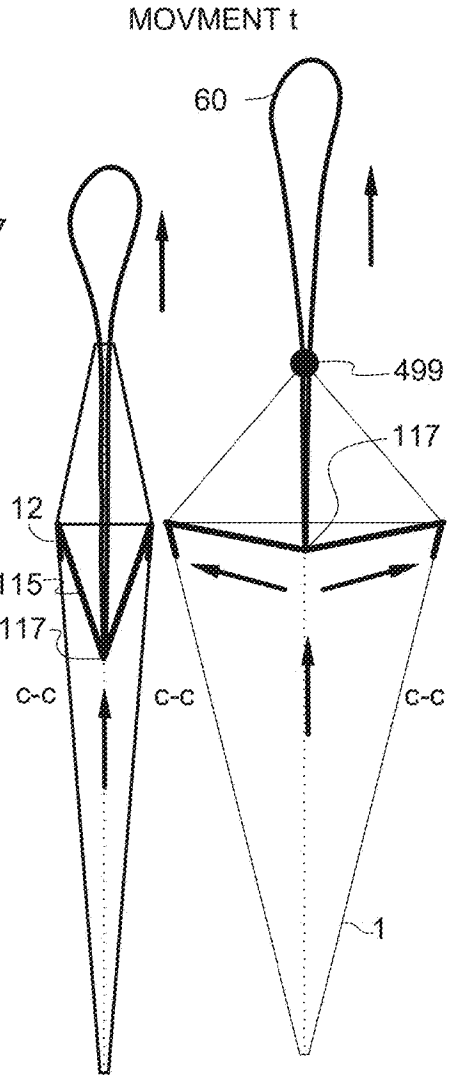
FIGS. 17F-17H show another variation of the tear drop ornament.
Figure 17G:
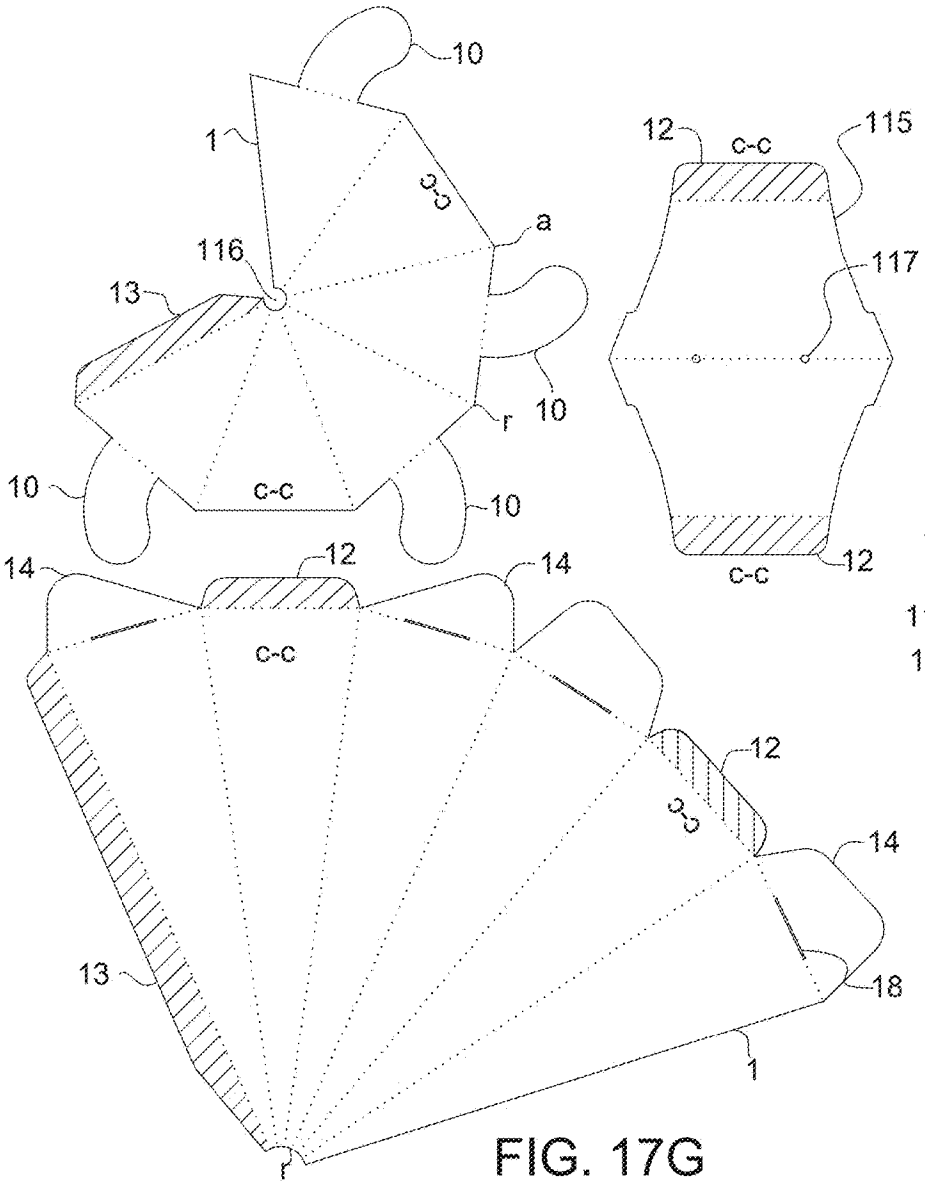
Figure 17F:
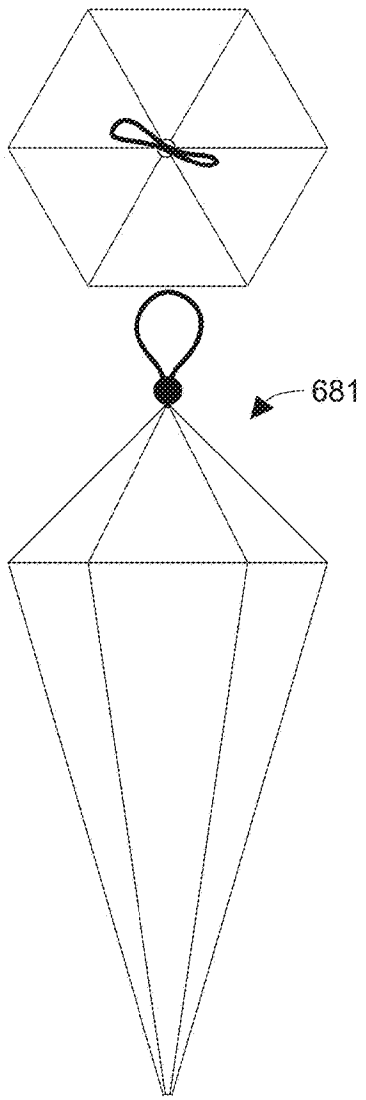

FIGS. 17F-17H show another variation of the tear drop ornament but having a shorter top cone as the prior example in FIGS. 17A-17EJ. The object is functionally similar to the preceding tear drop but uses an alternate expansion/collapsing mechanism similar to that outlined in the candy cane example.

FIG. 17F shows front and top views of the completed tear drop 681 in the expanded opened state. FIG. 17G shows the patterns needed to construct the object 681. Numerals are consistent with prior examples. On the upper and lower patterns, pattern group connection tabs 13 are rotated 180 degrees along the fold line. Both upper and lower patterns are then folded over (i.e., in half) along fold line r. Since the connection tabs 13, 13*a* (from FIG. 17C) from the prior example are not needed or used to attach the actuator cord 60 to, a simple overlapping of connection tab 13 by facet panels 1 using glue, tape or other means can join the pattern ends together making a continuous cone shape eliminating the raised tab. Facet panels 1 may be connected by any other practical means. Actuator control plate 115 is shown with actuator cord attachment points 117.

FIG. 17H is a section side view of the installed actuator control plate via connection tabs 12 to center (c-c) the facet panels 1. Actuator cord 60 is attached to actuator cord connection locations 117 on the actuator control plate 115 and run through the top of the actuator cord hole 116.

While holding the object in place, pulling the actuator cord 6*o* upwards causes the actuator control plate 115 center upwards extending the plate arms thus pushing the facet panels 1 at c-c outwards, opening the object. Similar to the candy cane actuator plate, this plate is slightly longer than the cross section of the opened hexagon, thus wedging it in position in the fully open state and preventing it from being pulled past 180 degrees thereby inverting it, rendering it ineffective. Cord lock 499 keeps the object in tension preventing inadvertent collapsing.

The object is collapsed by releasing cord lock 499 and pressing on facet panels 1 at location c-c at the object equator.

The example provided in FIGS. 17F-17H further demonstrate that a multitude of mechanical designs and devices may be used to facilitate the transformation of an object from substantially flat to an opened 3-dimensional object using and adhering to the design criteria described herein.

Figure 18A:
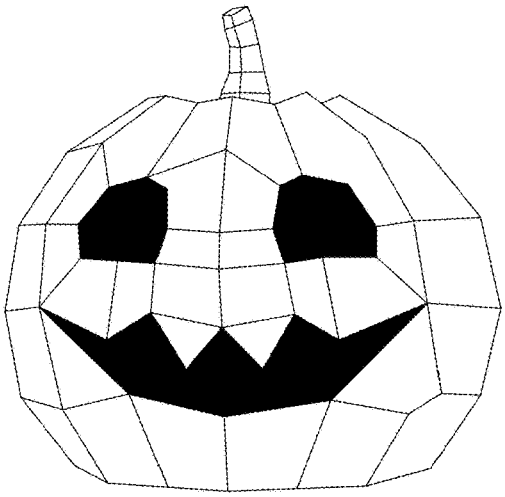
FIGS. 18A-18F illustrate examples of more complex embodiments.
Figure 18B:
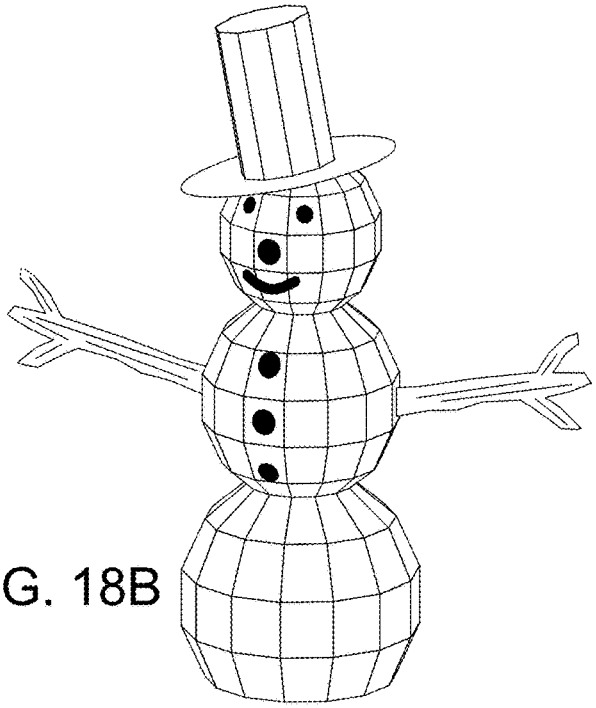
Figure 18C:
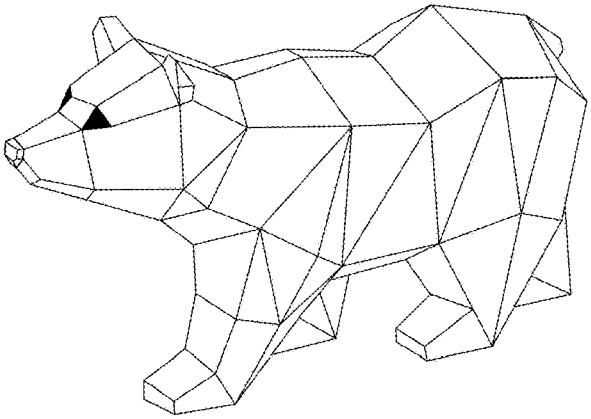
Figure 18D:
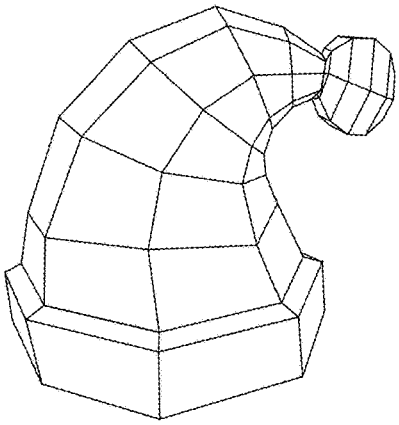
Figure 18E:
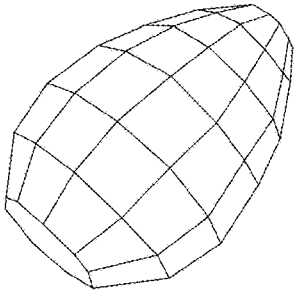
Figure 18F:
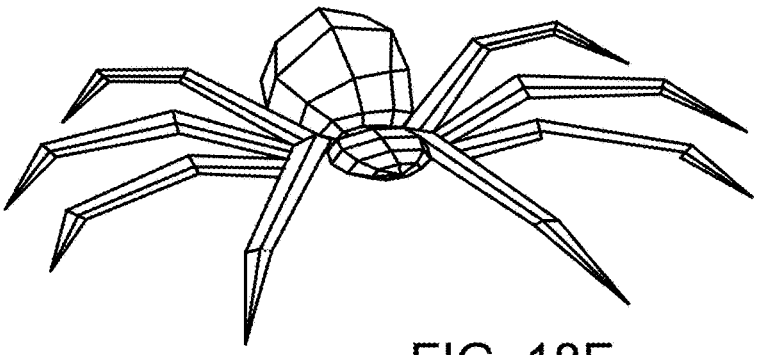
Figure 19A:
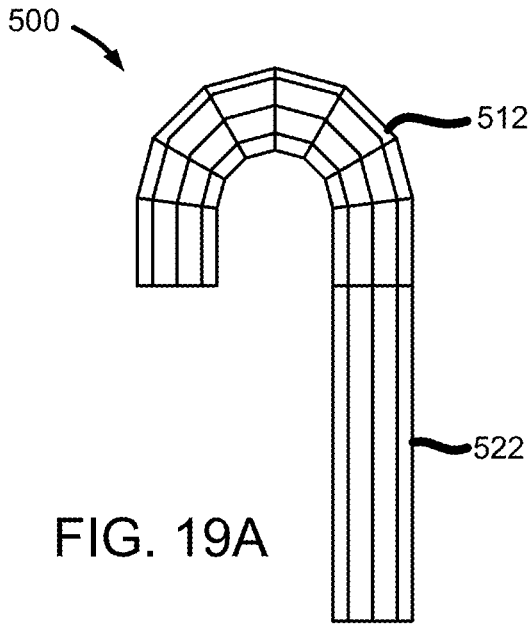
FIGS. 19A-19D illustrate a candy cane as an example of another embodiment.
Figure 19B:
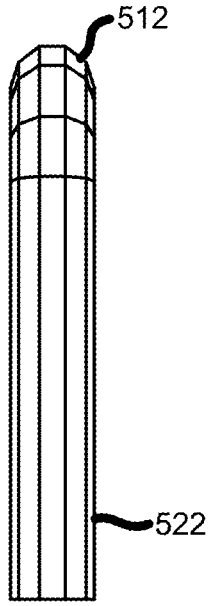
Figure 19C:
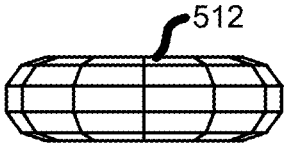
Figure 19D:
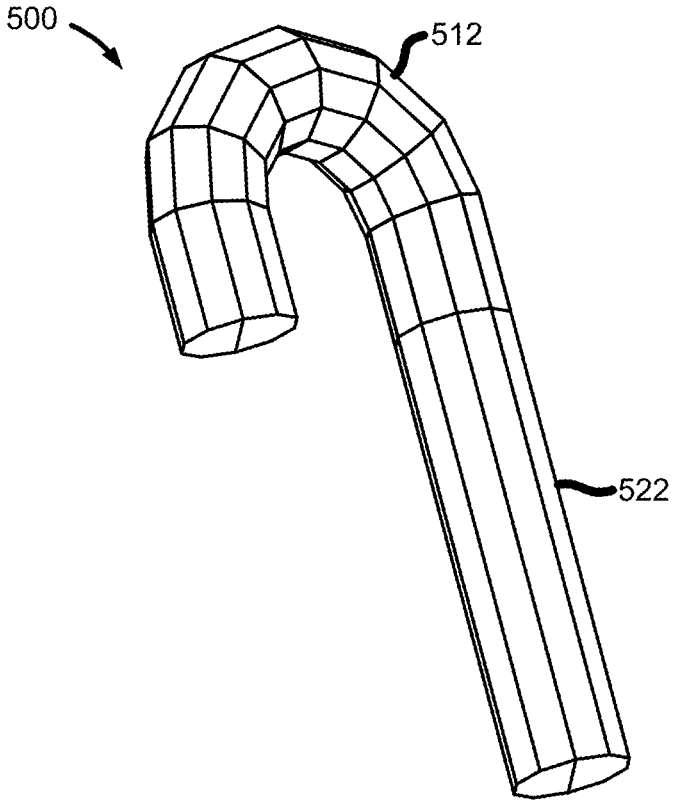

FIGS. 18A-18F illustrate examples of more complex embodiments. Each of these examples illustrates a recognizable object. For example, FIG. 18A shows a jack-o-lantern, FIG. 18B shows a snowman, FIG. 18C shows a bear, FIG. 18D shows a hat, FIG. 18E shows an egg (e.g., Easter egg) and 18F shows a spider. These examples are provided to be illustrative. It is understood that countless objects can be produced using the techniques described herein. Other examples include a Valentine heart, bell, lantern, a sled and reindeer, planets/solar system, candles, trees, a menorah, a dreidel, and a baseball.

As another example, a greeting card can be presented in the form of a collapsible object. The card could be paired with an envelope of a suitable size. As but one example, a picture can be taken of the family and printed on the facet panels of the card. With the pull of a string the family will present in three dimensions.

The provisional application (63/239,179) includes photographs (in FIGS. 18A-18H) that show an example process for forming the object as described above, or other object of different shape. These photographs are not reintroduced here but can be found in the provisional application.

The formation occurs once, for example, at the factory where the object is fabricated. The object can be flattened and shipped to the user in one or more pieces. In the Christmas ornament example above, the final ornament can be delivered as a single piece or in two pieces if the neck is separated from the sphere or many parts for a more DIY home assembly project. Other larger or more complex structures can be shipped in multiple pieces, assembled and expanded by the end user.

In FIG. P18A (i.e., FIG. 18A of the provisional application), a plastic sheet is laid out and, using a tool, cut into the individual pieces as shown in FIG. P18B (see also FIG. 3A). The assembly of the object is shown in FIGS. P18C-P18G. FIG. P18H shows a sphere in the open state. It is noted that the illustrations in FIGS. P18A-P18H show a different embodiment than otherwise discussed herein. The process illustrated can be used with the object described above.

FIGS. 19A-19D illustrate a candy cane as an example of another embodiment, i.e., the formation of another collapsible object using the same disclosed principles of mechanics as described in the sphere above. Once again, the object is formed from 2-dimensional materials to create a 3-dimensional recognizable object from rigid facet panels and movable articulating joints which can be expanded and collapsed to open or close spaces in-between the facet panels as needed in a coordinated movement to create a specific shape with minimal assembly. A number scheme similar to that used above is used in these figures.

FIGS. 19A-19D show front, side, top and ISO views of a candy cane 500 in the open 3-dimensional, expanded, assembled configuration.

Figure 20A:
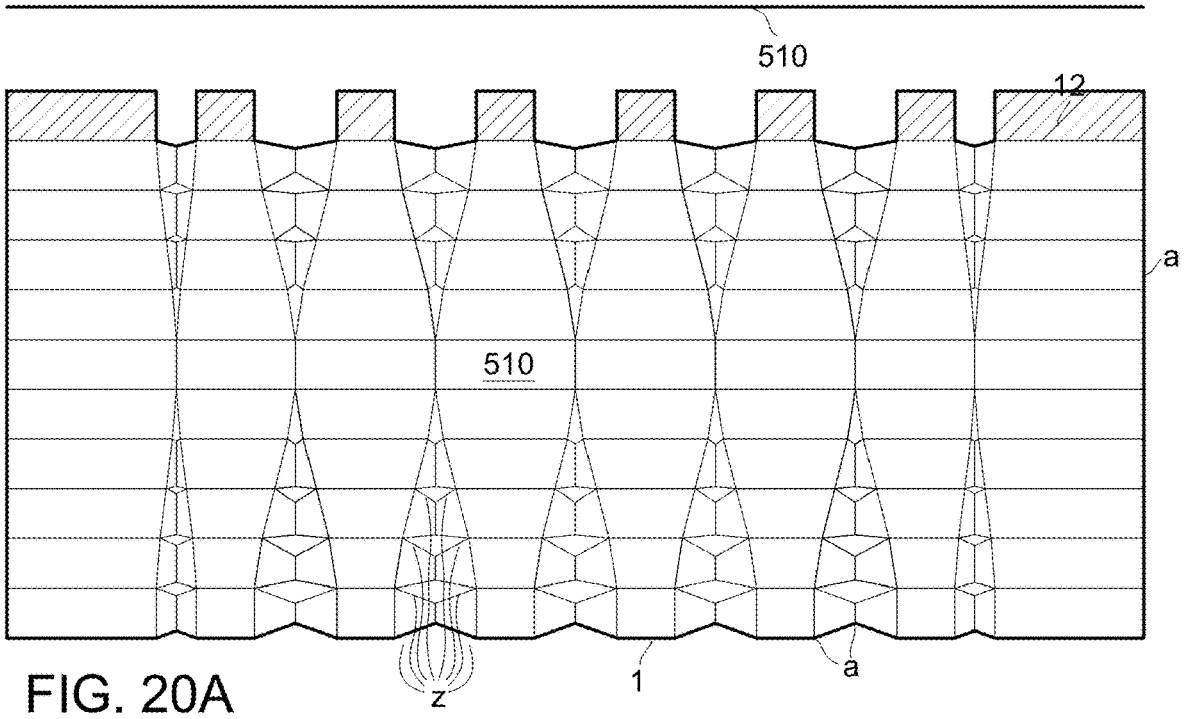
FIGS. 20A-20C provide plan and side views of the cut-out patterns for a candy cane embodiment.
Figure 20B:
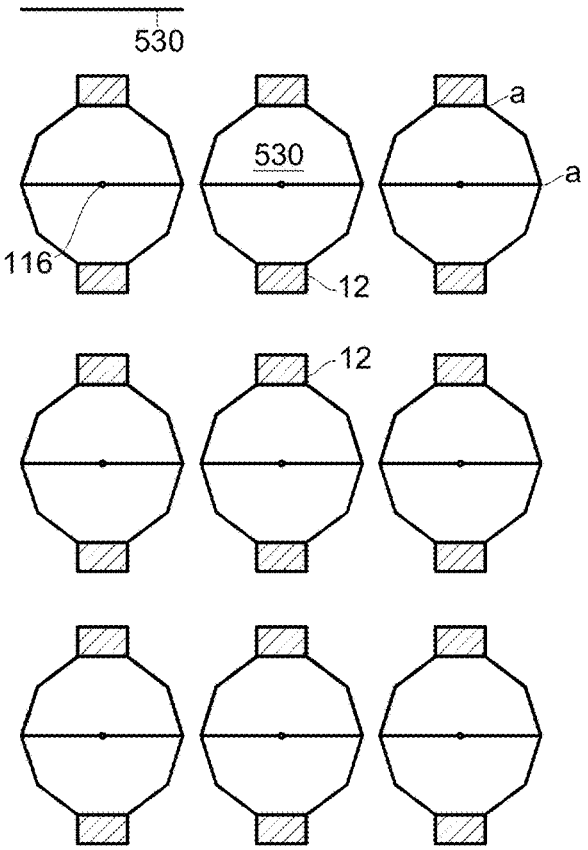
Figure 20C:
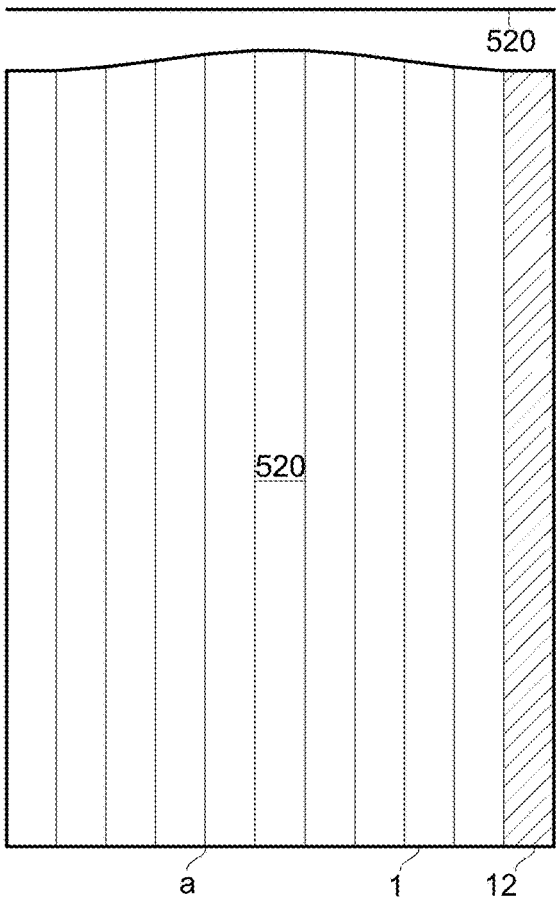

FIGS. 20A-20C provide plan and side views of the cut-out patterns from flat 2-dimensional sheet material needed to construct a candy cane, as well as flat facet panels 1, movable hinged joints a, accordion retracting panels z and glue tabs 12.

FIG. 20A shows the pattern of the top curved portion of the candy cane 510. FIG. 20C shows the pattern for the straight shaft of the candy cane 520. FIGS. 20A, 20C show rigid facet panels 1, flexible joints a, glue tabs 12, and articulating panels z that control the opening and closing of open spaces between facet panels 1 to create the final 3-dimensional shape. FIG. 20B shows the pattern of the internal actuator plate 530 that controls the opening and closing of the candy cane from a flattened 2-dimensional state to an expanded 3-dimensional state.

Figure 21A:
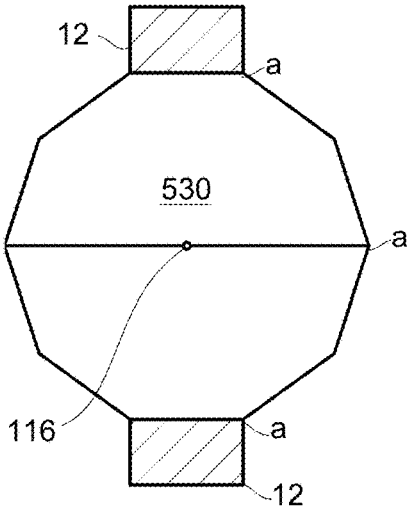
FIGS. 21A-21C show an internal actuator plate.
Figure 21B:
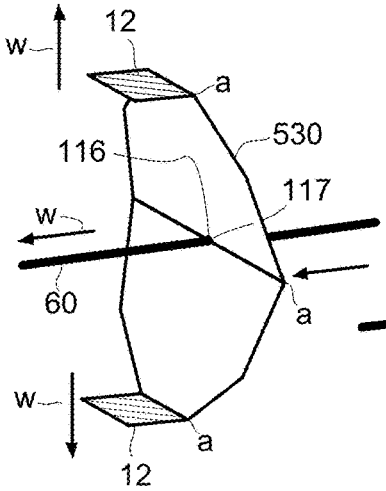
Figure 21C:
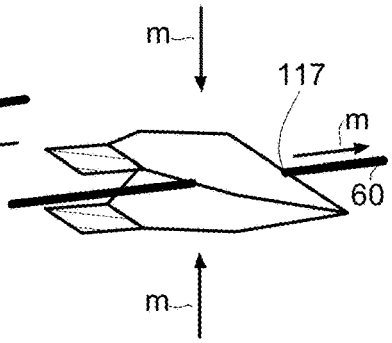

FIGS. 21A-21C show the internal actuator plate 530. FIG. 21A shows a detail of the flat actuator plate 530 pattern cut-out including attachment glue tab 12 and actuator cord hole 116.

FIG. 21B shows the actuator plate 530 in the open, expanded state, whereas glue tabs 12 are fixed to the side walls of the collapsed cylinder 510, 520 as shown later in FIG. 22A. Actuator cord 6*o* is added through the actuator cord holes 116 with cord stops 117 added on either side of each actuator plate 530 keeping the center of the plate located on a specific spot on the cord. The center of the actuator plate 530 is pulled left and right as the cord is pulled and moves left and right. Pulling the actuator cord 60, in this case to the left (movement w) will engage the actuator plate 530 panels and simultaneously force the glue tab surfaces 12 to move perpendicular to the pull cord 60 axis, thus pushing the glue tabs outwards like a wedge, expanding the flattened cylinder wall into a rounded 3-dimensional decagon shape.

The actuator plate 530 is designed in such a manner that its measured length along fold line a (x axis of part) is the same diameter as the inside of the opened cylinder diameter, enabling it to slide inside the cylinder walls freely. The perpendicular measurement (y axis) of the actuator plate 530 (glue tab 12 to glue tab 12 dimension) is slightly larger than the inside diameter of the fully opened cylinder diameter. The elongated dimension of the actuator plate 530 in the y axis acts as a "stopper" similar to a cork in a bottle opening. As the actuator cord 6*o* is pulled, the plates fold outwards opening the cylinder tube. Continuing to open, as soon as a perfectly shaped symmetrical decagon is formed, created and maintained by the correct x axis dimension of the actuator plate 530, all the interior cylinder tube walls (flat facet panels 1) lock tight against the outside edges of the actuator plate 530 edges. Because of the closed circular nature of a tube, the tube cannot move any higher in height (y axis) or in any direction, thus locking all the parts in place and maintaining a 3-dimensional decagon shape.

The limiting dimension in the height (y axis) keeps the actuator plates 530 at an acute angle, not fully opened and wedged in place seating the plate edges like a cork against the interior cylinder walls. This design prevents the actuator plates 530 from being pulled through, past 180 degrees, reversing or inverting it, thus allowing it to collapse in the opposite direction and rendering it ineffective.

FIG. 21C shows the actuator pull cord 60 being pulled in the opposite direction (in this case to the right). This movement m pulls the center of the actuator plate 530 to the right and allows it to unseat from the cylinder walls and "close" or collapse into a flattened 2-dimensional state, allowing the cylinder tube to also flatten from a 3-dimensional to 2-dimensional state.

Figure 22A:
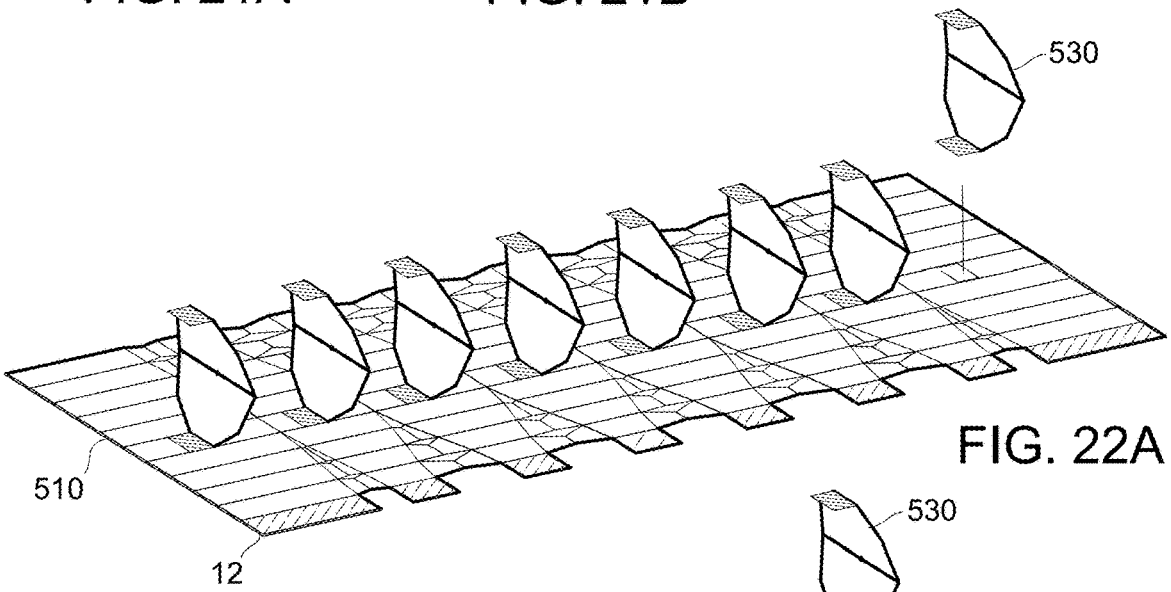
FIGS. 22A-22C show ISO and side views of the bottoms of actuator plates.
Figure 22B:
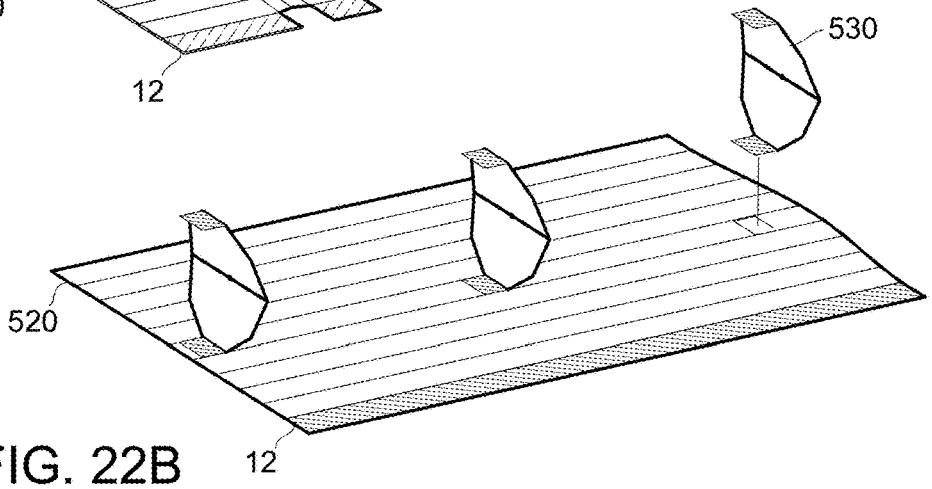
Figure 22C:
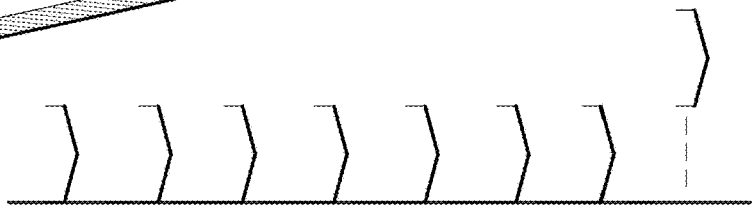

FIGS. 22A-22C show ISO and side views of the bottoms of the actuator plates 530 being joined (glued or otherwise connected) via the glue tabs 12 to the cut-out patterns of the top curve of the candy cane 510 (FIG. 22A) and the candy cane shaft pattern 520 (FIG. 22B).

Figure 23A:
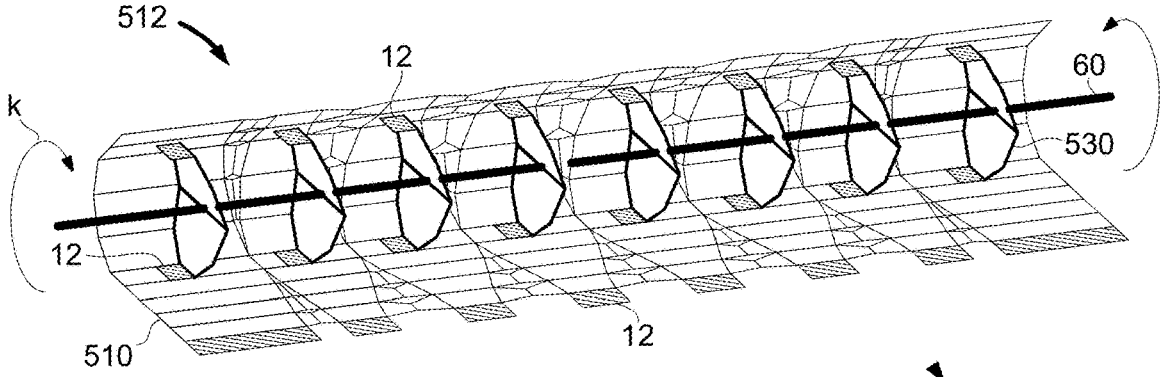
FIGS. 23A-23B show flat patterns being rolled into a cylinder shape.
Figure 23B:
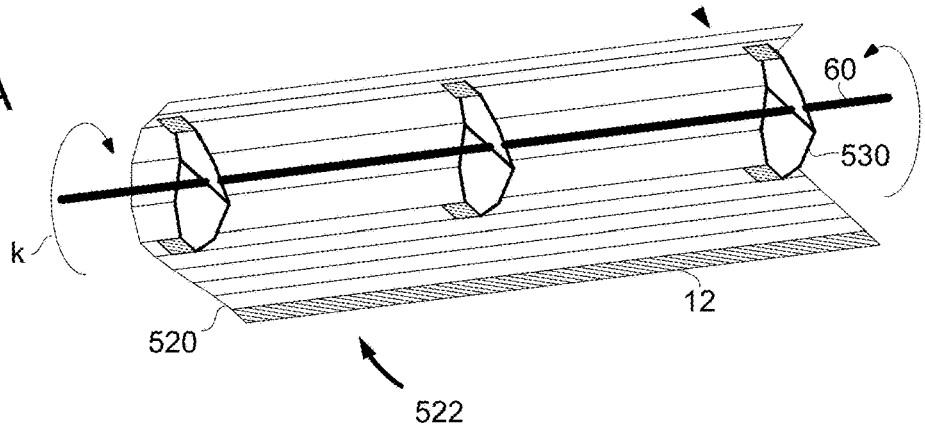

FIGS. 23A-23B show the flat patterns 510, 520 being rolled into a cylinder shape, the long edge of the patterns being joined at glue tabs 12 completing the cylinder (movement k). During movement k, the top glue tab of the actuator tabs 12 are glued to the opposite cylinder walls. The actuator pull cord 60 is added. Stops 117 are located on the pull cord on either side of the actuator plates 530 to "push" and "pull" the center of the actuator plates as needed. As the actuator cord 60 is pulled in one direction or the other the actuator plates 530 and facet panel cylinder walls 1 expand or collapse.

Figure 24:
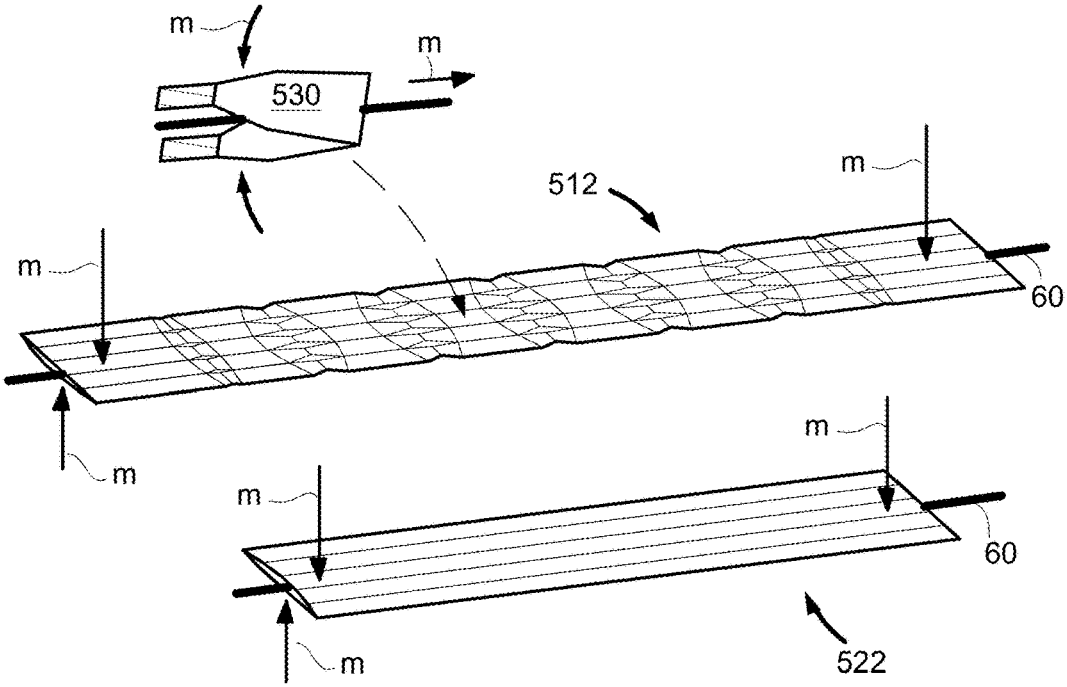
FIG. 24 shows a completed top curve sub-assembly, shaft sub-assembly, and an internal actuator plate.

FIG. 24 shows the completed top curve sub-assembly 512 and the completed shaft sub-assembly 522 as well as the internal actuator plates 530 (hidden) all in the flattened collapsed state as a result of the collapsing movement m.

In FIGS. 23A and 24, the cylinder includes ten cylinder wall facet panels 1 around the cylinder circumference thereby creating a decagon when in the expanded open configuration. The design presented herein functions as a result of there being an odd number on each side, with a center panel and an equal number of facet panels 1 on each side of the center panel to which the actuator plate tab 12 is attached. This formula of center panel with equal number of facet panels 1 on each side of the center panel is the same formula used in the sphere examples. In the candy cane example there are five facet panels one per side, two on each side of the center panel when the object is collapsed in the closed position. This design allows the cylinder to collapse symmetrically along a center spine, in this case, allowing the internal actuator plate 530 to fully collapse into a flattened state.

As the shape of connected facet panels 1 may vary in more complex objects, the connected panels at spine c-c may take on an irregular pathway (i.e., not straight).

As with the sphere, the number of surface facet panels 1 may vary to any number. As an example, a large four foot diameter candy cane can have 26 facet panels 1 along its circumference. Using the formula provided, there would be six facet panels, one on each side of a center (spine) panel, thus 13 facet panels per side when collapsed. Any number of cylinder wall or sphere facet panels 1 may be used as long as the number is coordinated with the opening/closing mechanism to allow the object to fully open as intended and close to a substantially flattened condition at will.

In this state shown in FIG. 24, the flattened straight top curve 512 is placed directly on top of the flattened straight shaft 522 for packing, shipping, and storage, taking up a small fraction of the volumetric space of the expanded, opened assembled object.

Figure 25:
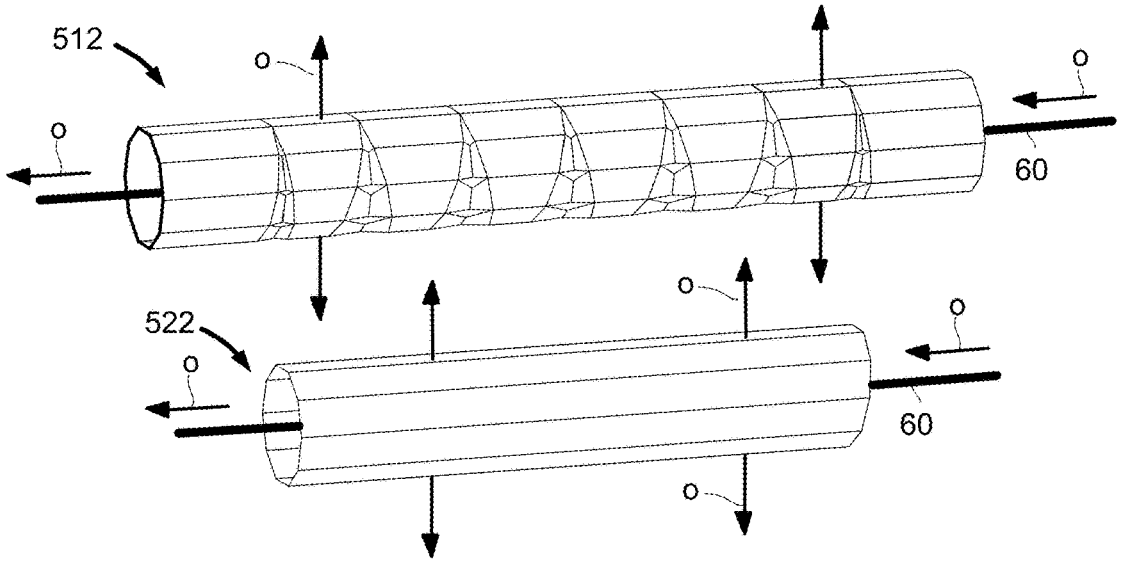
FIG. 25 illustrates a movement when an actuator pull cord is pulled.

FIG. 25 shows movement o where the actuator pull cord 6*o* is pulled, in this case to the left, thereby opening the internal actuator plates 530 until they seat firmly against the cylinder wall facet panels 1, in the process expanding the cylinder walls outwards into a proper decagon shape.

Figure 26:
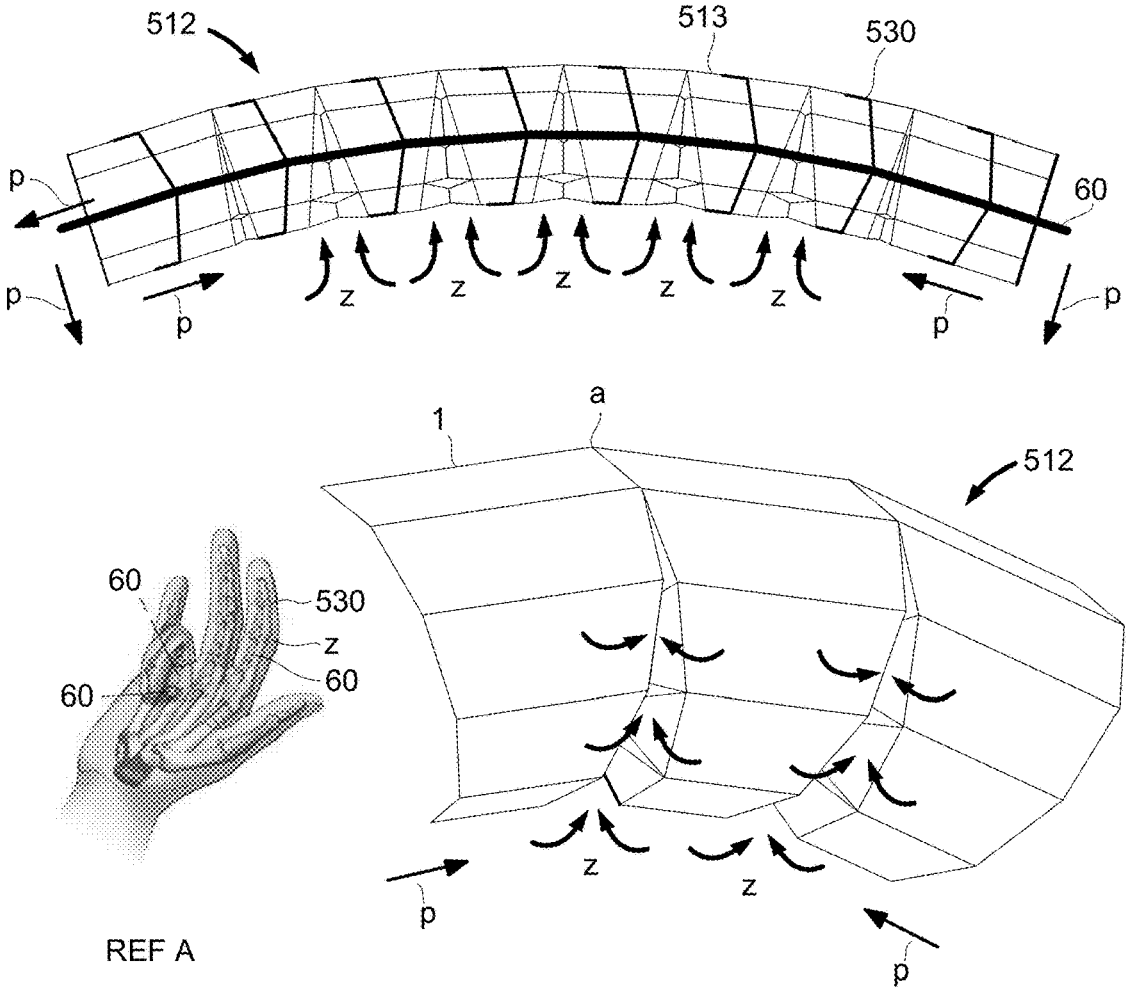
FIG. 26 shows a section and ISO view of a curving movement to create the top curve of a candy cane 512 from a straight flattened cylinder shape.

FIG. 26 shows a section and ISO view of the curving movement p to create the top curve of the candy cane 512 from a straight flattened cylinder shape. Following the opening of the cylinder tube from a flattened state to the opened state, and with the actuator plates 530 firmly seated on the cylinder walls as accomplished in movement o above, the actuator pull cord 60 is continued to be pulled through, starting the curving movement p. This continued pulling forces the retraction of the accordion control panels z and forces the actuator tabs together creating a curve. This movement is similar to the tendon pulling inside to create a curved finger. The accordion retracting panels z retract similarly to the skin on the underside of the finger as shown in Reference A allowing the part to curve. The folding geometry of the accordion panels control the movement of the converging flat facet panels 1, bringing them together in the correct orientation to align the facet panel edges, creating proper aligned seams between the surface facet panels 1, thus creating the illusion of a seamless, unbroken surface.

Figure 27:
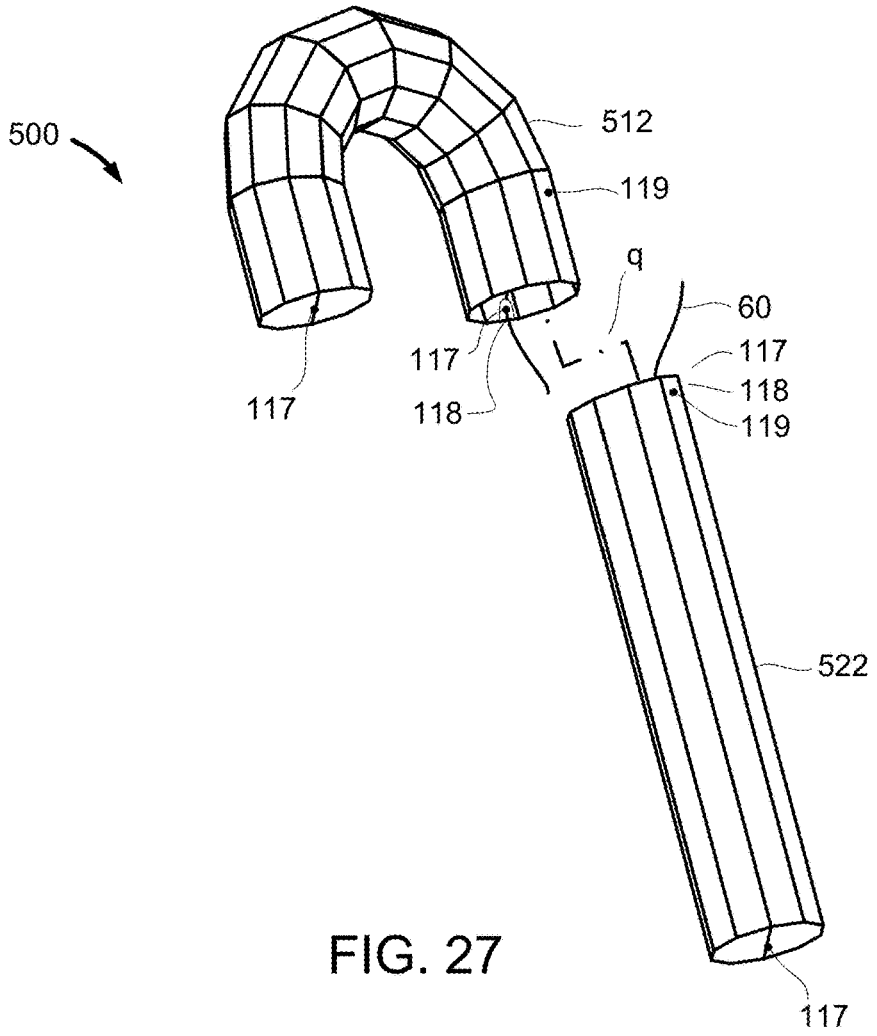
FIG. 27 shows an ISO view of an expanded top curve sub-assembly and expanded straight shaft sub-assembly for a candy cane.

FIG. 27 shows an ISO view of the expanded top curve 512 sub-assembly and expanded straight shaft sub-assembly 522 needed to make a completed candy cane 500.

Shown on top curve 512 and straight shaft 522 is a stopper knot located on one end 117 of the actuator cords 60 and held tight by a cord locking device 118 on the other end, maintaining tension and preventing loosening of the actuator cord 60 and thus, holding the opened object in tension, preventing the collapsing of the object until desired.

FIG. 27 shows movement q where the straight shaft 522 being slightly smaller in diameter than top curve 512 is sleeved into the bottom of top curve 512. A snap, cord, strap, or other temporary locking device, is provided to keep the sleeved parts from inadvertently separating. A friction sleeve may also be used for smaller objects such as greeting cards where a locking device may not be necessary.

Depending on the size, very large, 12' or more as an example, the top curve 512 and straight shaft 522 parts may be further divided into smaller sections for later assembly.

Figure 28:
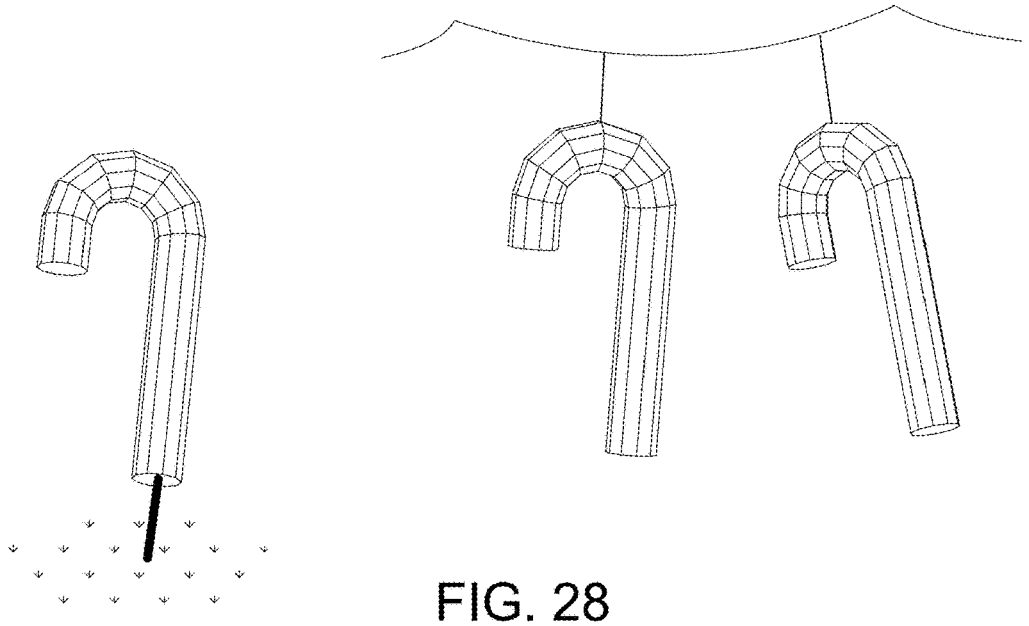
FIG. 28 shows ISO views of a completed candy canes.

FIG. 28 shows ISO views of a completed candy cane in various uses, (e.g., hanging or ground supported).

In this example the candy cane utilizes the mechanics of retracting panels z to control the opening and closing of open spaces in-between rigid facet panels 1 to manipulate an object's shape to appear to have a seamless, unbroken continuous surface. The sphere example utilized sliding guide tabs 10, guide tab slots 18, and slot stiffener tabs 14 to achieve substantially the same mechanical effect and result. Both systems as well as a variety of others not described herein may be implemented alone or in concert, to achieve the same mechanical effect, allowing the opening and closing of open spaces in a coordinated movement to obtain a desired shape of a closed unbroken surface appearance with minimal assembly.

Figure 29:
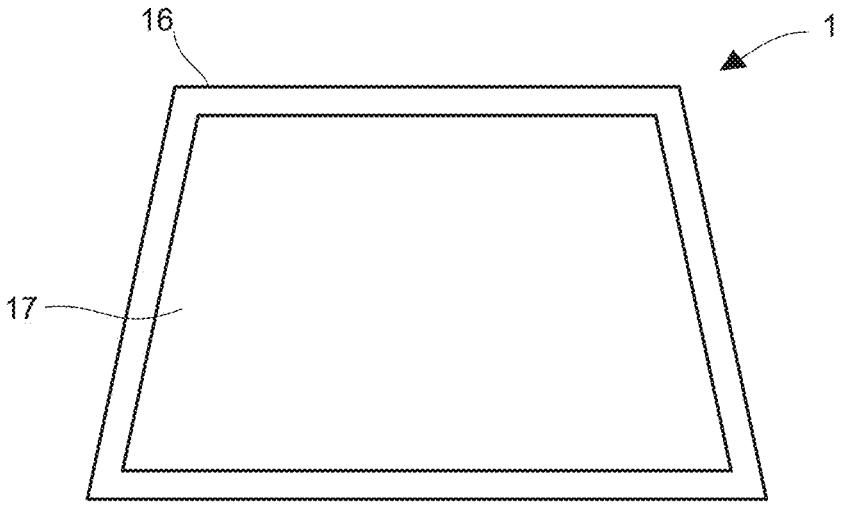
FIG. 29 shows an example of a facet that includes a rigid frame around a perimeter and a surface material within the rigid frame.

For all embodiments, perhaps depending on the size of the object, other material, activation mechanisms and devices may be used instead of, or in combination with, the actuator pull cord 60 and sliding alignment guide tabs 10, guide tab slots 18, slot stiffener tabs 14, actuator control plates 115 or 530 to affect the opening and closing of the object. A multitude of different design details and materials may be used to achieve the same opening and closing effect. Alternate means may include but not be limited to cardboard or plastic push rods for smaller greeting card sizes. Wood, plastic, metal rod or tube or cords or wires could be used for a system of hinged actuator arms and levers or captured sliding cords or wires in place of the flat actuator tab to open and close the sphere or tube walls for larger sizes. As shown in FIG. 29, a plastic sheet, sheet metal, FRP sheet or even fabrics 17 held in a rigid frame 16 can be used for the exterior flat facet panels surfaces 1.

The surface may be of opaque or translucent materials having surface printing, artwork, other added ornaments, glitter, internal or accent LED lighting. Materials may be suitable for interior or exterior uses.

In summary, a collapsible object is disclosed herein. A plurality of interconnected facet panels are formed from a rigid or hard-sided material or rigid frame with soft (or hard) material surface material. The facet panels are arranged so that the object can be in either a flat state or an expanded state.

In the flat state, the facet panels are substantially parallel to one another. The object has a first thickness in a direction perpendicular to the substantially parallel facet panels when in the flat state. This first thickness is close to, generally not greater than five times, the sum of thicknesses of the substantially parallel facet panels in the direction perpendicular to the parallel facet panels but can be more or less in thickness depending on variety of materials and fabrication details used.

In the expanded state, the object has a visually continuous outer surface that forms a closed three-dimensional shape. The object has a second thickness in the direction perpendicular to the parallel facet panels when in the expanded state. The second thickness is relatively large, possibly ten or thirty or hundreds of times larger than the first thickness but may vary more or less due to numerous factors both aesthetic (e.g., the final intended design shape) and/or functional (e.g., material thickness).

For smaller objects, the first thickness can be less than about one inch, e.g., a quarter of an inch while the second thickness is six inches or more. Larger objects typically include heavier materials and as such would have larger thicknesses. For example, the first thickness can be between three inches and six inches and the second thickness can be 24 inches or more. Once again, these thicknesses are merely provided as examples.

The facet panels can include fixed facet panels arranged in a first direction and sliding facet panels arranged in a second direction different than the first direction. The position of the sliding facet panels is different relative to the fixed facet panels in the flat state compared to the expanded position.

In the examples shown above, the temporary and repeatable transformation between a rigid 2-dimensional sheet material into a rigid 3-dimensional shape of the same material is possible by the specific geometry of the flat facet panel shapes 1, the specific geometry of cut out open negative spaces created between the surface flat facet panel shapes 1, and the articulating mechanisms utilized (e.g., sliding tabs or retracting panels) to control and keep aligned the opening and closing movement of the surface facet panels in a repeatable, predictable and desirable way.

Linkages within the object and/or an "activation device" is incorporated to move some, all or a combination of parts in one or a series of movements to "open" or "close" the object, initiated by the user with minimal time or effort.

In one example, the first thickness is substantially equal to the sum of thicknesses of the substantially parallel facet panels in the direction perpendicular to the parallel facet panels.

The second thickness can be greater than six inches. In another example, the second thickness can be four feet or more. A large setting could utilize collapsible ornaments of twelve feet or more.

The object can present in many forms in the expanded state, including a recognizable object. For example, design disposed on the outer surface of the object so that the object resembles the recognizable object. As examples, the object can resemble a Holiday/Christmas ornament, special events décor, athletic ball or an animal in the expanded state.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description.

What is claimed is:

1. A collapsible faceted object comprising:

a plurality of interconnected rigid facet panels, wherein the interconnected facet panels are formed by a plurality of pattern groups that are interconnected along a spine, each pattern group including a plurality of the facet panels;

wherein the facet panels are arranged so that the object can be in either a flat state or an expanded state;

wherein, in the flat state, the facet panels are substantially parallel to one another, the object having a first thickness in a direction perpendicular to the parallel facet panels when in the flat state, the object capable of remaining in the flat state without application of an external force; and wherein, in the expanded state, the object has a visually continuous outer surface that forms a closed three-dimensional shape, the object having a second thickness in the direction perpendicular to the parallel facet panels when in the flat state, wherein the second thickness is at least ten times larger than the first thickness, the object capable of remaining in the expanded state without application of the external force.

2. The object of claim 1, wherein each facet includes a rigid frame around a perimeter and a surface material within the rigid frame.

3. The object of claim 1, wherein the first thickness is about one inch or less and wherein the second thickness is about six inches or more.

4. The object of claim 1, wherein, in the expanded state, at least a portion of the object presents as a tear drop.

5. The object of claim 1, wherein a design is disposed on the outer surface of the object so that, in the expanded state, the object resembles a recognizable object.

6. The object of claim 1, wherein the facet panels include fixed facet panels arranged in a first direction and sliding facet panels arranged in a second direction different than the first direction, the position of the sliding facet panels being different relative to the fixed facet panels in the flat state compared to the expanded state.

7. The object of claim 1, wherein the pattern groups are formed from a unitary sheet of a hard-sided material.

8. The object of claim 1, further comprising an actuator cord having a first end attached to a first facet, the actuator cord extending through a hole in a second facet so that a second end of the actuator cord is outside the object when the object is in the expanded state.

9. A collapsible faceted object comprising:

a plurality of interconnected rigid facet panels, wherein the facet panels include fixed facet panels arranged in a first direction and sliding facet panels arranged in a second direction different than the first direction, and wherein the fixed facet panels are interconnected with the sliding facet panels by a sliding alignment guide mechanism that includes a male part and a female part;

wherein the facet panels are arranged so that the object can be in either a flat state or an expanded state, the position of the sliding facet panels being different relative to the fixed facet panels in the flat state compared to the expanded state;

wherein, in the flat state, the facet panels are substantially parallel to one another, the object having a first thickness in a direction perpendicular to the parallel facet panels when in the flat state, the object capable of remaining in the flat state without application of an external force; and wherein, in the expanded state, the object has a visually continuous outer surface that forms a closed three-dimensional shape, the object having a second thickness in the direction perpendicular to the parallel facet panels when in the flat state, wherein the second thickness is at least ten times larger than the first thickness, the object capable of remaining in the expanded state without application of the external force.

10. The object of claim 9, wherein the interconnected facet panels are formed by a plurality of pattern groups that are interconnected along a spine, each pattern group including a plurality of the facet panels.

11. A collapsible faceted object comprising:

a plurality of pattern groups interconnected along a spine, each pattern group including a plurality of rigid facet panels so that each facet panel of the plurality is attached to an adjacent facet panel in the respective pattern group by a flexible joint, wherein each facet panel of the plurality is spaced from another adjacent facet panel by an open space when the object is in a collapsed state and each facet panel has an edge that is parallel to an edge of the other adjacent facet panel when the object is in an expanded state; and a guide mechanism configured so that the object can be transformed from the collapsed state to the expanded state by simultaneously moving the facet panels to close the open spaces in a manner guided by the guide mechanism and so that the object can be transformed from the expanded state to the collapsed state by simultaneously moving the facet panels to create the open spaces between the facet panels in a manner guided by the guide mechanism.

12. The object of claim 11, wherein the guide mechanism comprises:

a plurality of sliding alignment guide tabs, each alignment guide tab being attached to an associated facet panel; and a plurality of tab slots, each tab slot associated with a respective one of the sliding alignment guide tabs.

13. The object of claim 12, wherein each sliding alignment guide tab is glued to the respective associated facet panel.

14. The object of claim 11, further comprising an actuator cord attached to a bottom one of the facet panels and extending through a top one of the facet panels, wherein the object is configured so that an alignment guide mechanism can guide the facet panels to move from the collapsed state to the expanded state in response to a force being applied to the actuator cord.

15. The object of claim 11, wherein, in the collapsed state, the facet panels are substantially parallel to one another, the object having a first thickness in a direction perpendicular to the parallel facet panels when in the collapsed state; and wherein, in the expanded state, the object has a continuous outer surface that forms a closed three-dimensional shape, the object having a second thickness greater than the first thickness in the direction perpendicular to the parallel facet panels when in the collapsed state.

16. The object of claim 15, wherein the first thickness is between three inches and six inches and the second thickness is 24 inches or more.

17. The object of claim 11, wherein a design is disposed on an outer surface of the object so that, in the expanded state, the object resembles a recognizable object.

18. A method of making a collapsible object, the method comprising:

forming a plurality of separate pattern groups from a hard-sided material, each pattern group including a plurality of facet panels separated by a flexible joint, wherein sliding alignment guide tabs are provided for the facet panels;

loading the pattern groups into a fixture in a layered manner so that the sliding alignment guide tabs of one pattern group overlies an adjacent pattern group;

attaching slot stiffener tabs to the pattern groups so that each slot stiffener tab overlies but is not attached to an associated on of the sliding alignment guide tabs thereby forming a guide tab slot; and attaching each pattern group to an adjacent pattern group.

19. The method of claim 18, wherein attaching the slot stiffener tabs to the pattern groups comprises:

aligning the slot stiffener tabs on a substrate;

attaching a glue material to the slot stiffener tabs;

positioning the substrate so that the glue material contacts the pattern groups; and removing the substrate leaving the slot stiffener tabs adhered to the facet panels of the pattern groups.

20. The method of claim 19, wherein the substrate comprises a sheet of the hard-sided material;

wherein aligning the slot stiffener tabs on the substrate comprises patterning the sheet to form the slot stiffener tabs, which remain attached to the sheet, and folding the slot stiffener tabs to create openings in the sheet; and wherein removing the substrate comprises removing the sheet from the facet panels so that the slot stiffener tabs are detached from the sheet and adhered to the facet panels.

21. A collapsible faceted object capable of being interchanged between a collapsed state and an expanded state, the object comprising:

a plurality of facet panels arranged in rows and columns, the columns including a central column and remaining columns;

wherein each facet panel in the central column is connected to an adjacent facet panel in the central column by a flexible joint, the central column forming a closed loop;

wherein, in each row, each facet panel in that row is connected to two adjacent facet panels in that row by respective flexible joints, each row forming a closed loop and having two facet panels that are also facet panels of the central column;

wherein, in each remaining column, each facet panel is connected to two adjacent facet panels in that remaining column, each remaining column forming a closed loop; and wherein, in each remaining column, each facet panel is spaced from a facet panel in an adjacent row when the object is in the collapsed state and touches the facet panel in the adjacent row when the object is in the expanded state.

22. The object of claim 21, wherein each row includes N facet panels, wherein N is an even integer greater than or equal to six, and wherein N/2 is an odd integer.

23. The object of claim 21, wherein the central column and the remaining columns terminate in a point when the object is in the expanded state.

24. The object of claim 21, wherein the central column and the remaining columns each have four triangular shaped facet panels, two of the four triangular facet panels meeting at a first point and the other two of the four triangular shaped facet panels meeting at a second point.

25. The object of claim 24, wherein the central column and the remaining columns each have a plurality of quadrilateral-shaped facet panels, each quadrilateral-shaped facet panel being connected to two adjacent facet panels in the same row by respective flexible joints.

* * * * *